US006502930B1

(12) United States Patent
Shimada et al.

(10) Patent No.: US 6,502,930 B1
(45) Date of Patent: Jan. 7, 2003

(54) INK JET RECORDING HEAD, METHOD FOR MANUFACTURING THE SAME, AND INK JET RECORDER

(75) Inventors: Masato Shimada, Nagano-ken (JP); Akira Matsuzawa, Nagano-ken (JP); Yoshinao Miyata, Nagano-ken (JP); Tsutomu Nishiwaki, Nagano-ken (JP); Hiroyuki Kamei, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/806,699

(22) PCT Filed: Aug. 4, 2000

(86) PCT No.: PCT/JP00/05251

§ 371 (c)(1),
(2), (4) Date: Apr. 4, 2001

(87) PCT Pub. No.: WO01/10646

PCT Pub. Date: Feb. 15, 2001

(30) Foreign Application Priority Data

| | | |
|---|---|---|
| Aug. 4, 1999 | (JP) | 11-221801 |
| Aug. 5, 1999 | (JP) | 11-222064 |
| Nov. 15, 1999 | (JP) | 11-324616 |
| Dec. 9, 1999 | (JP) | 11-350873 |
| Jan. 14, 2000 | (JP) | 2000-007152 |
| Feb. 18, 2000 | (JP) | 2000-041164 |
| Feb. 18, 2000 | (JP) | 2000-041495 |
| Mar. 24, 2000 | (JP) | 2000-085005 |
| Apr. 10, 2000 | (JP) | 2000-108264 |
| Apr. 12, 2000 | (JP) | 2000-110795 |

(51) Int. Cl.[7] ..... B41J 2/14
(52) U.S. Cl. ..... 347/71; 347/72
(58) Field of Search ..... 347/68, 69, 70, 347/71, 72

(56) References Cited

U.S. PATENT DOCUMENTS 5,265,315 A 11/1993 Hoisington et al. ..... 29/25.35

FOREIGN PATENT DOCUMENTS

| | | | |
|---|---|---|---|
| EP | 0738599 | * 10/1996 | ..... B41J/2/045 |
| EP | 0838336 A2 | 4/1998 | |
| JP | 58-102774 | 6/1983 | ..... B41J/3/04 |
| JP | 04-185348 | 7/1992 | |
| JP | 05-048235 | 2/1993 | |

(List continued on next page.)

*Primary Examiner*—Anh T. N. Vo
(74) *Attorney, Agent, or Firm*—Sughrue Mion, PLLC

(57) ABSTRACT

Disclosed are an ink-jet recording head, in which the rigidity of the compartment wall is improved, pressure generating chambers can be arranged in a high density, and cross talk between the pressure generating chambers is reduced, and a manufacturing method of the same and an ink-jet recording apparatus. In an ink-jet recording head including a passage-forming substrate (10) having a silicon layer consisting of single crystal silicon, in which a pressure generating chamber (15) communicating with a nozzle orifice is defined; and a piezoelectric element (300) for generating a pressure change in the pressure generating chamber, the piezoelectric element being provided on a region facing the pressure generating chamber (15) via a vibration plate constituting a part of the pressure generating chamber (15), the pressure generating chamber (15) is formed so as to open to one surface of the passage-forming substrate (10) and not to penetrate therethrough, at least a bottom surface of inner surfaces of the pressure generating chamber (15), which is facing to the one surface, is constituted of an etching stop surface as a surface in which anisotropic etching stops, and the piezoelectric element (300) is provided on the one surface side of the passage-forming substrate (10) by a film formed by film deposition technology and a lithography method.

85 Claims, 53 Drawing Sheets

FOREIGN PATENT DOCUMENTS

| | | | |
|---|---|---|---|
| JP | 5-286131 | 11/1993 | ..... B41J/2/045 |
| JP | 06-087217 | 3/1994 | |
| JP | 06-143566 | 5/1994 | |
| JP | 06-206315 | 7/1994 | |
| JP | 8-48038 | 2/1996 | ..... B41J/2/05 |
| JP | 9-156097 | 6/1997 | ..... B41J/2/045 |
| JP | 09-246234 | 9/1997 | |
| JP | 10-286960 | 10/1998 | ..... B41J/2/045 |
| JP | 10-290033 | 10/1998 | ..... H01L/41/09 |
| JP | 11-084273 | 3/1999 | |
| JP | 11-207954 | 8/1999 | |
| WO | 97/34769 | 9/1997 | ..... B41J/2/045 |

* cited by examiner (a)

(b)

(c)

(d)

(a)

(b)

(a)

(b)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

INK JET RECORDING HEAD, METHOD FOR MANUFACTURING THE SAME, AND INK JET RECORDER

TECHNICAL FIELD

The present invention relates to an ink-jet recording head, in which a piezoelectric element is formed via a vibration plate in a portion of a pressure generating chamber communicating with a nozzle orifice that ejects ink droplets, and ink droplets are ejected by displacement of the piezoelectric element, and to a manufacturing method of the same and an ink-jet recording apparatus.

BACKGROUND ART

With regard to the ink-jet recording head, in which a portion of a pressure generating chamber communicating with a nozzle orifice that ejects ink droplets is constituted of a vibration plate, and the vibration plate is deformed by a piezoelectric element to pressurize ink in the pressure generating chamber, thus ink droplets are ejected from the nozzle orifice, there are two types of recording heads put into practical use: one using a piezoelectric actuator of longitudinal vibration mode with a piezoelectric element expanding and contracting in the axis direction; and the other using a piezoelectric actuator of flexural vibration mode.

The former can change the volume of the pressure generating chamber by abutting an end surface of the piezoelectric element against the vibration plate, and manufacturing of a head suitable to high density printing is enabled. On the contrary, a difficult process, in which the piezoelectric element is cut and divided into a comb teeth shape to make it coincide with an array pitch of the nozzle orifices, and the operation of positioning and fixing the cut and divided piezoelectric element onto the pressure generating chamber are required, thus there is the problem of a complicated manufacturing process.

On the other hand, in the latter, the piezoelectric element can be fabricated and installed on the vibration plate by a relatively simple process, in which a green sheet as a piezoelectric material is adhered while fitting a shape thereof to the shape of the pressure generating chamber and is sintered. However, a certain size of vibration plate is required due to the usage of flexural vibration, thus there is the problem that a high density array of the piezoelectric elements is difficult.

Meanwhile, in order to solve such a disadvantage of the latter recording head, as shown in Japanese Patent Laid-Open No. Hei 5 (1993)-286131, a recording head is proposed, in which an even piezoelectric material layer is formed over the entire surface of the vibration plate by film deposition technology, the piezoelectric material layer is cut and divided into a shape corresponding to the pressure generating chamber by a lithography method, and the piezoelectric element is formed so as to be independent for each pressure generating chamber.

According to this, the operation of adhering the piezoelectric element onto the vibration plate is not required, and thus there is the advantage that not only the piezoelectric element can be fabricated and installed by accurate and simple means, that is, the lithography method, but also the thickness of the piezoelectric element can be thinned and a high-speed drive thereof is enabled.

Moreover, in such an ink-jet printing head, since the pressure generating chamber is formed so as to penetrate in the thickness direction of the head by performing etching to a plate from the surface opposite that having the piezoelectric element made thereon, a pressure generating chamber having a high dimensional accuracy can be arranged relatively easily with high density.

However, in such an ink-jet recording head, when a relatively large plate having a diameter of, for example, about 6 to 12 inches is to be used as the plate forming the pressure generating chamber, the thickness of the plate cannot help being thickened due to the problem of handling and the like, and accompanied with this, the depth of the pressure generating chamber is deepened. For this reason, if the thickness of a compartment wall partitioning the pressure generating chambers is not thickened, a sufficient rigidity is not obtained, thus there are problems that cross talk occurs, a desired ejection characteristic is not obtained, and so on. If the thickness of the compartment wall is thickened, nozzles cannot be arrayed in a high array density, thus there is the problem that printing quality with high resolution cannot be achieved.

On the other hand, in the piezoelectric actuator of the longitudinal vibration mode, a structure is conceived, in which the wide width portion is provided on the vibration plate side of the pressure generating chamber, the width of portions other than the wide width portion of the pressure generating chamber is reduced, and the thickness of the compartment walls is increased. In this case, however, an operation such as processing and pasting for the wide width portion of the pressure generating chamber is required, thus causing problems on operationality and accuracy.

In consideration of the foregoing circumstances, the object of the present invention is to provide an ink-jet recording head, in which the rigidity of the compartment wall is improved, the pressure generating chambers can be arranged in a high density, and cross talk between each pressure generating chamber is reduced, and to provide a manufacturing method of the same and an ink-jet recording apparatus.

DISCLOSURE OF THE INVENTION

A first aspect of the present invention for solving the above-described problems is an ink-jet recording head, which comprises: a passage-forming substrate having a silicon layer consisting of single crystal silicon, in which a pressure generating chamber communicating with a nozzle orifice is defined; and a piezoelectric element for generating a pressure change in the pressure generating chamber, the piezoelectric element being provided on a region facing the pressure generating chamber via a vibration plate constituting a part of the pressure generating chamber, characterized in that the pressure generating chamber is formed so as to open to one surface of the passage-forming substrate and not to penetrate there through, at least one bottom surface of the inner surfaces of the pressure generating chamber, the bottom surface facing to the one surface, is constituted of an etching stop surface as a surface in which anisotropic etching stops, and the piezoelectric element is provided on the one surface side of the passage-forming substrate by a film formed by film deposition technology and a lithography method.

In the first aspect, since the pressure generating chamber is formed without penetrating through the passage-forming substrate, the rigidity of the compartment wall partitioning the pressure generating chamber is maintained, crosstalk is restrained, and the ink-jet recording head having nozzle orifices in a high density can be mass-manufactured relatively readily.

A second aspect of the ink-jet recording head of the present invention according to the first aspect is characterized in that a piezoelectric layer constituting a part of the piezoelectric element has crystal subjected to priority orientation.

In the second aspect, crystal is subjected to priority orientation as a result of depositing the piezoelectric layer in a thin film step.

A third aspect of the ink-jet recording head of the present invention according to the second aspect is characterized in that the piezoelectric layer has crystal formed in a columnar shape.

In the third aspect, crystal is formed in a columnar shape as a result of depositing the piezoelectric layer in the thin film step.

A fourth aspect of the ink-jet recording head of the present invention according to any one of the first to third aspects is characterized in that the passage-forming substrate consists only of the silicon layer.

In the fourth aspect, the pressure generating chamber is defined only with the silicon layer.

A fifth aspect of the ink-jet recording head of the present invention according to the fourth aspect is characterized in that the passage-forming substrate consists of single crystal silicon of plane orientation (110), and the plane (110) formed by half etching which becomes the etching stop surface.

In the fifth aspect, the (110) plane of the passage-forming substrate becomes the bottom surface of the pressure generating chamber, and the pressure generating chamber is formed without penetrating through the passage-forming substrate.

A sixth aspect of the ink-jet recording head of the present invention according to the fourth aspect is characterized in that the passage-forming substrate consists of single crystal silicon of plane orientation (100), and the (111) plane becomes the etching stop surface.

In the sixth aspect, the (111) plane becomes the substantial bottom surface of the pressure generating chamber, and thus the pressure generating chamber is formed without penetrating through the passage-forming substrate.

A seventh aspect of the ink-jet recording head of the present invention according to the sixth aspect is characterized in that a cross section of the pressure generating chamber has an approximately triangular shape.

In the seventh aspect, since the rigidity of the compartment wall among the pressure generating chambers is significantly increased, the pressure generating chambers can be arranged in a high density, and crosstalk can be prevented.

An eighth aspect of the ink-jet recording head of the present invention according to any one of the sixth and seventh aspects is characterized in that, in the region of the vibration plate, which faces each of the pressure generating chambers, a protruding portion protruding toward the pressure generating chamber side is formed across a longitudinal direction.

In the eighth aspect, the protruding portion is formed in the vibration plate as a result of forming the pressure generating chamber by anisotropic etching.

A ninth aspect of the ink-jet recording head of the present invention according to any one of the sixth and seventh aspects is characterized in that a first film including an inner surface of the vibration plate constituting a part of the pressure generating chamber and a second film formed on the first film are provided, an etching hole for supplying an etching liquid to a surface of the one surface side of the passage-forming substrate in forming the pressure generating chamber is formed in the first film, and the etching hole is closed by the second film.

In the ninth aspect, since the pressure generating chamber is formed by etching the passage-forming substrate by an etching liquid supplied from the etching hole provided in the first film, the pressure generating chamber can be formed relatively readily with good accuracy. In addition, the etching hole can be closed readily and surely by the second film constituting the vibration plate.

A tenth aspect of the ink-jet recording head of the present invention according to the ninth aspect is characterized in that the etching hole is formed in the region facing the pressure generating chamber.

In the tenth aspect, the etching liquid is surely supplied to the surface of the passage-forming substrate via the etching hole.

An eleventh aspect of the ink-jet recording head of the present invention according to any one of the eighth to tenth aspects is characterized in that a protective layer having an opening portion in the region facing the pressure generating chamber is provided on the passage-forming substrate, and the pressure generating chamber is formed by etching the passage-forming substrate via the opening portion of the protective layer.

In the eleventh aspect, the pressure generating chamber can be formed with relatively good accuracy by etching the passage-forming substrate via the opening portion of the protective layer.

A twelfth aspect of the ink-jet recording head of the present invention according to the eleventh aspect is characterized in that the protective layer is a polycrystal silicon layer having boron diffused therein.

In the twelfth aspect, the protective layer that will be a mask in forming the pressure generating chamber by etching can be formed relatively readily.

A thirteenth aspect of the ink-jet recording head of the present invention according to any one of the eleventh and twelfth aspects is characterized in that the etching hole is provided outside of the region facing the pressure generating chamber, and a space portion communicating with this etching hole is defined between the first film and the protective film.

In the thirteenth aspect, the pressure generating chamber is formed by etching the passage-forming substrate from the etching hole via the space portion.

A fourteenth aspect of the ink-jet recording head of the present invention according to any one of the ninth to thirteenth aspects is characterized in that the pressure generating chamber is formed in an elongate shape, and the etching hole consists of a slit formed along the longitudinal direction of the pressure generating chamber.

In the fourteenth aspect, since the etching hole consists of a slit, the passage-forming substrate can be surely etched via the etching hole, and thus the pressure generating chamber can be formed readily with good accuracy.

A fifteenth aspect of the ink-jet recording head of the present invention according to any one of the ninth to thirteenth aspects is characterized in that the etching hole consists of a plurality of pores provided at a specified interval.

In the fifteenth aspect, since the etching hole consists of pores provided in a plurality of spots, the passage-forming substrate can be surely etched via the etching hole.

A sixteenth aspect of the ink-jet recording head of the present invention according to any one of the ninth to fifteenth aspects is characterized in that a lower electrode film constituting the piezoelectric element is formed on the second film, and the piezoelectric layer constituting the piezoelectric element is formed on the lower electrode film.

In the sixteenth aspect, since the lower electrode film is formed on the second film, the strength of the vibration plate is increased.

A seventeenth aspect of the ink-jet recording head of the present invention according to any one of the ninth to fifteenth aspects is characterized in that the second film constitutes the lower electrode film constituting the piezoelectric element, and the piezoelectric layer constituting the piezoelectric element is directly formed on the second film.

In the seventeenth aspect, since the lower electrode film doubles as the second film constituting the vibration plate, the manufacturing process can be simplified.

An eighteenth aspect of the ink-jet recording head of the present invention according to any one of the ninth to seventeenth aspects is characterized in that the first film is any one of a silicon oxide film, a silicon nitride film and a zirconium oxide film.

In the eighteenth aspect, the first film having a superior etching resistance can be formed relatively readily.

A nineteenth aspect of the ink-jet recording head of the present invention according to any one of the ninth to eighteenth aspects is characterized in that the second film is any one of a silicon oxide film, a silicon nitride film and a zirconium oxide film, alternatively a laminated film obtained by laminating any of the films.

In the nineteenth aspect, the second film constituting a part of the vibration plate can be readily formed. In addition, the strength of the vibration plate can be adjusted by forming the second film as a laminated film.

A twentieth aspect of the ink-jet recording head of the present invention according to any one of the ninth to nineteenth aspects is characterized in that the inner surface of the vibration plate forming a part of the inner wall surfaces of the pressure generating chamber forms a convex shape toward the direction of the piezoelectric element, and the vibration plate forms a convex shape toward the direction of the piezoelectric element so as to correspond to the convex shape of the inner surface of the vibration plate.

In the twentieth aspect, the pressure generating chamber can be formed relatively readily with good accuracy.

A twenty-first aspect of the ink-jet recording head of the present invention according to any one of the first to third aspects is characterized in that the passage-forming substrate has an insulation layer and passage layers, any one of which is a silicon layer, on both surfaces of said insulation layer, and a surface of the insulating layer becomes the etching stop surface.

In the twenty-first aspect, when the pressure generating chamber is formed in the silicon layer by etching, etching stops readily and surely by the insulating layer. In addition, since the thickness of the passage-forming substrate is thickened, handling thereof is facilitated.

A twenty-second aspect of the ink-jet recording head of the present invention according to any one of the first to twenty-first aspects is characterized in that a reservoir supplying ink to the pressure generating chamber is formed in the other surface side of the passage-forming substrate.

In the twenty-second aspect, since the reservoir having a volume sufficiently large for the volume of the pressure generating chamber is provided, pressure change in the reservoir is absorbed by ink itself therein.

A twenty-third aspect of the ink-jet recording head of the present invention according to the twenty-second aspect is characterized in that the reservoir directly communicates with the pressure generating chamber.

In the twenty-third aspect, ink is directly supplied from the reservoir to each pressure generating chamber.

A twenty-fourth aspect of the ink-jet recording head of the present invention according to the twenty-second aspect is characterized in that an ink communicating passage communicating with one end portion in the longitudinal direction of the pressure generating chamber is formed on one surface side of the passage-forming substrate, and the reservoir is made to communicate with the ink communicating passage.

In the twenty-fourth aspect, since ink is supplied from the reservoir via the ink communicating passage to each pressure generating chamber, even if a sectional area of communicating portion between the reservoir and the ink communicating passage varies, resistance of ink can be controlled with a narrowed portion, and variety in the ink ejection characteristics among the pressure generating chambers can be reduced.

A twenty-fifth aspect of the ink-jet recording head of the present invention according to the twenty-fourth aspect is characterized in that the ink communicating passage is provided for each of the pressure generating chambers.

In the twenty-fifth aspect, ink is supplied from the reservoir to each pressure generating chamber via the ink communicating passage provided for each pressure generating chamber.

A twenty-sixth aspect of the ink-jet recording head of the present invention according to the twenty-fourth aspect is characterized in that the ink communicating passage is continuously provided across the direction where the pressure generating chambers are parallelly provided.

In the twenty-sixth aspect, ink is supplied from the reservoir via a common ink communicating passage to each pressure generating chamber.

A twenty-seventh aspect of the ink-jet recording head of the present invention according to any one of the twenty-second to twenty sixth aspects is characterized in that the pressure generating chambers are parallelly provided along the longitudinal direction thereof, and the reservoir is provided between the pressure generating chambers parallelly provided along the longitudinal direction, and communicates with the pressure generating chambers at both sides.

In the twenty-seventh aspect, since the pressure generating chambers communicating with the reservoir are parallelly provided at both sides of the reservoir, arrangement of the ink supply passages and the pressure generating chambers in a higher density is achieved.

A twenty-eighth aspect of the ink-jet recording head of the present invention according to any one of the first to twenty-first aspects is characterized in that the pressure generating chambers are formed on both surfaces of the passage-forming substrate.

In the twenty-eighth aspect, since the pressure generating chambers can be arranged in a high density without damaging the rigidity of the compartment wall of the pressure generating chamber, it is possible to highly densify the heads.

A twenty-ninth aspect of the ink-jet recording head of the present invention according to any one of the first to twenty-eighth aspects is characterized in that the film constituting the piezoelectric element is provided on the pressure generating chamber and is a film formed on a sacrificial layer finally removed.

In the twenty-ninth aspect, the piezoelectric element can be readily formed in the region facing the pressure generating chamber in a thin film process by filling the pressure generating chamber with the sacrificial layer.

A thirtieth aspect of the ink-jet recording head of the present invention according to any one of the first to twenty-ninth aspects is characterized in that the depth of the pressure generating chamber ranges between 20 $\mu$m and 100 $\mu$m.

In the thirtieth aspect, the rigidity of the compartment wall is maintained by forming the pressure generating chamber so as to have a specified width.

A thirty-first aspect of the ink-jet recording head of the present invention according to any one of the first to thirtieth aspects is characterized in that a nozzle communicating passage allowing the pressure generating chamber and the nozzle orifice to communicate with each other is provided.

In the thirty-first aspect, ink is ejected from the pressure generating chamber via the nozzle communicating passage and the nozzle orifice.

A thirty-second aspect of the ink-jet recording head of the present invention according to the thirty-first aspect is characterized in that the nozzle communicating passage is provided in one end portion side in the longitudinal direction of the pressure generating chamber, which is opposite to that having the reservoir.

In the thirty-second aspect, ink is stably supplied from the reservoir to the pressure generating chamber, and ink is favorably ejected from the nozzle orifice.

A thirty-third aspect of the ink-jet recording head of the present invention according to any one of the nineteenth and twentieth aspects is characterized in that the nozzle communicating passage is formed by removing the vibration plate.

In the thirty-third aspect, the nozzle communicating passage can be formed readily.

A thirty-fourth aspect of the ink-jet recording head of the present invention according to the thirty-third aspect is characterized in that an inner surface of the nozzle communicating passage is covered with adhesive.

In the thirty-fourth aspect, exfoliation of the vibration plate due to ink passing through the nozzle communicating passage is prevented.

A thirty-fifth aspect of the ink-jet recording head of the present invention according to any one of the twenty-first to thirty-fourth aspects is characterized in that the passage-forming substrate consists of an SOI substrate having silicon layers on both surfaces of the insulating layer, the pressure generating chamber is formed on one of the silicon layers constituting the SOI substrate, and the surface of the insulting layer becomes the etching stop surface.

In the thirty-fifth aspect, when the pressure generating chamber is formed in the silicon layer by etching, etching stops readily and surely by the insulating layer.

A thirty-sixth aspect of the ink-jet recording head of the present invention according to the thirty-fifth aspect is characterized in that each of the silicon layers constituting the SOI substrate has a thickness different from that of the other, and the one silicon layer having the pressure generating chambers formed thereon is thinner than the other silicon layer.

In the thirty-sixth aspect, the pressure generating chamber is formed relatively shallowly, the rigidity of the compartment wall partitioning the pressure generating chambers is increased, and crosstalk is restrained.

A thirty-seventh aspect of the ink-jet recording head of the present invention according to any one of the thirty-fifth and thirty-sixth aspects is characterized in that the nozzle communicating passage allowing the pressure generating chamber and the nozzle orifice to communicate with each other is formed in one of the silicon layers constituting the SOI substrate.

In the thirty-seventh aspect, since the nozzle communicating passage is formed in the same layer as that having the pressure generating chamber, the head can be miniaturized.

A thirty-eighth aspect of the ink-jet recording head of the present invention according to any one of the thirty-fifth and thirty-sixth aspects is characterized in that the nozzle communicating passage allowing the pressure generating chamber and the nozzle orifice to communicate with each other penetrates the insulating layer constituting the SOI substrate and is formed on the other silicon layer, and the nozzle orifice is provided on the surface side of the other silicon layer.

In the thirty-eighth aspect, the ink-jet recording head of a type having the nozzle orifice on the surface of the passage-forming substrate, which is opposite to that having the piezoelectric element, is realized.

A thirty-ninth aspect of the ink-jet recording head of the present invention according to the thirty-seventh aspect is characterized in that a sealing plate having a space for sealing the piezoelectric element inside thereof is joined onto the vibration plate, and the nozzle orifice is formed on the sealing plate.

In the thirty-ninth aspect, the ink-jet recording head of a type having the nozzle orifice at the piezoelectric element side of the passage-forming substrate is realized. In addition, one substrate can combine a sealing function and a nozzle function.

A fortieth aspect of the ink-jet recording head of the present invention according to the thirty-seventh aspect is characterized in that the nozzle communicating passage is extended from the end portion in the longitudinal direction of the pressure generating chamber, and the nozzle orifice is provided at the end surface side of the passage-forming substrate.

In the fortieth aspect, the ink-jet recording head of a type having the nozzle orifice at the end surface side of the passage-forming substrate.

A forty-first aspect of the ink-jet recording head of the present invention according to the fortieth aspect is characterized in that the nozzle communicating passage is extended to the end surface of the passage-forming substrate, and a nozzle plate having the nozzle orifice is joined to the end surface of the passage-forming substrate.

In the forty-first aspect, the nozzle orifice can be formed relatively readily at the end surface side of the passage-forming substrate.

A forty-second aspect of the ink-jet recording head of the present invention according to the fortieth aspect is characterized in that the nozzle orifice is formed on an end portion of the nozzle communicating passage by removing a portion in the height direction of the silicon layer.

In the forty-second aspect, the nozzle orifice can be formed relatively readily in the passage-forming substrate together with the pressure generating chamber.

A forty-third aspect of the ink-jet recording head of the present invention according to any one of the thirty-ninth to forty-second aspects is characterized in that an IC is integrally formed in the sealing plate.

In the forty-third aspect, the IC is integrally formed in the sealing plate joined to the passage-forming substrate, thus the manufacturing process can be simplified, and the number of parts can be reduced, leading to cost reduction.

A forty-fourth aspect of the ink-jet recording head of the present invention according to any one of the twenty-first to forty-third aspects is characterized in that the plane orientation of the silicon layer is a (001) plane.

In the forty-fourth aspect, the reservoir and the like can be formed with high accuracy also by wet etching.

A forty-fifth aspect of the ink-jet recording head of the present invention according to the forty-fourth aspect is characterized in that the longitudinal direction of the pressure generating chamber is a <110> direction.

In the forty-fifth aspect, the pressure generating chambers can be formed with good accuracy and high density.

A forty-sixth aspect of the ink-jet recording head of the present invention according to any one of the twenty-first to forty-third aspects is characterized in that the main plane of the silicon layer where the pressure generating chamber is formed has a (110) orientation, and the longitudinal direction of the pressure generating chamber is a <1-12> direction.

In the forty-sixth aspect, the pressure generating chambers can be formed with good accuracy and high density.

A forty-seventh aspect of the present invention is an ink-jet recording apparatus characterized by comprising the ink-jet recording head according to any one of the first to forty-sixth aspects.

In the forty-seventh aspect, an ink-jet recording apparatus can be realized, in which the ink ejection performance of the heads is improved and the heads are highly densified.

A forty-eighth aspect of the present invention is a method of manufacturing an ink-jet recording head, in which a piezoelectric element allowing a pressure generating chamber to generate a pressure change via a vibration plate is formed in a region facing the pressure generating chamber formed in a passage-forming substrate, the method of manufacturing an ink-jet recording head characterized by comprising the steps for: forming the pressure generating chamber on a passage-forming substrate having at least a silicon layer consisting of single crystal silicon without penetrating in the height direction of the passage-forming substrate; filling the pressure generating chamber with a sacrificial layer; forming the vibration plate on the sacrificial layer side of the passage-forming substrate and forming the piezoelectric element in the region facing the pressure generating chamber; and removing the sacrificial layer filled in the pressure generating chamber.

In the forty-eighth aspect, the pressure generating chamber can be formed relatively readily without penetrating the passage-forming substrate.

A forty-ninth aspect of the method of manufacturing the ink-jet recording head of the present invention according to the forty-eighth aspect is characterized in that the passage-forming substrate consists of an SOI substrate having silicon layers consisting of single crystal silicon on both surfaces of an insulating layer, and in the step where a pressure generating chamber is formed, one of the silicon layers of the SOI substrate is patterned to form the pressure generating chamber.

In the forty-ninth aspect, the pressure generating chamber can be formed relatively readily without penetrating the passage-forming substrate.

A fiftieth aspect of the method of manufacturing the ink-jet recording head of the present invention according to any one of the forty-eighth and forty-ninth aspects is characterized in that, during the step where a pressure generating chamber is formed, a nozzle communicating passage communicating with the nozzle orifice from an end portion in the longitudinal direction of the pressure generating chamber is formed.

In the fiftieth aspect, the pressure generating chamber and the nozzle communicating passage can be simultaneously formed in the passage-forming substrate.

A fifty-first aspect of the method of manufacturing the ink-jet recording head of the present invention according to the fiftieth aspect is characterized in that an ink communicating passage allowing one side surface of the silicon layer and the pressure generating chamber to communicate with each other is formed, and in the step of removing a sacrificial layer, the sacrificial layer is removed by wet etching via the ink communicating passage.

In the fifty-first aspect, the sacrificial layer can be removed relatively readily and surely by performing wet etching via the ink communicating passage.

A fifty-second aspect of the method of manufacturing the ink-jet recording head of the present invention according to any one of the forty-eighth to fiftieth aspects is characterized in that the step of removing the sacrificial layer is performed by etching via an opening portion penetrating the vibration plate to expose the sacrificial layer.

In the fifty-second aspect, the sacrificial layer can be removed relatively readily and surely by etching via the opening portion.

A fifty-third aspect of the method of manufacturing the ink-jet recording head of the present invention according to any one of the forty-eighth to fifty-second aspects is characterized in that the step of filling with a sacrificial layer includes: the step of forming the sacrificial layer so as to have at least a thickness approximately equal to the depth of the pressure generating chamber in a region corresponding to the pressure generating chamber of the passage-forming substrate; and the step of removing a sacrificial layer other than that of the pressure generating chamber by polishing.

In the fifty-third aspect, the pressure generating chamber can be filled with the sacrificial layer readily and surely.

A fifty-fourth aspect of the method of manufacturing an ink-jet recording head of the present invention according to the fifty-third aspect is characterized in that the sacrificial layer is formed by a jet molding method.

In the fifty-fourth aspect, the sacrificial layer can be partially formed, and the pressure generating chamber can be filled with the sacrificial layer relatively readily.

A fifty-fifth aspect of the method of manufacturing the ink-jet recording head of the present invention according to any one of the forty-eighth to fifty-fourth aspects is characterized in that the sacrificial layer is selected from a group consisting of phosphorous-doped silicate glass (PSG), boron phosphorous-doped silicate glass (BPSG), silicon oxide (SiOx) and silicon nitride (SiNx).

In the fifty-fifth aspect, the sacrificial layer can be removed readily and surely by using a specified material therefor.

A fifty-sixth aspect of the method of manufacturing the ink-jet recording head of the present invention according to any one of the forty-eighth to fifty-fifth aspects is characterized in that the insulating layer is formed as the vibration plate, and a lower electrode layer, a piezoelectric layer and an upper electrode layer are sequentially formed in a laminated state on the insulating layer and patterned to form the piezoelectric element.

In the fifty-sixth aspect, the piezoelectric element of a flexural vibration mode can be formed relatively readily.

A fifty-seventh aspect of the method of manufacturing the ink-jet recording head of the present invention according to the fifty-sixth aspect is characterized in that the vibration plate doubles as the lower electrode layer.

In the fifty-seventh aspect, the structure of the head can be simplified, and the number of manufacturing steps can be reduced.

A fifty-eighth aspect of the method of manufacturing the ink-jet recording head of the present invention according to any one of the forty-eighth to fifty-seventh aspects is characterized in that the pressure generating chamber and an ink passage are formed by anisotropic etching.

In the fifty-eighth aspect, the pressure generating chambers can be formed with good accuracy and high density.

A fifty-ninth aspect of the present invention is a method of manufacturing an ink-jet recording head, which comprises: a passage-forming substrate consisting of a single crystal silicon substrate, in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, the method of manufacturing an ink-jet recording head characterized by comprising the steps of: forming a region that will be a space portion between the vibration plate and the passage-forming substrate on a side of the passage-forming substrate where the vibration plate is formed; forming the vibration plate on a surface of the passage-forming substrate; laminating sequentially the lower electrode film, the piezoelectric layer and the upper electrode film on the vibration plate and patterning the same to form the piezoelectric element; and forming the pressure generating chamber by performing anisotropic etching for the passage-forming substrate from the piezoelectric element side via the space portion.

In the fifty-ninth aspect, the pressure generating chambers can be formed relatively readily with good accuracy and high density.

A sixtieth aspect of the method of manufacturing the ink-jet recording head of the present invention according to the fifty-ninth aspect is characterized in that the step of forming a space portion includes: a first depositing step of forming a polycrystal silicon film on one surface of the passage-forming substrate; and a boron diffusing step of diffusing highly concentrated boron in a region of the polycrystal silicon film, which excludes the region corresponding to the pressure generating chamber portion in the passage-forming substrate, and the step for forming a pressure generating chamber includes: a hole forming step for removing the other part of the region of the vibration plate, the region corresponding to the pressure generating chamber portion in the passage-forming substrate, to form an etching hole; and the step of removing a portion of the polycrystal silicon film where boron is not diffused and one side surface portion of the passage-forming substrate under the portion by anisotropic wet etching from the etching hole.

In the sixtieth aspect, since a portion of the polycrystal silicon film, which has boron diffused therein, is not removed by anisotropic wet etching, a pressure generating chamber of a specified shape can be formed readily with good accuracy.

A sixty-first aspect of the method of manufacturing the ink-jet recording head of the present invention according to the sixtieth aspect is characterized in that the boron diffusing step diffuses boron so that an element containing density thereof can be $1\times10^{20}$ number/cm$^3$ or more.

In the sixty-first aspect, a specified amount of boron is diffused, thus etching surely stops by this portion where boron is diffused when the polycrystal silicon film is removed by etching.

A sixty-second aspect of the method of manufacturing the ink-jet recording head of the present invention according to any one of the sixtieth and sixty-first aspects is characterized in that the boron diffusing step includes: a mask forming step of forming a mask film on an upper surface of a region of the polycrystal silicon film, the region corresponding to the pressure generating chamber portion in the passage-forming substrate; a boron imparting step of imparting boron to approximately the entire surface of the upper surface of the polycrystal silicon film; and a mask removing step of removing the mask film.

In the sixty-second aspect, boron can be diffused relatively readily in a specified region.

A sixty-third aspect of the method of manufacturing an ink-jet recording head of the present invention according to any one of the fifty-ninth to sixty-second aspects is characterized by further comprising a reservoir forming step of forming a reservoir reaching the pressure generating chamber from the other side surface of the passage-forming substrate.

In the sixty-third aspect, the reservoir can be formed relatively readily with good accuracy.

A sixty-fourth aspect of the method of manufacturing an ink-jet recording head of the present invention according to the sixty-third aspect is characterized in that the passage-forming substrate is entirely constituted of single crystal silicon, and the reservoir forming step includes: a third depositing step of forming a protective film on the other side surface of the passage-forming substrate; a hole forming step of removing a region of the protective film, which corresponds to a reservoir forming portion in the passage-forming substrate, to form an etching hole; and a reservoir etching step of removing the reservoir forming portion reaching the pressure generating chamber from the other side surface of the passage-forming substrate by anisotropic wet etching from the etching hole.

In the sixty-fourth aspect, the reservoir can be formed in the passage-forming substrate consisting of single crystal silicon relatively readily and surely.

A sixty-fifth aspect of the method of manufacturing the ink-jet recording head of the present invention according to the sixty-fourth aspect is characterized in that the passage-forming substrate is an SOI substrate in which the other side surface is constituted of single crystal silicon and the center portion is constituted of an insulating layer, the pressure generating chamber forming step forms the pressure generating chamber so that a bottom portion of the pressure generating chamber can be regulated by the insulating layer, and the reservoir forming step includes: a third depositing step of forming a protective film on the other side surface of the passage-forming substrate; a hole forming step of removing a region of the protective film, which corresponds to a reservoir forming portion in the passage-forming substrate, to form an etching hole; a reservoir etching step of removing a first reservoir forming portion reaching the insulating layer from the other side surface of the passage-forming substrate by anisotropic wet etching from the etching hole; and an insulating layer removing step of removing a part of the insulating layer to form a second reservoir forming portion allowing the pressure generating chamber and the first reservoir forming portion to communicate with each other.

In the sixty-fifth aspect, the reservoir can be formed in the passage-forming substrate consisting of the SOI substrate relatively readily and surely.

A sixty-sixth aspect of the method of manufacturing the ink-jet recording head of the present invention according to any one of the sixty-fourth and sixty-fifth aspects is characterized in that the protective film is selected from a group consisting of silicon nitride, silicon dioxide and zirconium oxide.

In the sixty-sixth aspect, the protective film is formed of a specified material, thus the reservoir can be surely formed with the protective film as a mask.

A sixty-seventh aspect of the method of manufacturing the ink-jet recording head of the present invention according to any one of the sixty-third to sixty-sixth aspects is characterized in that the pressure generating chamber forming step and the reservoir etching step are simultaneously executed.

In the sixty-seventh aspect, the manufacturing process is simplified, and the manufacturing cost can be reduced.

A sixty-eighth aspect of the method of manufacturing the ink-jet recording head of the present invention according to any one of the fifty-ninth to sixty-seventh aspects is characterized by further comprising the protective film forming step of forming a protective film protecting the piezoelectric element after the step of forming the piezoelectric element.

In the sixty-eighth aspect, destruction of the piezoelectric element due to etching is prevented.

A sixty-ninth aspect of the method of manufacturing the ink-jet recording head of the present invention according to the sixty-eighth aspect is characterized in that a hole forming step is constituted for removing the other part of a region of an elastic film and the protective film, which corresponds to the pressure generating chamber forming portion in the passage-forming substrate.

In the sixty-ninth aspect, the etching hole can be surely formed without destroying the piezoelectric element.

A seventieth aspect of the method of manufacturing an ink-jet recording head of the present invention according to the fifty-ninth aspect is characterized in that the passage-forming substrate consists of a single crystal silicon substrate of crystal plane orientation (100), the step of forming the space portion includes the step of forming a groove portion having a width narrower than the pressure generating chamber in the region of the passage-forming substrate where the pressure generating chamber is formed, and the step of forming the pressure generating chamber includes: the step of patterning the vibration plate to form a communicating hole communicating with the groove portion in a region respectively facing the groove portion; and the step of forming the pressure generating chamber in an approximately triangular shape in a cross section by performing anisotropic etching for the passage-forming substrate via the communicating hole.

In the seventieth aspect, the pressure generating chambers can be formed relatively readily with good accuracy and high density.

A seventy-first aspect of the method of manufacturing the ink-jet recording head of the present invention according to the seventieth aspect is characterized in that the groove portion is formed to have a depth shallower than that of the pressure generating chamber.

In the seventy-first aspect, the pressure generating chamber can be formed by anisotropic etching readily with high accuracy.

A seventy-second aspect of the method of manufacturing the ink-jet recording head of the present invention according to the fifty-ninth aspect is characterized in that the step of forming a space portion includes: a first etching step of etching a part of the surface of the passage-forming substrate so as to leave a plurality of columnar portions; and a transforming and flattening step of transforming the chemical property of the plurality of columnar portions and flattening a part of the surface, and the step of forming a pressure generating chamber includes: a hole forming step of removing the other part of the region of the vibration plate, which corresponds to the pressure generating chamber forming portion in the passage-forming substrate, to form an etching hole; and a second etching step of etching the plurality of columnar portions having a chemical property transformed by anisotropic wet etching from the etching hole to form the pressure generating chamber.

In the seventy-second aspect, since it is not necessary to newly deposit a sacrificial layer, the manufacturing time is significantly shortened.

A seventy-third aspect of the method of manufacturing an ink-jet recording head of the present invention according to the seventy-second aspect is characterized in that the transforming and flattening step includes a thermally oxidizing step of thermally oxidizing the plurality of columnar portions.

In the seventy-third aspect, the columnar portions can be flattened readily and surely by thermally oxidizing the columnar portions.

A seventy-fourth aspect of the method of manufacturing an ink-jet recording head of the present invention according to the seventy-third aspect is characterized in that the transforming and flattening step includes a sacrificial layer filling step of filling spaces of the plurality of columnar portions with the sacrificial layer.

In the seventy-fourth aspect, the columnar portions can be readily flattened by the sacrificial layer.

A seventy-fifth aspect of the method of manufacturing an ink-jet recording head of the present invention according to any one of the seventy-second to seventy-fourth aspects is characterized in that the plurality of columnar portions are formed to be arranged approximately uniformly on a part of the surface.

In the seventy-fifth aspect, the columnar portions can be surely removed by etching.

A seventy-sixth aspect of the method of manufacturing an ink-jet recording head of the present invention according to any one of the seventy-second to seventy-fifth aspects is characterized in that each of the plurality of columnar portions has a sectional area of a surface side thereof, which is larger than that of the bottom portion side thereof.

In the seventy-sixth aspect, the columnar portions can be flattened relatively readily and can be surely removed by etching.

A seventy-seventh aspect of the method of manufacturing the ink-jet recording head of the present invention according to any one of the seventy-second to seventy-sixth aspects is characterized in that the shape of the pressure generating chamber is approximately hexagonal.

In the seventy-seventh aspect, the pressure generating chamber can be formed relatively readily with high accuracy by etching.

A seventy-eighth aspect of the present invention is a method of manufacturing an ink-jet recording head, which comprises: a passage-forming substrate consisting of a single crystal silicon substrate of crystal plane orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, the method of manufacturing an ink-jet recording head characterized by comprising the steps of: forming a polycrystal silicon film on a surface of the passage-forming substrate of (100) plane orientation, which includes the surface and a back surface; diffusing boron in the vicinity of inner surfaces of the polycrystal silicon film and the single crystal silicon substrate excluding the region that will be the pressure generating chamber; forming a first film on the polycrystal silicon film; forming an etching hole in the first film for supplying an etching liquid to the portion where the pressure generating chamber is formed; supplying an etching liquid to the portion where the pressure generating chamber is formed via the etching hole, and the surface of the single crystal silicon substrate is etched by anisotropic wet etching by means of a pattern of an undoped portion of the polycrystal silicon film etched by isotropic wet etching by use of the etching liquid; and forming a second film on the first film to close the etching hole.

In the seventy-eighth aspect, the manufacturing process can be simplified, and the pressure generating chamber can be formed with good accuracy.

A seventy-ninth aspect of the present invention is a method of manufacturing an ink-jet recording head, which comprises: a passage-forming substrate consisting of a single crystal silicon substrate of crystal face orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, the method of manufacturing an ink-jet recording head characterized by comprising the steps of: forming a polycrystal silicon film on a surface of the passage-forming substrate of (100) plane orientation, which includes the surface and a back surface; removing the polycrystal silicon film excluding the region that will be the pressure generating chamber to form a polycrystal silicon film of a specified pattern; forming a first film on the polycrystal silicon film of a specified pattern and on the surface of the single crystal silicon substrate; forming an etching hole for supplying an etching liquid to a portion where the pressure generating chamber is formed in the first film; supplying the etching liquid to the portion where the pressure generating chamber is formed via the etching hole, and the surface of the single crystal silicon substrate is etched by anisotropic wet etching by means of the specified pattern of the polycrystal silicon film etched by isotropic wet etching by use of the etching liquid; and forming a second film on the first film to close the etching hole.

In the seventy-ninth aspect, the manufacturing process can be simplified, and the pressure generating chamber can be formed with good accuracy.

An eightieth aspect of the present invention is a method of manufacturing an ink-jet recording head, which comprises: a passage-forming substrate consisting of a single crystal silicon substrate of crystal face orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, the method of manufacturing an ink-jet recording head characterized by comprising the steps of: forming a protective layer on a surface of the passage-forming substrate of (100) plane orientation, which includes the surface and a back surface, and forming an opening portion in a region of the protective layer, which will be the pressure generating chamber; forming a sacrificial layer on this protective layer and patterning the sacrificial layer to leave at least the region covering the opening portion as a remaining portion; forming a first film on this sacrificial layer; forming an etching hole communicating with a peripheral portion of the sacrificial layer formed on the protective layer; supplying an etching liquid via the etching hole to remove the sacrificial layer, and performing anisotropic etching for the passage-forming substrate from the surface side by the specified pattern of the protective layer to form the pressure generating chamber; and forming a second film on the first film to close the etching hole.

In the eightieth aspect, the manufacturing process can be simplified, and the pressure generating chamber can be formed with good accuracy.

An eighty-first aspect of the method of manufacturing the ink-jet recording head of the present invention according to the eightieth aspect is characterized in that, in the step of patterning the sacrificial layer, a groove portion is formed across a periphery of the opening portion of the protective layer.

In the eighty-first aspect, the manufacturing process can be simplified, and the pressure generating chamber can be formed with good accuracy.

An eighty-second aspect of the method of manufacturing the ink-jet recording head of the present invention according to any one of the seventy-eighth to eighty-first aspects is characterized in that the pressure generating chamber is formed in an elongate shape, and the etching hole consists of a slit formed along a longitudinal direction of the pressure generating chamber.

In the eighty-second aspect, since the etching hole consists of the slit, the passage-forming substrate can be surely etched via the etching hole, and the pressure generating chamber can be formed readily with good accuracy.

An eighty-third aspect of the method of manufacturing an ink-jet recording head of the present invention according to any one of the seventy-sixth to seventy-ninth aspects is characterized in that the etching hole consists of a plurality of pores formed at a specified interval.

In the eighty-third aspect, since the etching hole consists of a plurality of pores, the passage-forming substrate can be surely etched via the etching hole, and the pressure generating chamber can be formed readily with good accuracy.

An eighty-fourth aspect of the present invention is a method of manufacturing an ink-jet recording head, in which a pressure generating chamber is formed on a passage-forming substrate, and a piezoelectric element consisting of a lower electrode, a piezoelectric layer and an upper electrode is formed on one surface of the passage-forming substrate via a vibration plate, the method of manufacturing an ink-jet recording head characterized by comprising the steps of: forming the passage-forming substrate having a silicon layer consisting of a single crystal silicon substrate on each of both surfaces of a polysilicon layer to which etching selectivity is imparted by doping boron in a region other than that having the pressure generating chamber formed therein; laminating sequentially the lower electrode, the piezoelectric layer and the upper electrode on one silicon layer side of the passage-forming substrate via the vibration plate and patterning the same to form the piezoelectric element; etching the other silicon layer of the passage-forming substrate to reach the polysilicon layer, thus forming an ink introducing port, patterning the polysilicon layer in the region that will be the pressure generating chamber via the ink introducing port, and etching the one silicon layer with the polysilicon layer as a mask, to form the pressure generating chamber.

In the eighty-fourth aspect, the passage-forming substrate is selectively etched via the ink introducing port, thus making it possible to form the pressure generating chamber relatively readily. In addition, since the pressure generating chamber and the like can be formed by etching the passage-forming substrate from the surface opposite that having the piezoelectric element, protectability for the piezoelectric layer is improved, and operational efficiency is improved.

An eighty-fifth aspect of the method of manufacturing an ink-jet recording head of the present invention according to the eighty-fourth aspect is characterized in that the step of forming the passage-forming substrate includes a step of doping boron on a surface of the other silicon layer joining the polysilicon layer, which is at least a surface layer of the region facing the pressure generating chamber.

In the eighty-fifth aspect, when one silicon layer is etched via the ink introducing port, the other silicon layer is not etched, thus the pressure generating chamber can be formed relatively readily.

BEST MODE FOR CARRYING OUT THE PRESENT INVENTION

The present invention will be described in detail based on the embodiments below.

(Embodiment 1)

Figure 1:
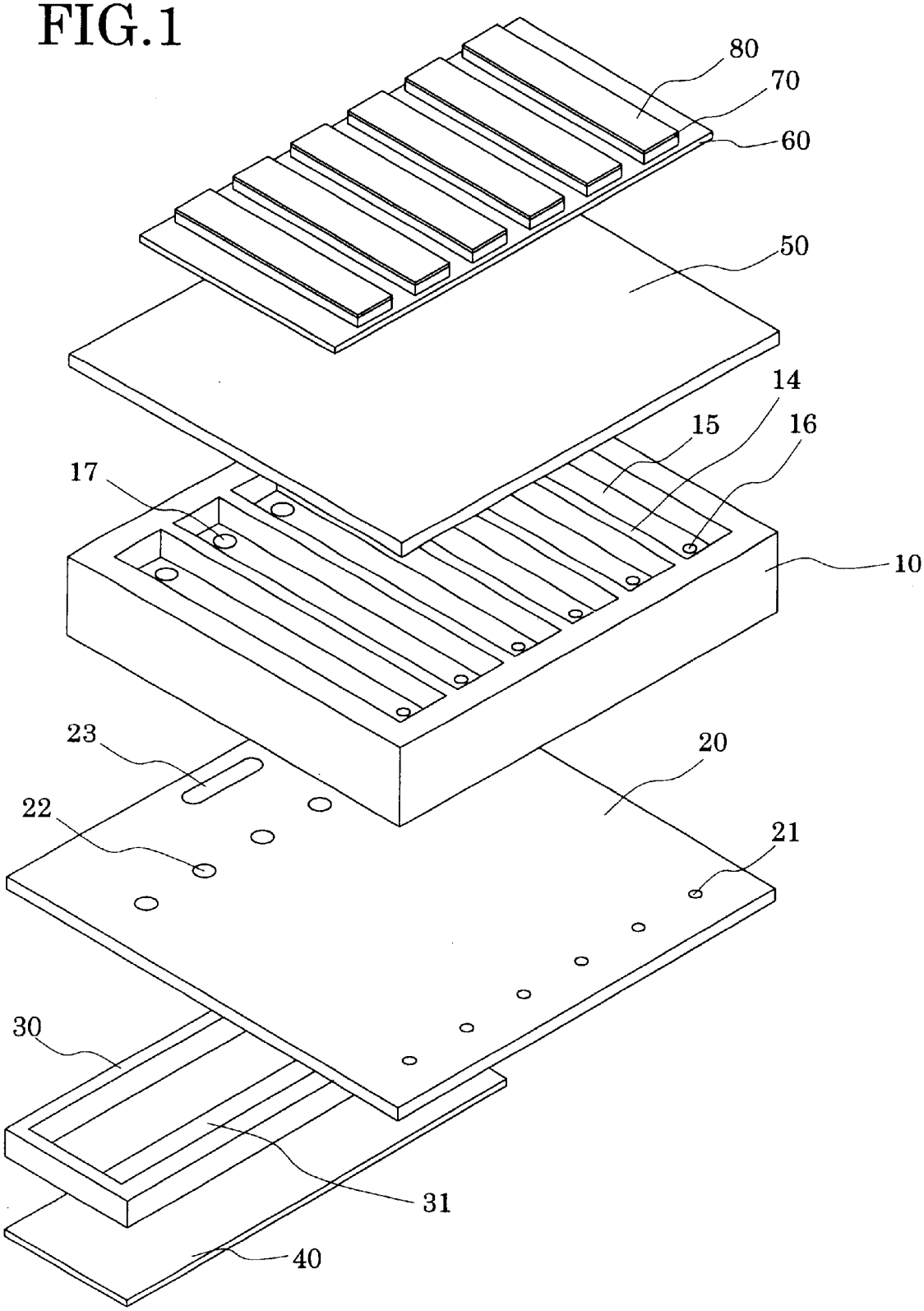
FIG. 1 is an exploded perspective view schematically showing an ink-jet recording head according to embodiment 1 of the present invention.
Figure 2:
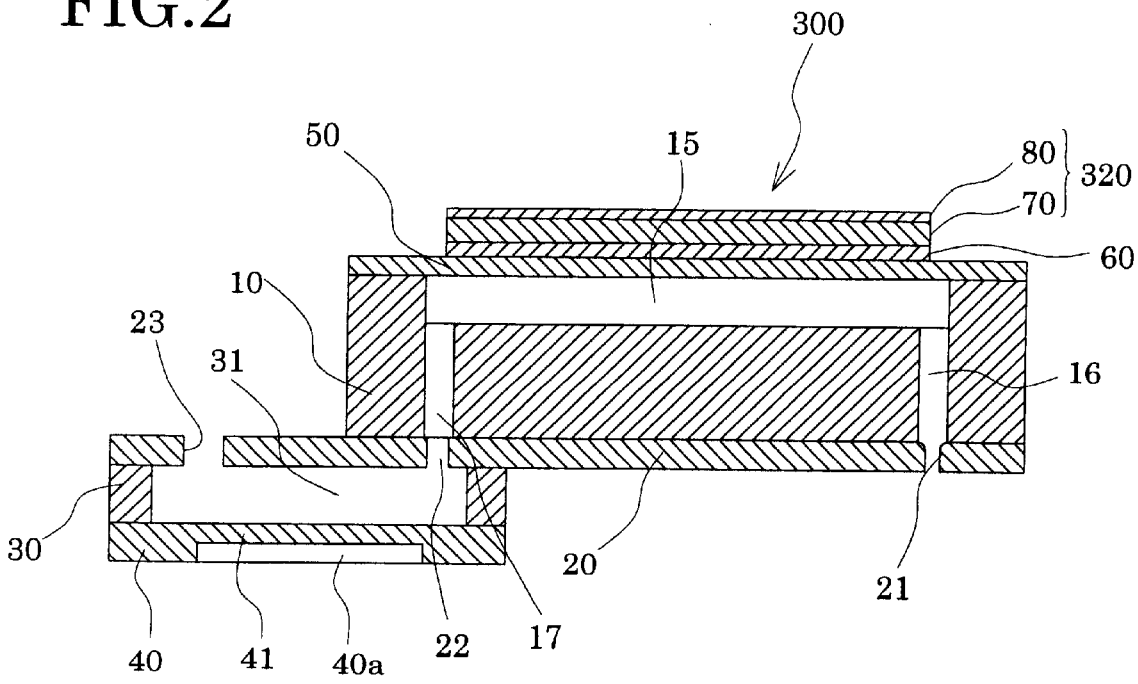
FIG. 2 is a sectional view showing the ink-jet recording head according to embodiment 1 of the present invention.

FIG. 1 is an exploded perspective view showing an ink-jet recording head according to embodiment 1 of the present invention, and FIG. 2 is a view showing a sectional structure of one pressure generating chamber of the ink-jet recording head in the longitudinal direction.

As shown in the drawings, a passage-forming substrate 10 comprises a single crystal silicon substrate of a plane (110) of the plane orientation in the present embodiment. As the passage-forming substrate 10, a plate having a thickness of about 150 $\mu$m to 1 mm is typically used.

On one surface of the passage-forming substrate 10, pressure generating chambers 15 partitioned by a plurality of compartment walls 14 are formed by performing anisotropy 4 etching for the single crystal silicon substrate.

For this anisotropy etching, any method of wet etching and dry etching may be used, and the pressure generating chambers 15 are shallowly formed by etching the single crystal silicon substrate halfway in the thickness direction (half etching). Note that this half etching is performed by adjusting the etching time.

In the bottom portions of both end portions in the longitudinal direction of each of the pressure generating chambers 15, a nozzle communicating hole 16 communicating with a nozzle orifice (to be described later) and an ink communicating hole 17 communicating with a reservoir (to be described later) are made open. These nozzle communicating holes 16 and ink communicating hole 17 are provided penetratingly to the other surface side with diameters smaller than the width of the pressure generating chamber 15, and are formed by performing anisotropy etching from the other surface side.

On a surface of the passage-forming substrate 10, where the nozzle communicating holes 16 and the ink communicating holes 17 are made open, a nozzle plate 20 having nozzle orifices 21 respectively communicating with the nozzle communicating holes 16 and ink-supply communicating ports 22 respectively communicating with the ink communicating holes 17 drilled therein is adhered via adhesive or a thermal welding film. Note that, the nozzle plate 20 consists of glass ceramics having a thickness of, for example, 0.1 to 1 mm, and a linear expansion coefficient of, for example, 2.5 to 4.5 [$\times 10^{-6}$/° C.] at a temperature of 300° C. or less. One surface of the nozzle plate 20 covers the passage-forming substrate 10, and also plays a role of a reinforcement plate for protecting the single crystal silicon substrate from impact or an external force.

Herein, the size of the pressure generating chamber 15 giving ink an ink droplet ejection pressure and the size of the nozzle orifice 21 ejecting ink droplets are optimized in accordance with an amount of ejected ink droplets, an ejection speed and an ejection frequency thereof. For example, in a case where 360 ink droplets per one inch are recorded, it is necessary that the nozzle orifice 21 be formed with a diameter of several ten micrometers with good accuracy.

A common ink chamber forming plate 30 is the one forming peripheral walls of a reservoir 31 as a common ink chamber common to the plurality of pressure generating chambers 15, and made by blanking a stainless plate having an appropriate thickness according to the number of nozzle orifices and the ejection frequency of ink droplets. In the present embodiment, the thickness of the common ink chamber forming plate 30 is set at 0.2 mm.

An ink chamber side plate 40 consists of a stainless plate, and one surface thereof constitutes one wall surface of the reservoir 31. In addition, on the ink chamber side plate 40, a thin wall 41 is formed by forming a convex portion 40*a* by half etching on one portion of the other surface thereof. Note that the thin wall 41 is the one for absorbing a pressure, which is generated in ejecting ink droplets and travels oppositely to the nozzle orifice 21, and prevents the other pressure generating chambers 15 from adding unrequited positive or negative pressures via reservoir 31. In the present embodiment, in consideration of the rigidity required at the time of connecting the ink introducing port 23 and external ink supplying means, the thickness of the ink chamber side plate 40 is set at 0.2 mm, and a portion thereof is formed to be the thin wall 41 having a thickness of 0.02 mm. However, for omitting formation of the thin wall 41 by half etching, the thickness of the ink chamber side plate 40 may be initially set at 0.02 mm.

The reservoir 31 formed of the common ink chamber forming plate 30, the ink chamber side plate 40 and the like is made to communicate with the respective pressure generating chambers 15 via the ink-supply communicating ports 22 formed in the nozzle plate 20. Ink is supplied from reservoir 31 to the respective pressure generating chambers 15 via these ink-supply communicating ports 22. In addition, ink supplied to reservoir 31 is supplied from the ink introducing port 23 formed in a region of the nozzle plate 20, which faces to the reservoir 31.

On the other hand, on the passage-forming substrate 10 having the pressure generating chambers 15 formed thereon, an elastic film 50, which consists of an insulating layer of, for example, zirconium oxide ($ZrO_2$) or the like and has a thickness of 1 to 2 $\mu$m, is provided. One surface of this elastic film 50 constitutes one wall surface of the pressure generating chamber 15.

On a region of the elastic film 50 is described above, which faces to the respective pressure generating chambers 15, a lower electrode film 60 having a thickness of, for example, about 0.5 $\mu$m, a piezoelectric film 70 having a thickness of, for example, about 1 $\mu$m and an upper electrode film 80 having a thickness of, for example, about 0.1 $\mu$m are formed in a laminated state in a process (to be described later) and are constituted of a piezoelectric element 300. Herein, the piezoelectric element 300 indicates a portion that includes the lower electrode film 60, the piezoelectric film 70 and the upper electrode film 80. Generally, the piezoelectric element 300 is constituted such that any one of electrodes of the piezoelectric element 300 is made to be a common electrode, and that the other electrode and the piezoelectric film 70 are patterned for each pressure generating chamber 15. And, in this case, the portion that is constituted of any one of the electrodes and the piezoelectric film 70, which are patterned, and where a piezoelectric distortion is generated by application of a voltage to both of the electrodes, is referred to as a piezoelectric active portion 320. In the present embodiment, the lower electrode film 60 is made to be a common electrode of the piezoelectric element 300 and the upper electrode 80 film is made to be an individual electrode of the piezoelectric element 300. However, no impediment occurs even if the above-described order is inverted in order to position a drive circuit or wiring. In any case, a piezoelectric active portion is to be formed for each pressure generating chamber. In addition, herein, a combination of the piezoelectric element 300 and the elastic film having displacement generated by the drive of the piezoelectric element 300 is referred to as a piezoelectric actuator.

Herein, description will be made for a process of forming the pressure generating chamber 15 on the passage-forming substrate 10 consisting of a single crystal silicon substrate and a process of forming the piezoelectric element 300 on the region corresponding to this pressure generating chamber 15 with reference to FIG. 3(*a*) to FIG. 5(*b*). Note that FIGS. 3(*a*) to 3(*c*) and FIGS. 4(*a*) to 4(*d*) are sectional views of the pressure generating chamber 15 in the width direction, and that FIGS. 5(*a*) and 5(*b*) are sectional views of the ink-jet recording head in the longitudinal direction of the pressure generating chamber 15.

Figure 3:
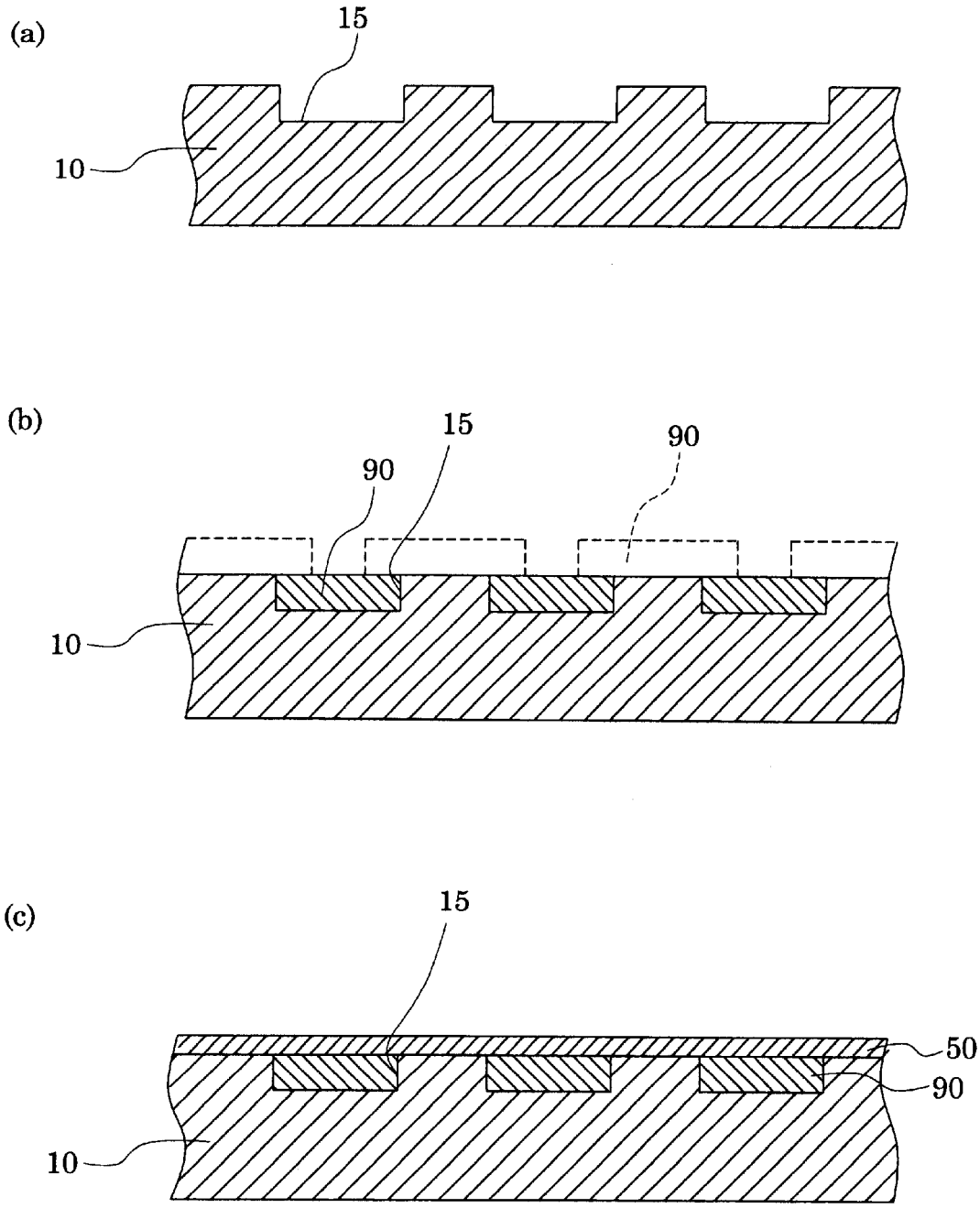
FIGS. 3(*a*) to 3(*c*) are sectional views showing a manufacturing process of the ink-jet recording head according to embodiment 1 of the present invention.

First, as shown in FIG. 3(*a*), on a single crystal silicon substrate that will be the passage-forming substrate 10, the pressure generating chamber 15 is formed by performing anisotropic etching by use of a mask of a specified shape, which consists of, for example, silicon oxide. Herein, in the present embodiment, the pressure generating chamber 15 is formed by performing half etching for the passage-forming substrate 10 consisting of single crystal silicon of a plane (110) of the plane orientation. Accordingly, the plane (110) constituting the bottom surface of the pressure generating chamber 15 serves as an etching stop surface for anisotropic etching.

Next, as shown in FIG. 3(*b*), a sacrificial layer 90 is buried in the pressure generating chamber 15 formed on the passage-forming substrate 10. For example, in the present embodiment, the sacrificial layer 90 is formed in such a manner that, after forming the sacrificial layer 90 across the entire surface of the passage-forming substrate 10 with a thickness approximately equal to the depth of the pressure generating chamber 15, the sacrificial layer 90 except that in the pressure generating chamber 15, is removed by chemical mechanical polish (CMP).

The material for thus forming the sacrificial layer 90 is not particularly limited. However, for example, polysilicon, phosphorous-doped silicate glass (PSG) or the like may be satisfactorily used, and in the present embodiment, PSG, having a relatively fast etching rate, is used.

Note that a forming method of the sacrificial layer 90 is not particularly limited, and, for example, a method called a gas deposition method or a jet molding method, in which super fine particles, each of which has a diameter of 1 μm or less, are made to collide against a substrate at a high speed with a pressure of gas such as helium (He) or the like and thus are deposited on the substrate, may also be employed. By this method, the sacrificial layer 90 can be partially formed only on a region corresponding to the pressure generating chamber 15.

Next, as shown in FIG. 3(*c*), the elastic film 50 is formed on the passage-forming substrate 10 and the sacrificial layer 10. For example, in the present embodiment, after forming a zirconium layer on the passage-forming substrate 10, the zirconium layer is thermally oxidized in a diffusion furnace at 500 to 1200° C. to form the elastic film 50 consisting of zirconium oxide. Note that the material for the elastic film 50 is not particularly limited as long as it is not etched in a later step of removing the sacrificial layer 90, and for example, silicon oxide and the like may be used.

Next, the piezoelectric element 300 is formed on the elastic film 50 so as to correspond to each pressure generating chamber 15.

Figure 4:
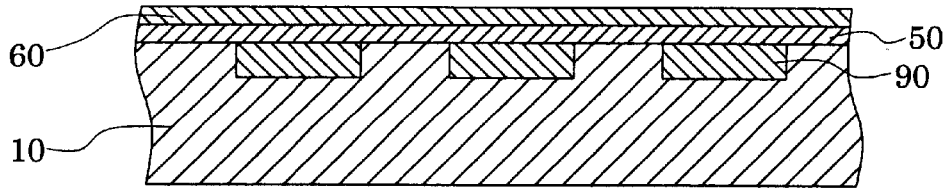
FIGS. 4(*a*) to 4(*d*) are sectional views showing the manufacturing process of the ink-jet recording head according to embodiment 1 of the present invention.
Figure 4:
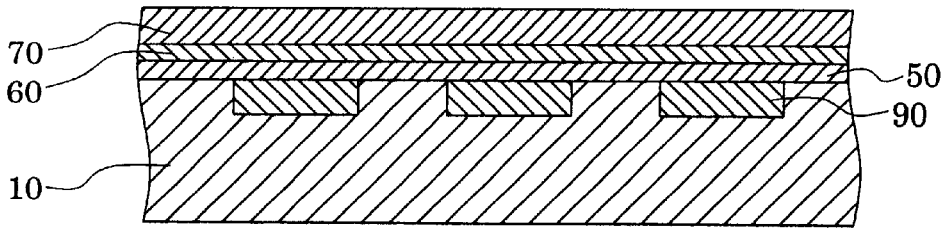
Figure 4:
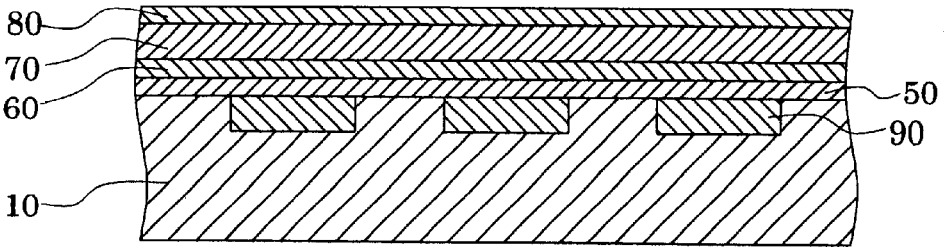
Figure 4:
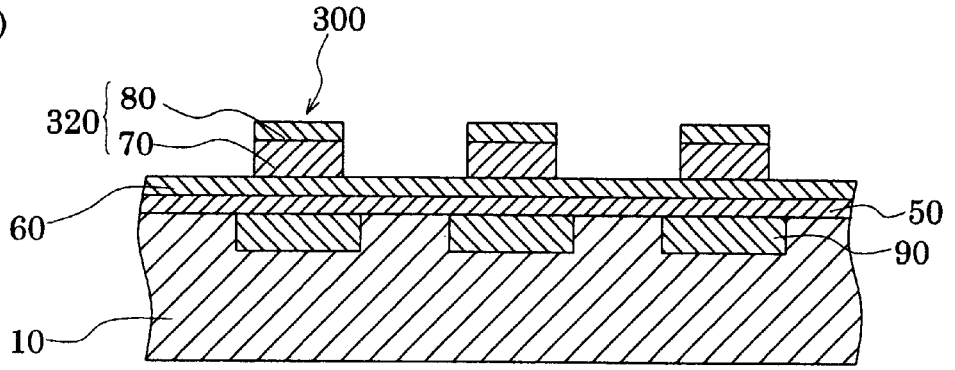

With regard to a process of forming the piezoelectric element 300, first, as shown in FIG. 4(*a*), the lower electrode film 60 is formed by sputtering. As a material for this lower electrode film 60, platinum or the like is preferable. This is because the piezoelectric film 70 (to be described later), which is deposited by a sputtering method or a sol-gel method, is required to be sintered at about 600 to 1000° C. under the atmosphere or an oxygen atmosphere to be crystallized after the film deposition. In other words, the material of the lower electrode film 60 must maintain conductivity under such high temperature and oxidization atmosphere, specifically when lead zirconium titanate (PZT) is used as the piezoelectric film 70, change in conductivity due to diffusion of lead oxide is desirably small. For these reasons, platinum is preferable.

Next, as shown in FIG. 4(*b*), the piezoelectric film 70 is deposited. For example, in the present embodiment, the piezoelectric film 70 is formed by use of a so-called sol-gel method, in which a so-called sol obtained by dissolving/dispersing metal organic matter in catalyst is coated and dried to turn the same into gel, and the gel is further sintered at a high temperature to obtain the piezoelectric film 70 consisting of metal oxide. As a material for the piezoelectric film 70, for example, enumerated are: $BaTiO_3$, $(Ba, Sr)TiO_3$, PMN-PT, PZN-PT, $SrBi_2Ta_2O_9$ and the like. Particularly, lead zirconium titanate series material is preferable when it is used for the ink-jet recording head. Note that this film deposition method of the piezoelectric film 70 is not particularly limited, and for example, the film deposition may be performed by a sputtering method or a spin coat method such as an MOD method (metal organic decomposition method, i.e., organic metal dipping-pyrolysis process).

Moreover, a method may be used, in which a precursor film of lead zirconium titanate is formed by the sol-gel method, the sputtering method, the MOD method or the like, thereafter, the precursor film is subjected to crystal growth at a low temperature in an alkaline solution by a high pressure treatment method.

In any case, the piezoelectric film 70 thus deposited has crystal subjected to priority orientation unlike a bulk piezoelectric, and in the present embodiment, the piezoelectric film 70 has the crystal formed in a columnar shape. Note that the priority orientation indicates a state where the orientation direction of the crystal is not in disorder, but a state where a specified crystal face faces in an approximately fixed direction. In addition, the thin film having a crystal in a columnar shape indicates a state where the approximately columnar crystal gathers across the surface direction in a state where center axes thereof are made approximately coincident with the thickness direction. It is a matter of course that the piezoelectric film 70 may be a thin film formed of particle-shaped crystal subjected to the priority orientation. Note that a thickness of the piezoelectric film thus manufactured in the thin film step is typically 0.2 to 5 μm.

Next, as shown in FIG. 4(*c*), the upper electrode film 80 is deposited. It is satisfactory that the upper electrode film 80 is made of a material with high conductivity, and various kinds of metals such as aluminum, gold, nickel and platinum, conductive oxide or the like can be used. In the present embodiment, platinum is deposited by sputtering.

Subsequently, the lower electrode film 60, the piezoelectric film 70 and the upper electrode film 80 are etched together, and the entire pattern of the lower electrode film 60 is patterned, thereafter, as shown in FIG. 4(*d*), only the piezoelectric film 70 and the upper electrode film 80 are etched to pattern the piezoelectric active portion 320.

Figure 5:
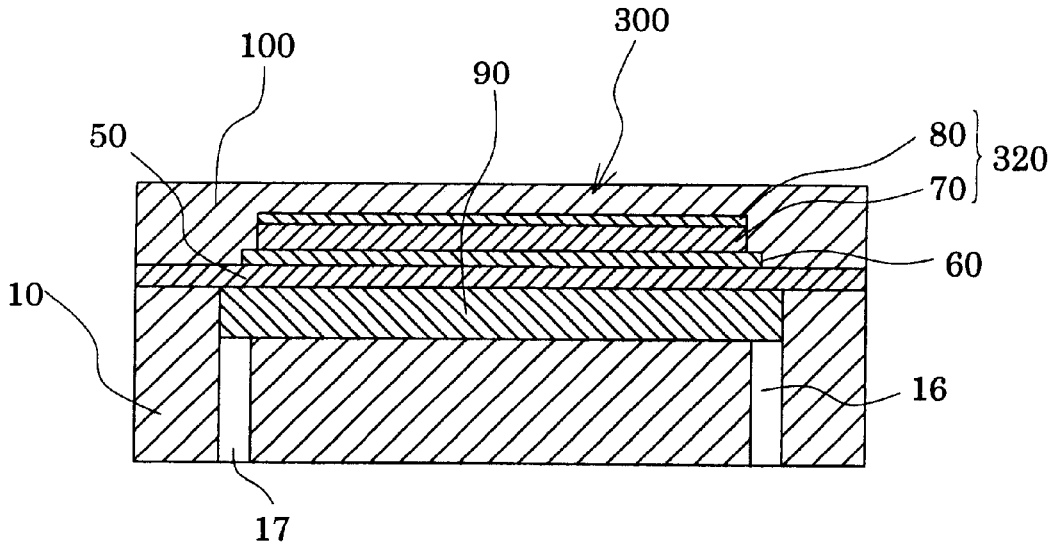
FIGS. 5(*a*) and 5(*b*) are sectional views showing the manufacturing process of the ink-jet recording head according to embodiment 1 of the present invention.
Figure 5:
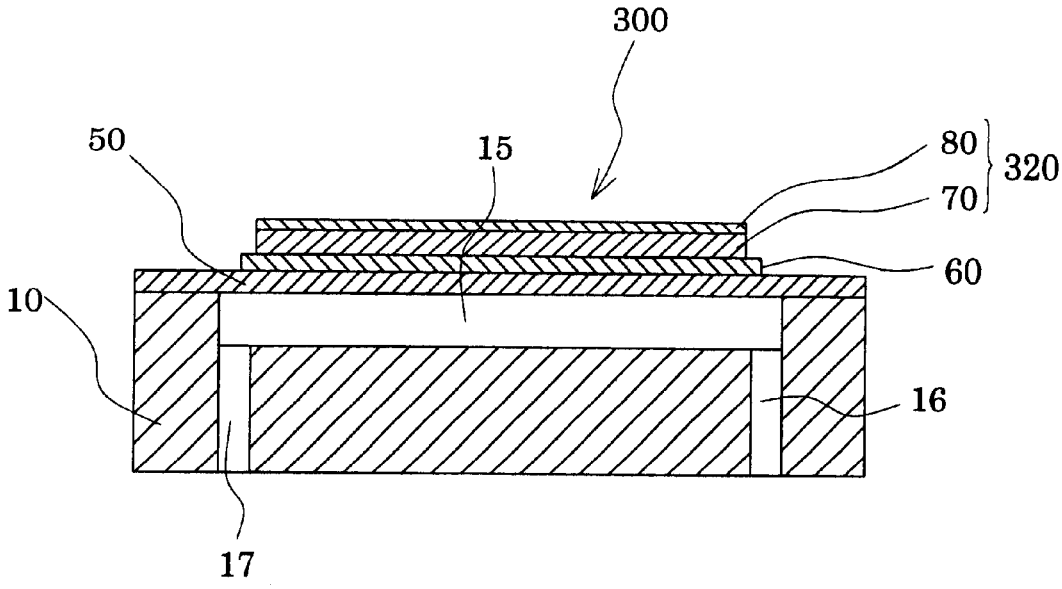

Next, as shown in FIG. 5(*a*), a protective film 100 is deposited so as to cover at least the piezoelectric film 70. Thereafter, the nozzle communicating hole 16 and the ink communicating hole 17 are formed by performing anisotropic etching from the opposite side. The anisotropic etching in forming the nozzle communicating hole 16 and the ink communicating hole 17 is desirably dry etching in order to make these nozzle communicating hole 16 and the ink communicating hole 17 vertical through holes. Note that no problem occurs even if the nozzle communicating hole 16 and the ink communicating hole 17 are formed before the protective film 100 is deposited, that is, after the step shown in FIG. 4(*d*).

Thereafter, as shown in FIG. 5(*b*), wet etching or etching by steam is performed from the nozzle communicating hole 16 and the ink communicating hole 17 to remove the sacrificial layer 90, thereafter, the protective film 100 is removed. In the present embodiment, since PSG is used as a material of the sacrificial layer 90, etching is performed by a hydrofluoric acid solution. Note that when polysilicon is used, etching can be performed by a mixed solution of hydrofluoric acid and nitric acid or a potassium hydroxide solution.

By the process as described above, the pressure generating chamber 15 and the piezoelectric element 300 are formed.

In a series of the film deposition and anisotropic etching steps described above, a large number of chips are simultaneously formed on one wafer, and after the termination of processes, the chip is divided for each passage-forming substrate 10 of one chip size as shown in FIG. 1. In addition, the nozzle plate 20, the common ink chamber forming plate 30 and the ink chamber side plate 40 are sequentially adhered to the passage-forming substrate 10 obtained by dividing the wafer to be united therewith, thus constituting the ink-jet recording head.

After introducing ink from the ink introducing port 23 connected to external ink supplying means (not shown) and filling the inside from the reservoir 31 to the nozzle orifice 21 with ink, the ink-jet recording head thus constituted applies a voltage between the lower electrode film 60 and the upper electrode film 80 according to a recording signal from an external drive circuit (not shown) to warp and deform the elastic film 50, the lower electrode film 60 and the piezoelectric film 70. Therefore, the pressure in the pressure generating chamber 15 is increased to eject ink droplets from the nozzle orifice 21.

In the present embodiment as described above, since each pressure generating chamber 15 is formed without penetrating the substrate, the rigidity of the compartment wall 14 between the pressure generating chambers 15 can be sufficiently increased, and ink droplets can be ejected effectively. For this reason, a silicon wafer having a large diameter can also be used without limitation as to the thickness of the single crystal silicon substrate, and it is possible to apply the ink-jet recording head of the present invention to a large-size head of a line printer and the like.

Moreover, when the nozzle plate 20 is adhered to the passage-forming substrate 10, since the adhesive used for such adhering does not flow out to the elastic film 50 side, an ink ejection defect due to the restraint of movement of the elastic film 50 dose not occur.

Furthermore, in forming the pressure generating chamber 15, the depth of the pressure generating chamber 15 can be freely set in accordance with an etching time, compliance of the compartment wall can be controlled, and the time required for manufacturing the pressure generating chamber 15 can be reduced, and thus low-cost manufacturing can be realized.

Figure 6:
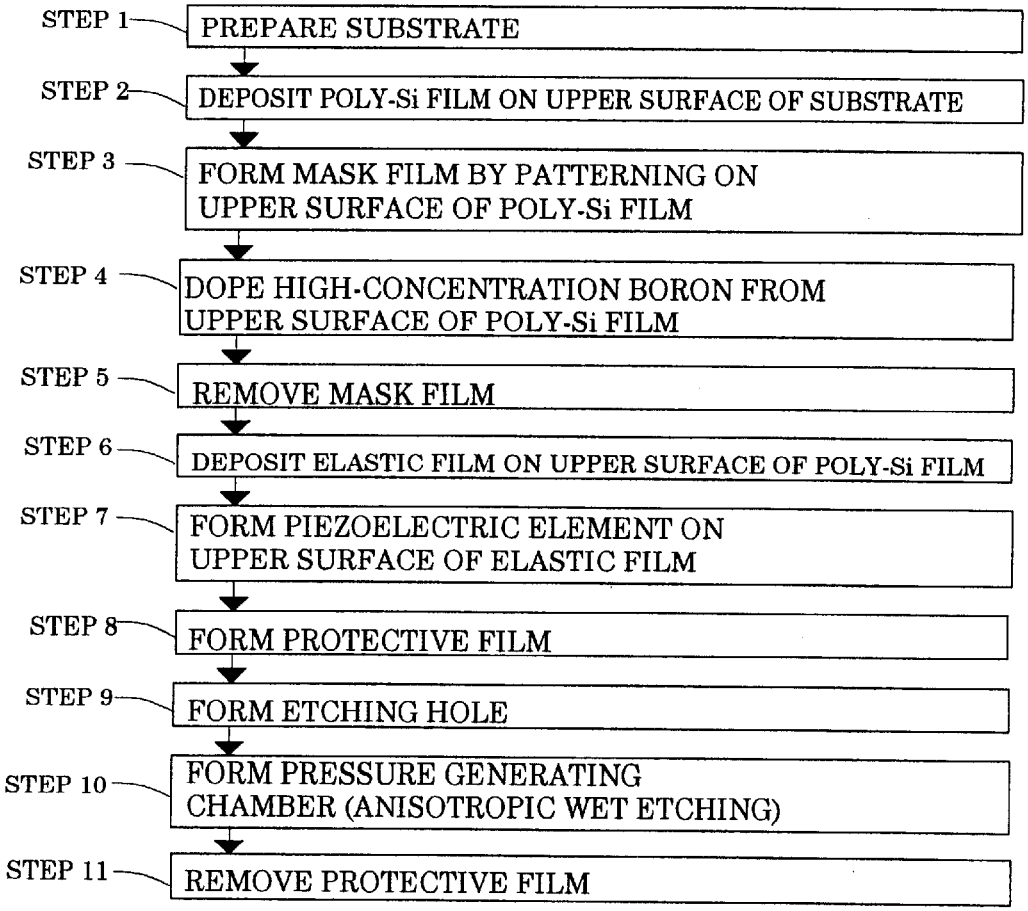
FIG. 6 is a flowchart explaining another manufacturing process of the ink-jet recording head according to embodiment 1 of the present invention.

Still further, a forming method of the pressure generating chamber 15 or the like is not limited to the above-described method. Hereinbelow, one example of the forming method will be described. Note that, FIG. 6 is a flowchart explaining another manufacturing method of the ink-jet recording head, particularly explaining another forming process of the pressure generating chamber 15, and FIG. 7(*a*) to FIG. 14(*b*) are schematic views for sequentially explaining each step shown in FIG. 6. In addition, in FIG. 7(*a*) to FIG. 14(*b*), each drawing added with (a) is a sectional view of the ink-jet recording head in the longitudinal direction of the pressure generating chamber, and each drawing added with (b) is a sectional view of the drawing added with (a) taken along the line b—b.

The present example is an example where the pressure generating chamber is formed without using a sacrificial layer. First, as shown in FIG. 6, a substrate as an object to be processed is prepared. (STEP 1). Note that, in this example, a single crystal silicon substrate having a crystal orientation of, for example, (100) as the passage-forming substrate 10.

Figure 7:
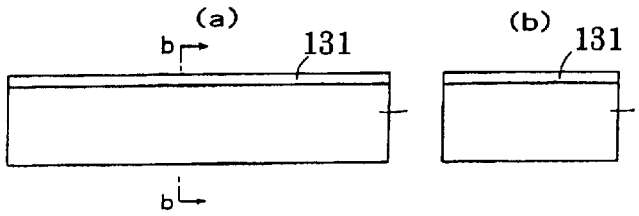
FIGS. 7(*a*) and 7(*b*) are sectional views showing another manufacturing process of the ink-jet recording head according to embodiment 1 of the present invention.

Next, as shown in FIG. 7(*a*) and FIG. 7(*b*), a poly-Si (polycrystalline silicon) film 131 is deposited on the upper surface of the passage-forming substrate 10 (STEP 2). The poly-Si film 131 is deposited until a thickness thereof reaches, for example, 0.1 to 1 $\mu$m.

Figure 8:
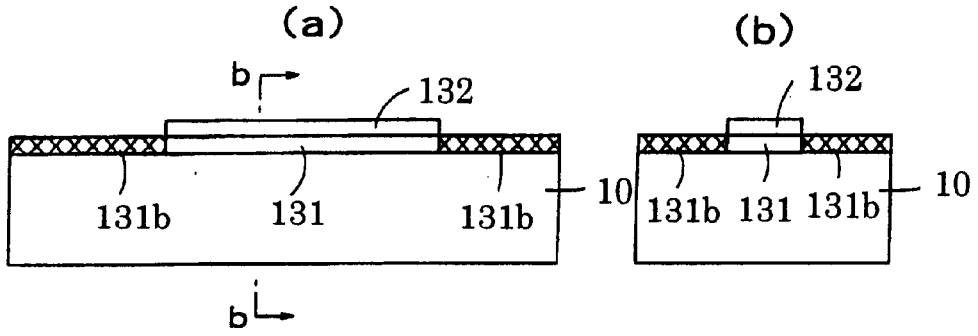
FIGS. 8(*a*) and 8(*b*) are sectional views showing another manufacturing process of the ink-jet recording head according to embodiment 1 of the present invention.

Subsequently, as shown in FIG. 8(*a*) and FIG. 8(*b*), on a region, which is further on the upper surface of the poly-Si film 131 and corresponds to a portion for the pressure generating chamber in the passage-forming substrate 10, a mask film 132 is formed by patterning (STEP 3). The mask film 132 is an $SiO_2$ film in this case, and a thickness thereof is, for example, 1 to 2 $\mu$m. Then, high-concentration boron doping treatment is executed for the mask film 132 and the poly-Si film 131 (STEP 4), and high-concentration boron is diffused on a region of the poly-Si film 131, where the mask film 132 is not formed (this region excludes the region corresponding to the portion for the pressure generating chamber in the passage-forming substrate 10). In this case, the high-concentration boron doping treatment is performed such that the poly-Si film 131 on the foregoing region can be a boron containing film 131*b* having a boron containing density of $1\times10^{20}$ number/cm$^3$ or more.

Figure 9:
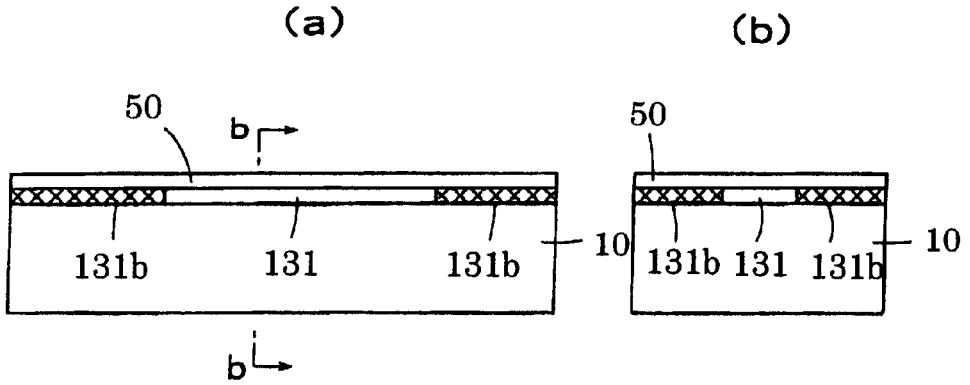
FIGS. 9(*a*) and 9(*b*) are sectional views showing another manufacturing process of the ink-jet recording head according to embodiment 1 of the present invention.

Subsequently, as shown in FIG. 9(*a*) and FIG. 9(*b*), the mask film 132 is removed by any publicly known method (STEP 5). Then, on the upper surface of the poly-Si film 131 and the boron containing film 131*b*, the elastic film 50 is deposited (STEP 6).

Figure 10:
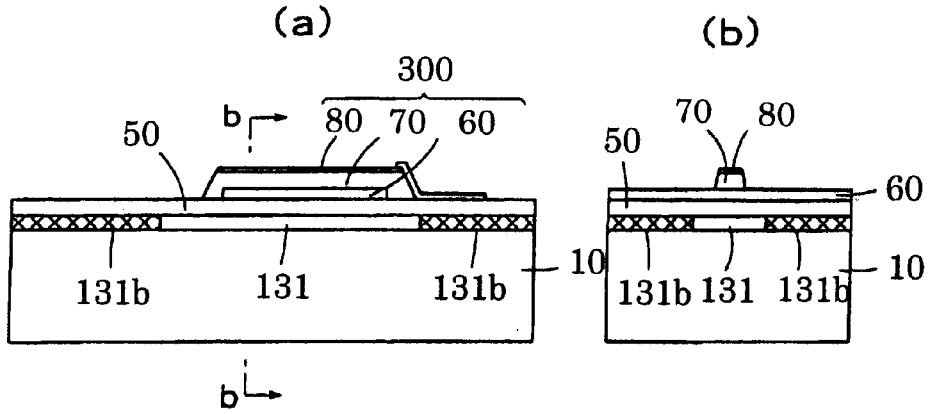
FIGS. 10(*a*) and 10(*b*) are sectional views showing another manufacturing process of the ink-jet recording head according to embodiment 1 of the present invention.

Next, as shown in FIG. 10(*a*) and FIG. 10(*b*), on one portion, which is on the upper surface side of the elastic film 50, of the region corresponding to the portion for the pressure generating chamber in the passage-forming substrate 10, the lower electrode film 60, the piezoelectric film 70 and the upper electrode film 80 are sequentially deposited and patterned to form the piezoelectric element 300 (STEP 7) similarly to the above-described manufacturing process.

Figure 11:
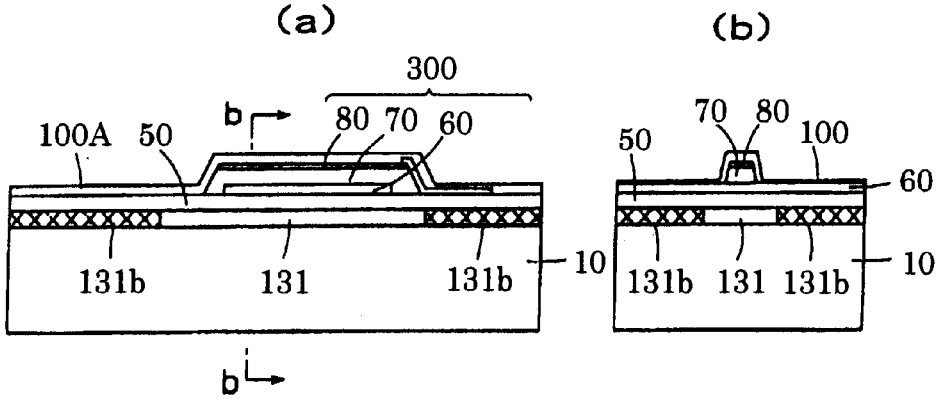
FIGS. 11(*a*) and 11(*b*) are sectional views showing another manufacturing process of the ink-jet recording head according to embodiment 1 of the present invention.

Subsequently, as shown in FIG. 11(*a*) and 11(*b*), on the upper surface side of the piezoelectric element 300, a protective film 100A is formed (STEP 8). The protective film 100A may be constituted of, for example, fluorine series resin, paraxylylene resin or the like.

Figure 12:
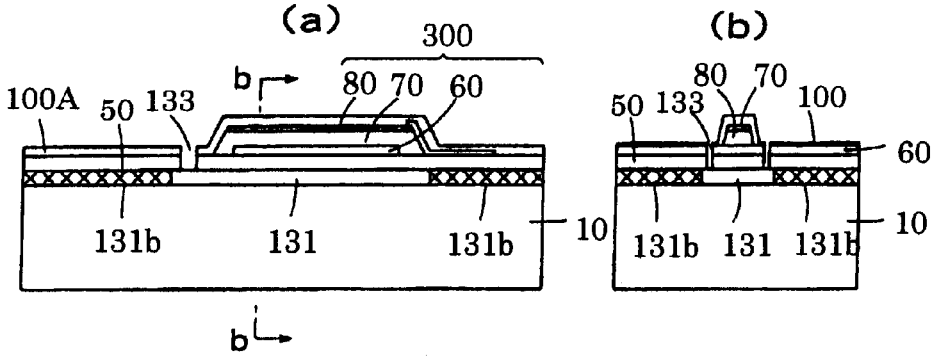
FIGS. 12(*a*) and 12(*b*) are sectional views showing another manufacturing process of the ink-jet recording head according to embodiment 1 of the present invention.

Subsequently, as shown in FIG. 12(*a*) and FIG. 12(*b*), in a region of the elastic film 50 and the protective film 100A, which corresponds to the portion for the pressure generating chamber in the passage-forming substrate 10, and in a portion where the piezoelectric element 300 is not formed, an etching hole 133 is formed (STEP 9). The etching hole 133 may be formed by, for example, photoresist patterning and dry etching such as ion milling.

In the present embodiment, as shown in FIG. 12(*a*) and FIG. 12(*b*), the etching hole 133 is formed so as to surround a periphery of the piezoelectric element 300 in the shape of U-character, and penetrates the lower electrode film 60 continuously provided to be used commonly by the plurality of piezoelectric elements.

Figure 13:
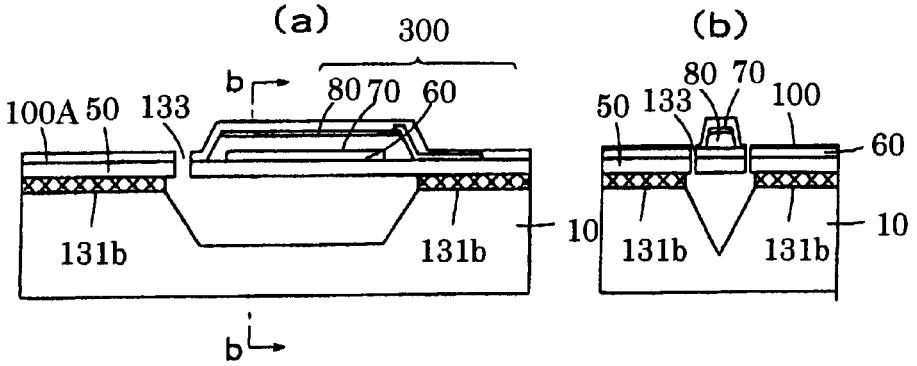
FIGS. 13(*a*) and 13(*b*) are sectional views showing another manufacturing process of the ink-jet recording head according to embodiment 1 of the present invention.

Then, as shown in FIG. 13(*a*) and FIG. 13(*b*), anisotropic wet etching by a potassium hydroxide solution is executed from the etching hole 133, a portion of the poly-Si film 131 where boron is not diffused and the passage-forming substrate 10 under the concerned portion are removed, and the pressure generating chamber 15 having a triangular shape in this case is formed in accordance with the crystal orientation of the silicon substrate as the passage-forming substrate 10 (STEP 10). At this time, since the boron containing film 131*b* is not removed by the potassium hydroxide solution but remains, the advancing direction of the etching to the passage-forming substrate 10 may be regulated with good accuracy.

Figure 14:
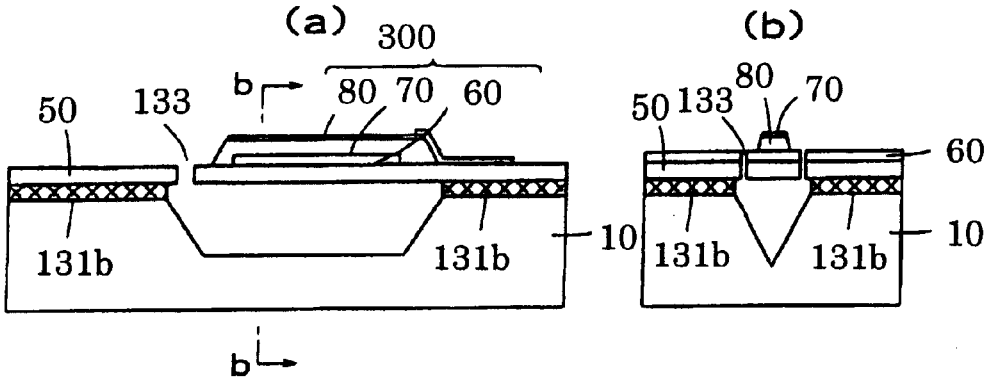
FIGS. 14(*a*) and 14(*b*) are sectional views showing another manufacturing process of the ink-jet recording head according to embodiment 1 the present invention.

Subsequently, as shown in FIG. 14(*a*) and FIG. 14(*b*), the protective film 100A is removed (STEP 11).

As described above, according to the present embodiment, since the boron containing film 131*b* (portion of the poly-Si film 131 where boron is diffused) is not removed by anisotropic wet etching, the pressure generating chamber 15 of a desired shape may be formed readily with good accuracy.

Herein, the present inventors confirmed that it was particularly preferable that the boron contain a film density of 131*b* be $1\times10^{20}$ number/cm$^3$ or more in order to secure the resistance of the boron containing film 131*b* to the anisotropic wet etching.

Moreover, according to the present embodiment, even if the depth of the pressure generating chamber 15 is shallowly formed, the thickness of the passage-forming substrate 10 to be prepared can be freely selected. For this reason, handling of the passage-forming substrate 10 during manufacturing is facile, and a silicon substrate from a wafer having a large diameter can be utilized.

Furthermore, according to the present embodiment, since it is not necessary to deposit the sacrificial layer having a thickness equal to the depth of the pressure generating chamber, manufacturing time therefor is significantly shortened.

Still further, a protective film is formed on the upper surface of the piezoelectric element 300, thus the piezoelectric element 300 is securely protected during the anisotropic wet etching (STEP 10).

(Embodiment 2)

Figure 15:
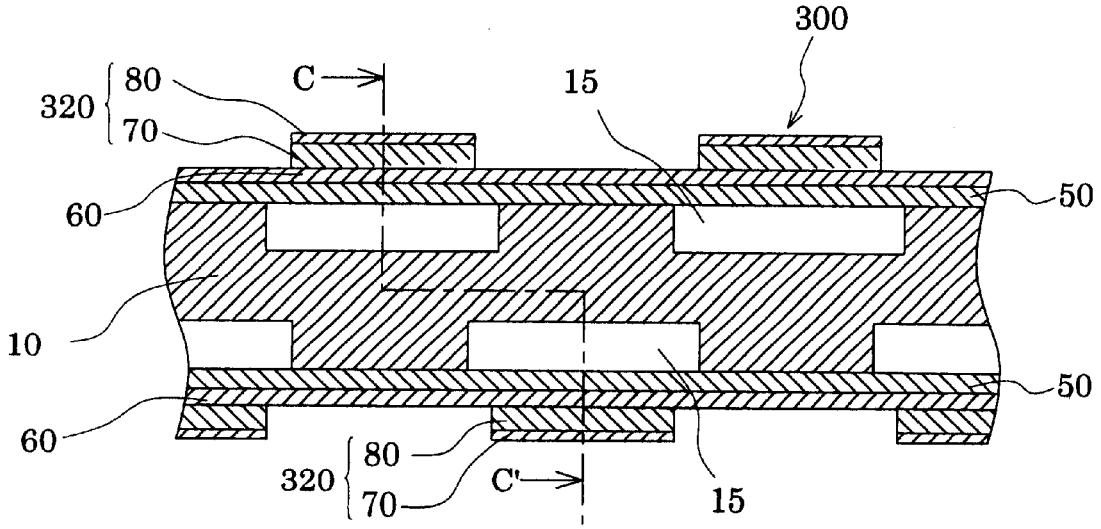
FIGS. 15(*a*) and 15(*b*) are sectional views showing an ink-jet recording head according to embodiment 2 of the present invention.
Figure 15:
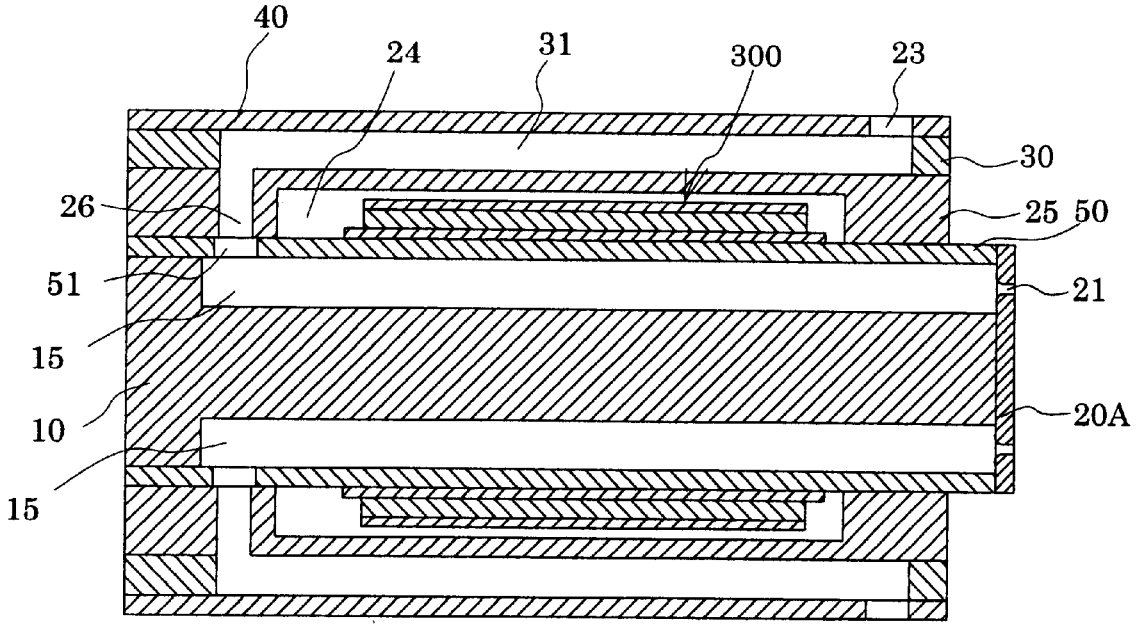

FIG. 15(*a*) is a sectional view in the width direction of a pressure generating chamber of an ink-jet recording head according to embodiment 2, and FIG. 15(*b*) is a sectional view of FIG. 15(*a*) taken along a line C–C'. Note that members having similar functions to those in the embodiments described above are added with the same reference numerals, and repeated description will be omitted.

As shown in FIG. 15(*a*), the present embodiment is an example where pressure generating chambers 15 are formed on both surfaces of the passage-forming substrate 10 consisting of a single crystal silicon substrate. The pressure generating chambers 15, which are on the both surfaces of the passage-forming substrate 10, are provided at positions not facing each other.

The pressure generating chambers 15 are shallowly formed by performing half etching therefor similarly to embodiment 1. Each end of the pressure generating chamber 15 in the longitudinal direction is provided so as to penetrate to the side surface of the passage-forming substrate 10. And, on the side surface of the passage-forming substrate 10, a nozzle plate 20A, in which nozzle orifices 21A communicating with the pressure generating chambers 15 are drilled, is adhered via adhesive or a thermal welding film.

Moreover, elastic films 50 are respectively formed on the both surfaces of the passage-forming substrate 10. Above a region of each elastic film 50, which corresponds to the pressure generating chamber 15, a piezoelectric element 300 is formed similarly to the above-described embodiment 1. Note that, in the present embodiment, a first through hole 51 for allowing each pressure generating chamber 15 and the reservoir 31 to communicate with each other is formed in the elastic film 50.

Furthermore, as shown in FIG. 15(*b*), on the elastic film 50, a sealing plate 25, a common ink chamber forming plate 30 and an ink chamber side plate 40 are sequentially joined, and on approximately the entire surface of the sealing plate 25, the reservoir 31 is constituted. Note that, an ink introducing port 23 supplying ink from external ink supplying means to the reservoir 31 is provided in the ink chamber side plate 40 in the present embodiment.

Still further, the sealing plate 25 has a piezoelectric element holding portion 24 capable of hermetically sealing a space in a state where the space is secured to the extent of not inhibiting the motion of the piezoelectric element 300. At minimum, a piezoelectric active portion 320 of the piezoelectric element 300 is hermetically sealed in this piezoelectric element holding portion 24. In addition, in the sealing plates 25, an ink supply holes 26 are formed so as to correspond to each of these first through holes 51 of the elastic film 50, and via each of these first through holes 51, ink is supplied from the reservoir 31 to the pressure generating chamber 15.

With such a constitution of the present embodiment, since the pressure generating chambers 15 are provided on the both surfaces of one passage-forming substrate 10, it is possible to miniaturize the head. In addition, even if the pressure generating chambers 15 are formed in a high density, the rigidity of the compartment walls 14 is sufficiently maintained.

Note that, in the present embodiment, the nozzle plate 20A having the nozzle orifices 21 is joined on the side surface of the passage-forming substrate 10, but not being limited to this, for example, a nozzle orifice communicating with the pressure generating chamber may be formed also in an end portion of the passage-forming substrate by half etching.

(Embodiment 3)

Figure 16:
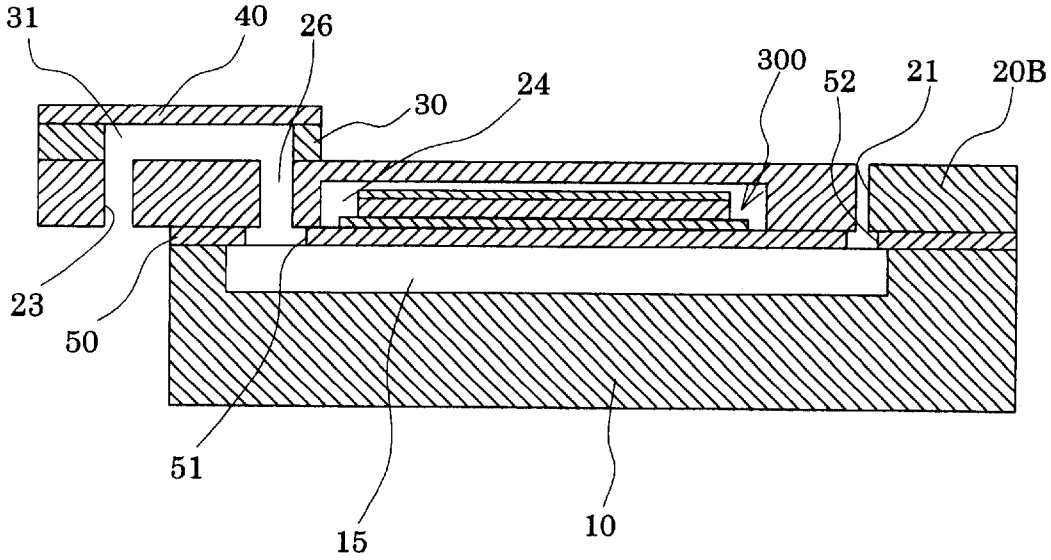
FIG. 16 is a sectional view showing an ink-jet recording head according to embodiment 3 of the present invention.

FIG. 16 is a sectional view of an ink-jet recording head according to embodiment 3.

As shown in FIG. 16, the present embodiment is an example where a nozzle orifice is provided at the same side as that of a piezoelectric element 300 of a passage-forming substrate 10.

Specifically, in the present embodiment, instead of the sealing plate 25 of embodiment 2, a nozzle plate 20B having a nozzle orifice 21 drilled therein is joined with an elastic film 50 so as to cover approximately the entire surface of the passage-forming substrate 10. And, a nozzle orifice 21B and a pressure generating chamber 15 communicate with each other via a second through hole 52 provided in the elastic film 50.

Moreover, such a nozzle plate 20B has a piezoelectric element holding portion 24 capable of hermetically sealing a space in a state where the space is secured to an extent of not inhibiting a motion of a piezoelectric element 300. And, an ink supply hole 26 supplying ink from a reservoir 31 to the pressure generating chamber 15 is formed so as to correspond to a first through hole 51 provided in the elastic film 50.

Note that, on the nozzle plate 20B, the reservoir 31 is formed of a common ink chamber forming plate 30 and an ink chamber side plate 40 similarly to the above-described embodiment 1. To this reservoir 31, ink is supplied via an ink introducing port 23 formed in the nozzle plate 20B.

Also with such a constitution, as a matter of course, similar effects to those of the above-described embodiments are obtained.

(Embodiment 4)

Figure 17:
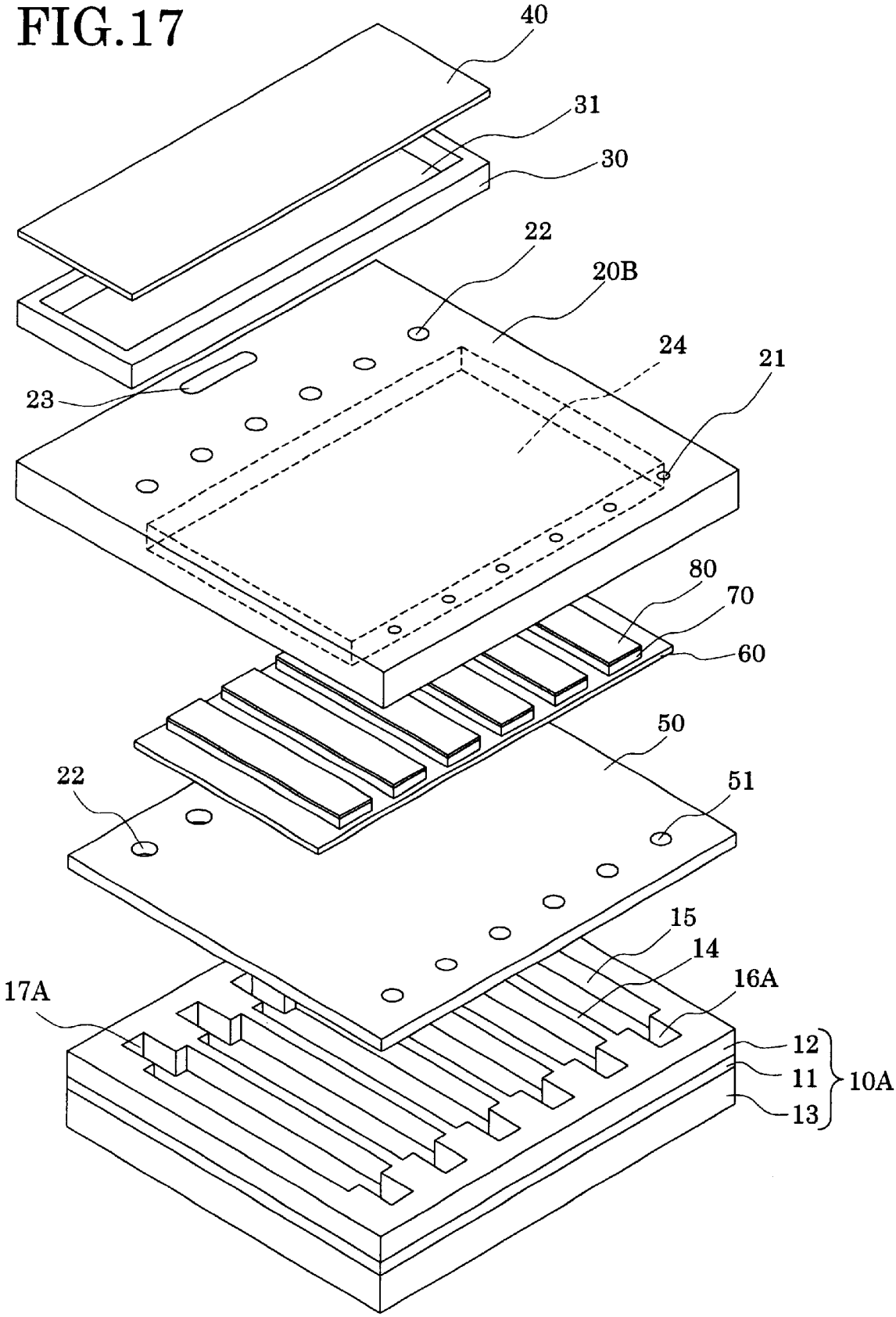
FIG. 17 is an exploded perspective view schematically showing an ink-jet recording head according to embodiment 4 of the present invention.
Figure 18:
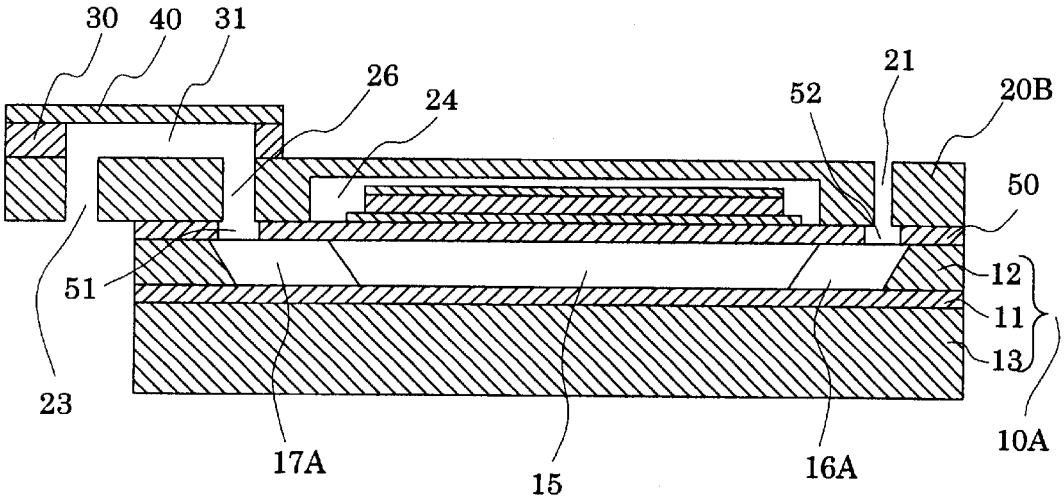
FIGS. 18(*a*) and 18(*b*) are sectional views showing the ink-jet recording head according to embodiment 4 of the present invention.
Figure 18:
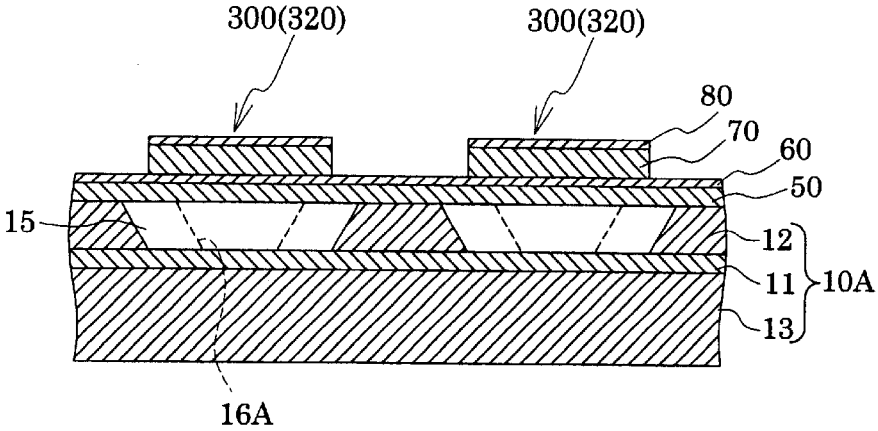

FIG. 17 is an exploded perspective view showing an ink-jet recording head according to embodiment 4, and FIGS. 18(*a*) and 18(*b*) are sectional views thereof. Note that members having similar functions to those in the embodiments described above are added with the same reference numerals, and repeated description will be omitted.

The present embodiment is similar to embodiment 3 except that a passage-forming substrate constituted of a plurality of layers is used. As shown in the drawings, in the present embodiment, a passage-forming substrate 10A has an insulating layer 11 consisting of silicon oxide and a pair of a first silicon layer 12 and a second silicon layer 13, which are provided on both surfaces of this insulating layer 11 and consist of single crystal silicon substrates. Specifically, the passage-forming substrate 10A of the present embodiment consists of an SOI substrate.

A film thickness of the first silicon layer 12 of the passage-forming substrate 10A is formed to be thinner than a film thickness of the second silicon layer 13. In the present embodiment, pressure generating chambers 15 partitioned by a plurality of compartment walls 14 are parallelly provided in the width direction of the pressure generating chamber in this first silicon layer 12 having a thin film thickness. Moreover, in end portions in the longitudinal direction of each of the pressure generating chambers 15, a nozzle communicating passage 16A communicating with a nozzle orifice 21 and an ink communicating passage 17A communicating with a reservoir 31 are respectively provided extendedly so as to have a width narrower than that of the pressure generating chamber 15.

Note that, on the first silicon layer 12 of the passage-forming substrate 10A, where the pressure generating chamber 15 and the like are formed in such a manner, an elastic film 50 is formed similarly to the above-described embodiments. On this elastic film 50, piezoelectric elements 300 consisting of a lower electrode film 60, piezoelectric films 70 and upper electrode films 80 are formed.

Herein, description will be made for a manufacturing process of an ink-jet recording head according to the present embodiment, concretely, a step of forming the pressure generating chambers 15 and the like on the passage-forming substrate 10A consisting of the SOI substrate with reference to FIGS. 19(*a*) to 19(*d*). Note that, FIGS. 19(*a*) to 19(*c*) are sectional views of an ink-jet head in the width direction of the pressure generating chambers, and FIG. 19(*d*) is a sectional view of an ink-jet head in the longitudinal direction of the pressure generating chamber.

Figure 19:
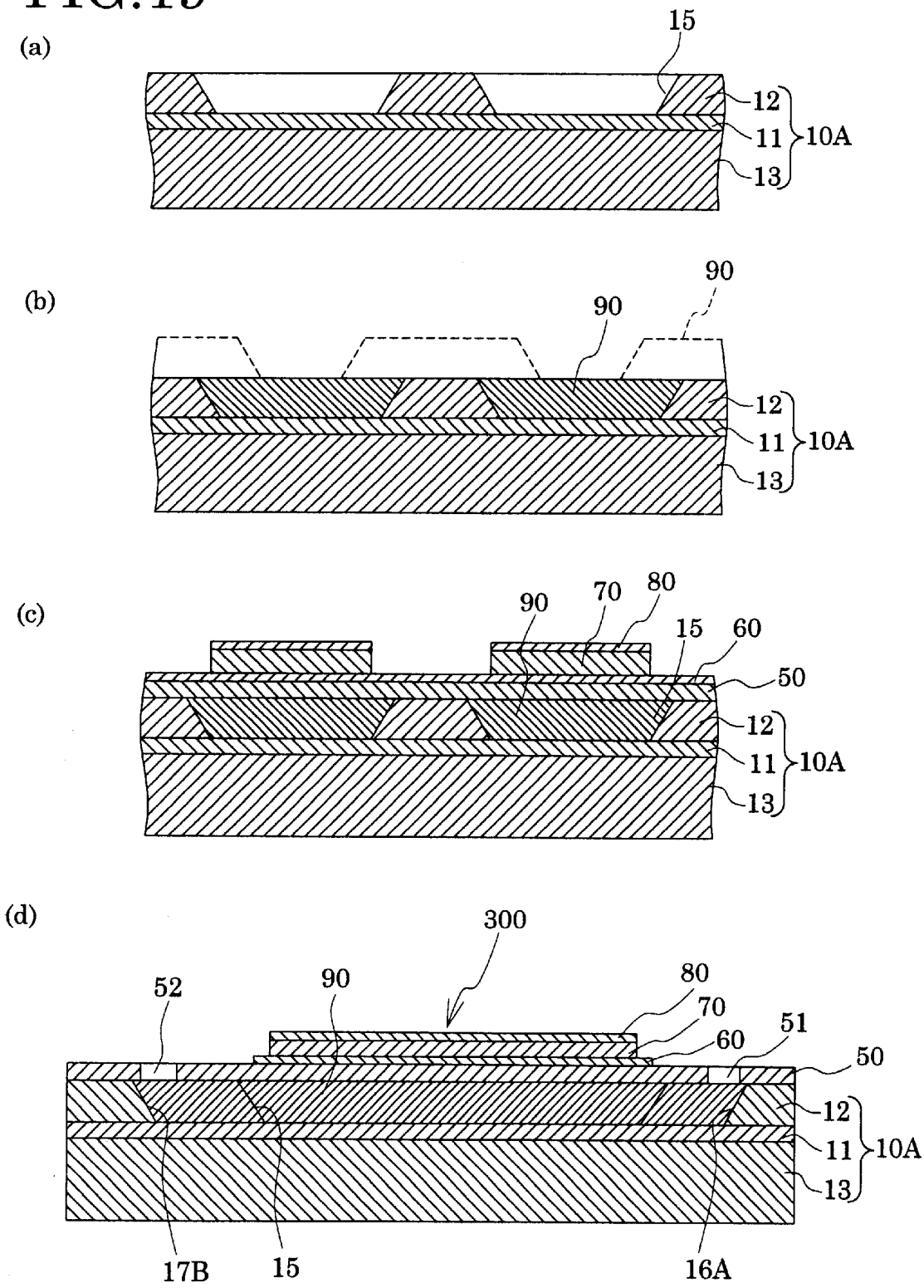
FIGS. 19(*a*) to 19(*d*) are sectional views showing another manufacturing process of the ink-jet recording head according to embodiment 4 of the present invention.

First, as shown in FIG. 19(*a*), on the first silicon layer 12 of a wafer of the SOI substrate that will be the passage-forming substrate 10A, anisotropic etching is performed by an alkaline solution such as potassium hydroxide by use of a mask in a specified shape consisting of, for example, silicon oxide. Thus, in the end portions in the longitudinal direction of each pressure generating chamber 15, the nozzle communicating passage 16A and the ink communicating passage 17A are respectively formed.

Herein, in the present embodiment, the first silicon layer 12 of the passage-forming substrate 10A is formed so that a main plane thereof can be of (001) orientation, and the pressure generating chamber 15 is formed so that a longitudinal direction thereof can be a <110> direction. For this reason, the pressure generating chamber 15, the nozzle communicating passage 16A and the ink communicating passage 17A are constituted so as to have slant planes of specified angles.

As described above, the first silicon layer 12 is made to have a specified plane orientation to form the pressure generating chambers 15, thus the pressure generating chambers 15 can be formed by anisotropic etching with a relatively high dimensional accuracy, and the pressure generating chambers 15 can be arrayed in a high density.

Note that, the main plane of the first silicon layer 12 may be also of a plane (110) of the plane orientation, and the pressure generating chamber 15 may be also formed so that a longitudinal direction thereof can be <1-12> direction. Herein, (−1) stands for (bar 1).

In this case, the pressure generating chamber 15, the nozzle communicating passage 16A and the ink communicating passage 17 are constituted of planes approximately perpendicular to the surface of the passage-forming substrate 10A. However, similarly to the above-described cases, the pressure generating chamber 15 can be formed with a high accuracy and a high density.

Moreover, these pressure generating chamber 15, nozzle communicating passage 16A and ink communicating passage 17A are formed by performing etching therefor so as to substantially penetrate the first silicon layer 12 of the passage-forming substrate 10A to reach the insulating layer 11. Accordingly, the insulating layer 11 facilitates a stop of the etching, depths of the pressure generating chamber 15 and the like can be readily controlled, and the pressure generating chamber 15 and the like can be formed in a high density. Note that, an amount of the insulating layer 11 eroded by an alkaline solution for etching the first silicon layer 12 consisting of a single crystal silicon substrate is extremely small.

Next, as shown in FIG. 19(*b*), a sacrificial layer 90 is buried in the pressure generating chamber 15, the nozzle communicating passage 16A and the ink communicating passage 17A, which are formed in the first silicon layer 12, in a similar manner to those in the above-described embodiments.

Next, as shown in FIG. 19(*c*), the elastic film 50 is formed on the fist silicon layer 12 and the sacrificial layer 10. And on this elastic film 50, the lower electrode film 60, the piezoelectric film 70 and the upper electrode film 80 are sequentially laminated and patterned to form the piezoelectric element 300. Note that, this forming process of the elastic film 50 and the piezoelectric element 300 is similar to those of the above-described embodiments.

Thereafter, as shown in FIG. 19(*d*), in a region of the elastic film 50, which faces to the sacrificial layer 90, through holes exposing the sacrificial layer 90, for example in the present embodiment, a first through hole 51 and a second through hole 52 are respectively formed in regions corresponding to the nozzle communicating passage 16A and the ink communicating passage 17A. And, from the first through hole 51 and the second through hole 52, the sacrificial layer 90 is removed in a similar manner to those of the above-described embodiments.

By the process as described above, the pressure generating chamber 15 and the piezoelectric element 300 are formed.

As described above, in the present embodiment, since the pressure generating chamber 15 is formed in the first silicon layer having a thin film thickness by use of the SOI substrate as the passage-forming substrate 10A, the rigidity of the compartment wall 14 partitioning the pressure generating chambers 15 can be increased, and the plurality of pressure generating chambers 15 can be arrayed in a high density. Moreover, by making the depth of the pressure generating chamber 15 more shallow, compliance of the compartment wall 14 can be reduced to improve the ink ejection features.

Moreover, although the film thickness of the first silicon layer 12 where the pressure generating chamber 15 is formed is thin, since the thickness of the entire passage-forming substrate 10A is thick, even in the case of a wafer of a large size, handling thereof is facilitated. Accordingly, the number of chips taken from one wafer can be increased to reduce manufacturing cost. In addition, since the chip size can be increased, a head of a greater length can be manufactured.

Furthermore, since the passage-forming substrate 10A is thick, occurrence of warp is restrained to facilitate positioning in joining the same to other members. And also after the joining, a characteristic change of the piezoelectric element 300 is restrained to stabilize the ink ejection characteristic.

Note that, in the present embodiment, the SOI substrate having silicon layers formed on both surfaces of the insulating layer consisting of silicon oxide is used as the passage-forming substrate, but not being limited to this, for example, a constitution may be adopted, in which silicon layers are formed on both surfaces of an insulating layer consisting of boron-doped silicon, silicon nitride or the like. In addition, for example, the silicon layer may be provided on at least one surface of the insulating layer, and the other surface thereof may not necessarily be provided with a silicon layer.

Moreover, in the present embodiment, the first silicon layer 12 of the passage-forming substrate 10A consisting of the SOI substrate is formed so as to make a film thickness thinner than that of the second silicon layer, but not being limited to this, as a matter of course, the first silicon layer 12 may have a thickness equal to that of the second silicon layer, or the first silicon layer 12 may be thicker. It is satisfactory that the thickness of these films may be appropriately decided in consideration of the size of the pressure generating chambers 15, an array thereof and the like.

Furthermore, in the present embodiment, the nozzle orifice 21 is formed at the side of the piezoelectric element 300 of the passage-forming substrate 10A, but not being limited to this, for example, the nozzle orifice may be provided at the side opposite to that of the piezoelectric element 300 of the passage-forming substrate. Alternatively, for example, the nozzle orifice may be provided on the lateral surface of the passage-forming substrate. In addition, in the case where the nozzle orifice is provided on the lateral surface of the passage-forming substrate, a nozzle plate having a nozzle orifice drilled may be joined on the side surface of the passage-forming substrate. Alternatively, for example, as shown in FIG. 20(*a*), the nozzle orifice 21A which has an end communicating with the nozzle communicating passage 16A may be also formed in an end portion of the passage-forming substrate 10A.

Figure 20:
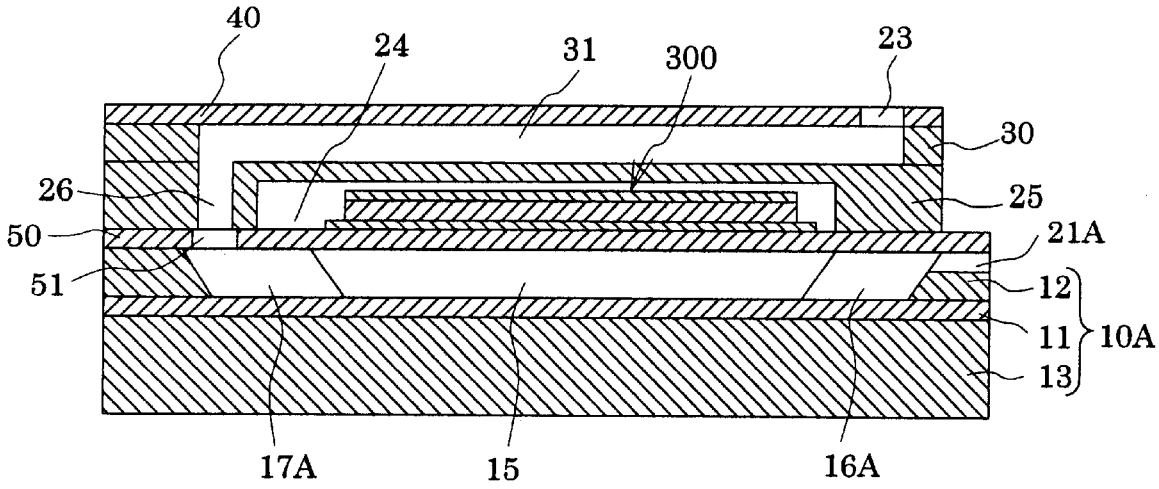
FIGS. 20(*a*) and 20(*b*) are sectional views showing another example of the ink-jet recording head according to embodiment 4 of the present invention.
Figure 20:
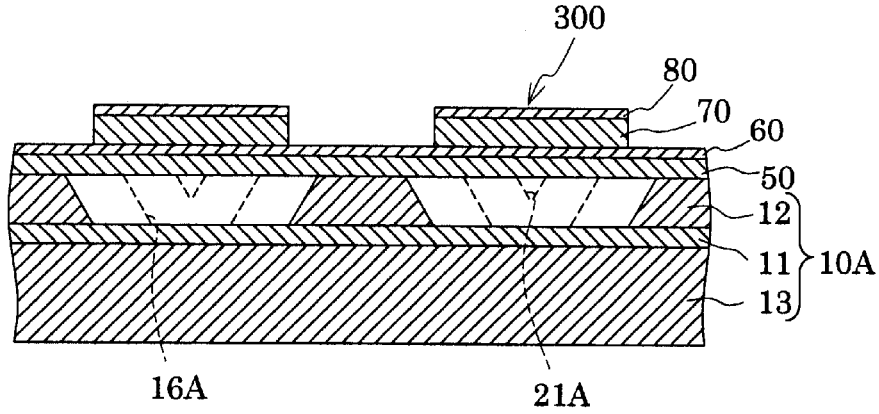

Note that, since such a nozzle orifice 21A is formed by anisotropic etching at the same time that the pressure generating chamber 15, the nozzle communicating passage 16A and the ink communicating passage 17A are formed, for example, in the case where the main surface of the first silicon layer 12 is of (001) orientation, the nozzle orifice 21A is constituted of slant planes as shown by dotted lines in FIG. 20(*b*). In this case, if the nozzle orifice 21A is formed to have a specified width by anisotropic etching, etching stops at the time when the slant surfaces abut against each other, and the nozzle orifice 21A having an approximate V-character shape in section is formed. Specifically, by adjusting the width of the nozzle orifice 21A, the depth of the nozzle orifice 21A can be readily adjusted.

Moreover, in the case where the main surface of the first silicon layer 12 is of (110) orientation, since the nozzle orifice 21A is constituted of planes approximately perpendicular to the surface of the passage-forming substrate 10 similarly to the above-described pressure generating chamber 15 and the like, it is satisfactory that the nozzle orifice 21A may be formed by etching the first silicon layer 12 halfway (half etching). Note that, the half etching is performed by adjusting an etching time.

(Embodiment 5)

Figure 21:
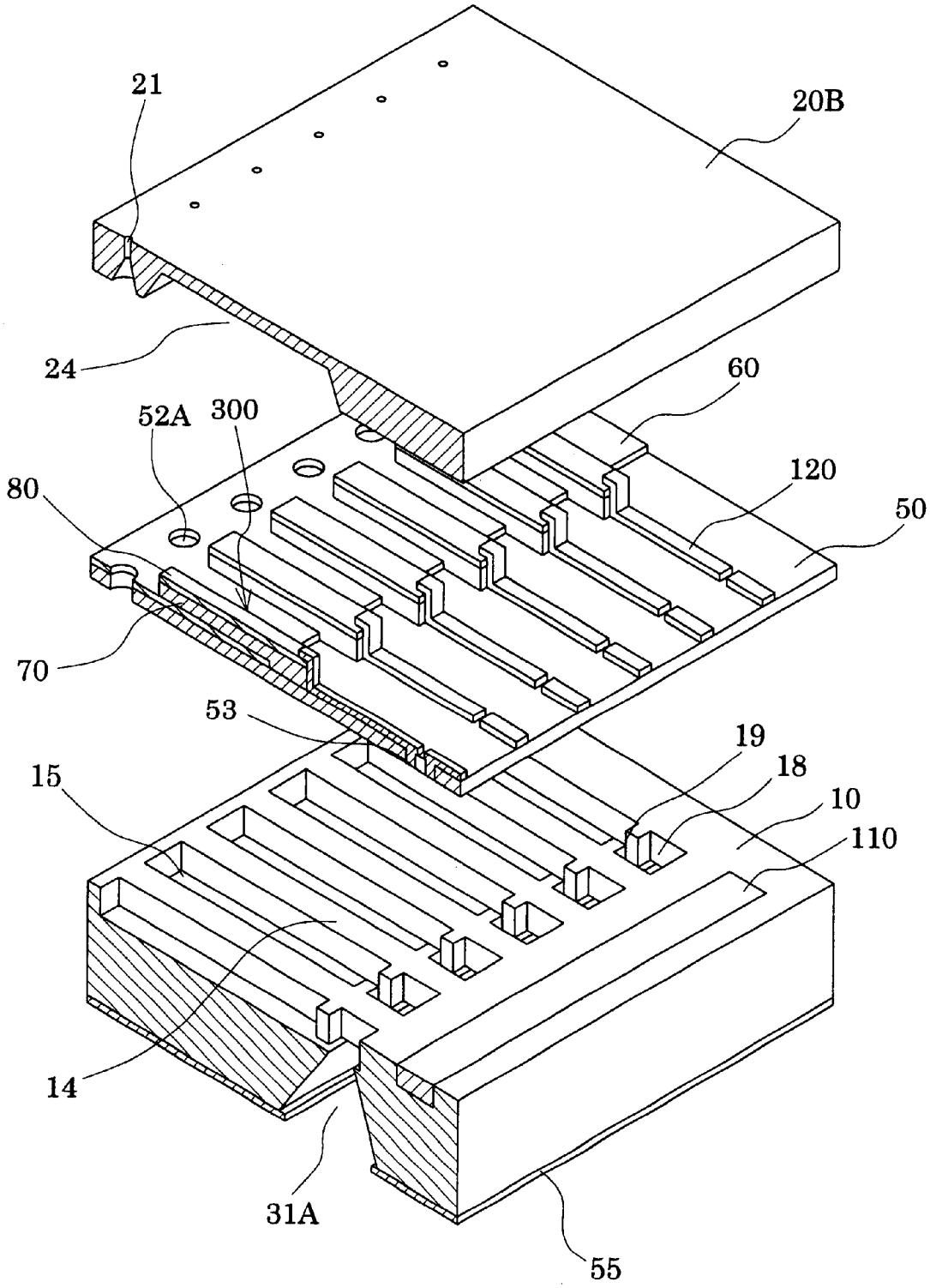
FIG. 21 is an exploded perspective view schematically showing an ink-jet recording head according to embodiment 5 of the present invention.
Figure 22:
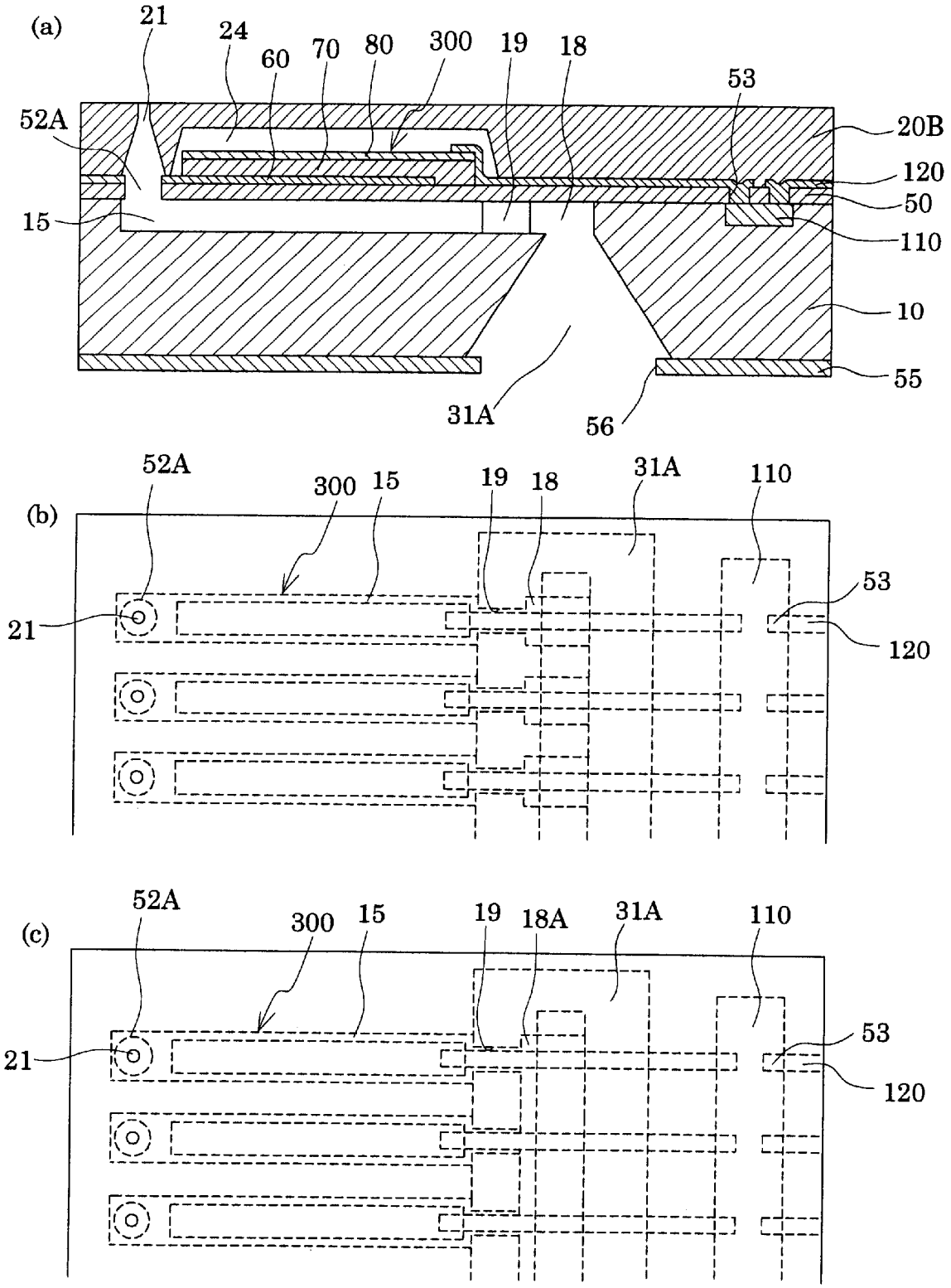
FIGS. 22(*a*) to 22(*c*) are sectional views and plan views showing the ink-jet recording head according to embodiment 5 of the present invention.

FIG. 21 is an exploded perspective view showing an ink-jet recording head according to embodiment 5, and FIGS. 22(*a*) to 22(*c*) is a view showing a sectional structure of one pressure generating chamber of the ink-jet recording head in the longitudinal direction. Note that members having similar functions to those in the embodiments described above are added with the same reference numerals, and repeated description will be omitted.

The present embodiment is an example where a reservoir supplying ink to each pressure generating chamber is provided on the surface of the passage-forming substrate, which is opposite to that having a pressure generating chamber, instead of providing the reservoir on a substrate other than the passage-forming substrate. As shown in the drawings, on the passage-forming substrate 10, pressure generating chambers 15 are formed, and with one end portion in the longitudinal direction of each pressure generating chamber 15, an ink communicating portion 18 is a relay chamber for connecting a reservoir 31A and the pressure generating chamber 15 is made to communicate via a narrowed portion 19 having a width narrower than the pressure generating chamber 15. In addition, these ink communicating portion 19 and narrowed portion 19 are formed by anisotropic etching together with the pressure generating chamber 15. Note that, the narrowed portion 18 is made for controlling the flow of ink of the pressure generating chamber 15.

Note that, in the present embodiment, the ink communicating portion 18 is provided for each pressure generating chamber 15, but not being limited to this, for example, as shown in FIG. 22(*c*), one ink communicating portion 18A may be provided to communicate with all of the pressure generating chambers 15 via the narrowed portions 19, and in this case, this ink communicating portion 18A may also constitute a part of the reservoir 31A.

Meanwhile, on the other surface of the passage-forming substrate 10, the reservoir 31A communicating with each ink communicating portion 18 and supplying ink to each pressure generating chamber 15 is formed. This reservoir 31A is formed by anisotropic etching, which is wet etching in the present embodiment, from the other surface of the passage-forming substrate 10 by use of a specified mask. Since this reservoir 31A is formed by wet etching in the present embodiment, reservoir 31A has a shape where an opening area becomes larger toward the other surface of the passage-forming substrate 10, and has a volume sufficiently larger than a volume of all the pressure generating chambers supplied with ink.

Moreover, in the present embodiment, in the vicinity of the end portion of the passage-forming substrate 10, a drive IC 110 for driving piezoelectric elements 300 to be described later is integrally formed in a direction parallel to the pressure generating chambers 15 prior to this step.

On such a passage-forming substrate 10, similarly to the above-described embodiments, an elastic film 50 is formed, and on this elastic film 50, piezoelectric elements 300, each of which consists of a lower electrode film 60, a piezoelectric film 70 and an upper electrode film 80, is formed.

Moreover, between the upper electrode film 80 of each piezoelectric element 300 and the drive IC 110 provided integrally with the passage-forming substrate 10, a lead electrode 120 is extended on the elastic film 50. Each lead electrode 120 and the drive IC 110 are electrically connected with each other via a connection hole 53 provided in a region of the elastic film 50, which faces to the drive IC 110.

Note that, in the vicinity of the end portions opposite to the ink communicating portions 18 in the longitudinal direction of the pressure generating chambers 15, second through holes 52A communicating with nozzle orifices 21 are formed by removing the elastic film 50 and the lower electrode film 60 so as to correspond to the respective pressure generating chambers 15.

Herein, description will be made for a manufacturing process of the ink-jet recording head of the present embodiment, concretely, one step in forming the pressure generating chambers 15 in the passage-forming substrate 10 consisting of a single crystal silicon substrate with reference to FIGS. 23(*a*) to 25(*b*). Note that FIGS. 23(*a*) to 25(*b*) are sectional views the ink-jet head in the longitudinal direction of the pressure generating chamber.

Figure 23:
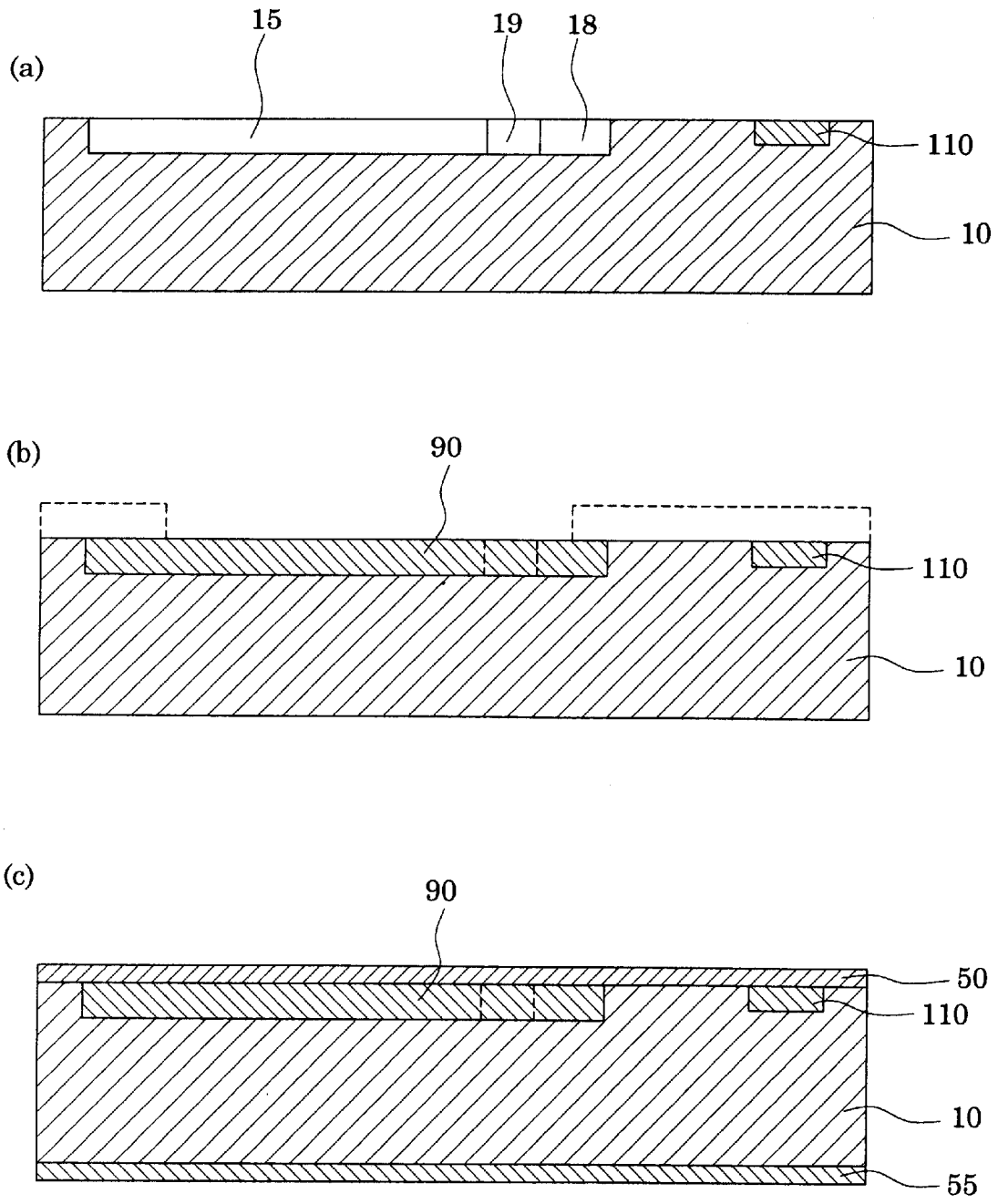
FIGS. 23(*a*) to 23(*c*) are sectional views showing a manufacturing process of the ink-jet recording head according to embodiment 5 of the present invention.

First, as shown in FIG. 23(*a*), for one surface of the single crystal silicon substrate that will be the passage-forming substrate 10, anisotropic etching is performed by use of a mask of a specified shape, which consists of, for example, silicon oxide, thus forming the pressure generating chamber 15, the ink communicating portion 18 and the narrowed portion 19. Note that, the drive IC 110 for driving the piezoelectric element is integrally formed on the passage-forming substrate 10 prior to this step.

Next, as shown in FIG. 23(*b*), similarly to the above-described embodiments, the pressure generating chamber 15, the ink communicating portion 18 and the narrowed portion 19 are filled with a sacrificial layer 10.

Next, as shown in FIG. 23(*c*), the elastic film 50 is formed on the passage-forming substrate 10 and the sacrificial layer 90, and on the other surface of the passage-forming substrate 10, a protective film 55 is a mask in forming the reservoir 31A is formed. For example, in the present embodiment, after forming zirconium layers on both surfaces of the passage-forming substrate, these zirconium layers are thermally oxidized in a diffusion furnace at a temperature of, for example, 500 to 1200° C. to form the elastic film 50 and the protective film 55, which consist of zirconium oxide.

Note that the material used for the elastic film 50 and the protective film 55 is not particularly limited, and any material may be used as long as it can not be etched in the step where reservoir 31A is formed and the step where sacrificial layer 90 is removed. For example, silicon nitride, silicon dioxide or the like can be used. Moreover, these elastic film 50 and protective film 55 may be also formed of materials different from each other. Furthermore, the protective film 55 may be formed in any step as long as the step is performed before forming the reservoir 31A.

Figure 24:
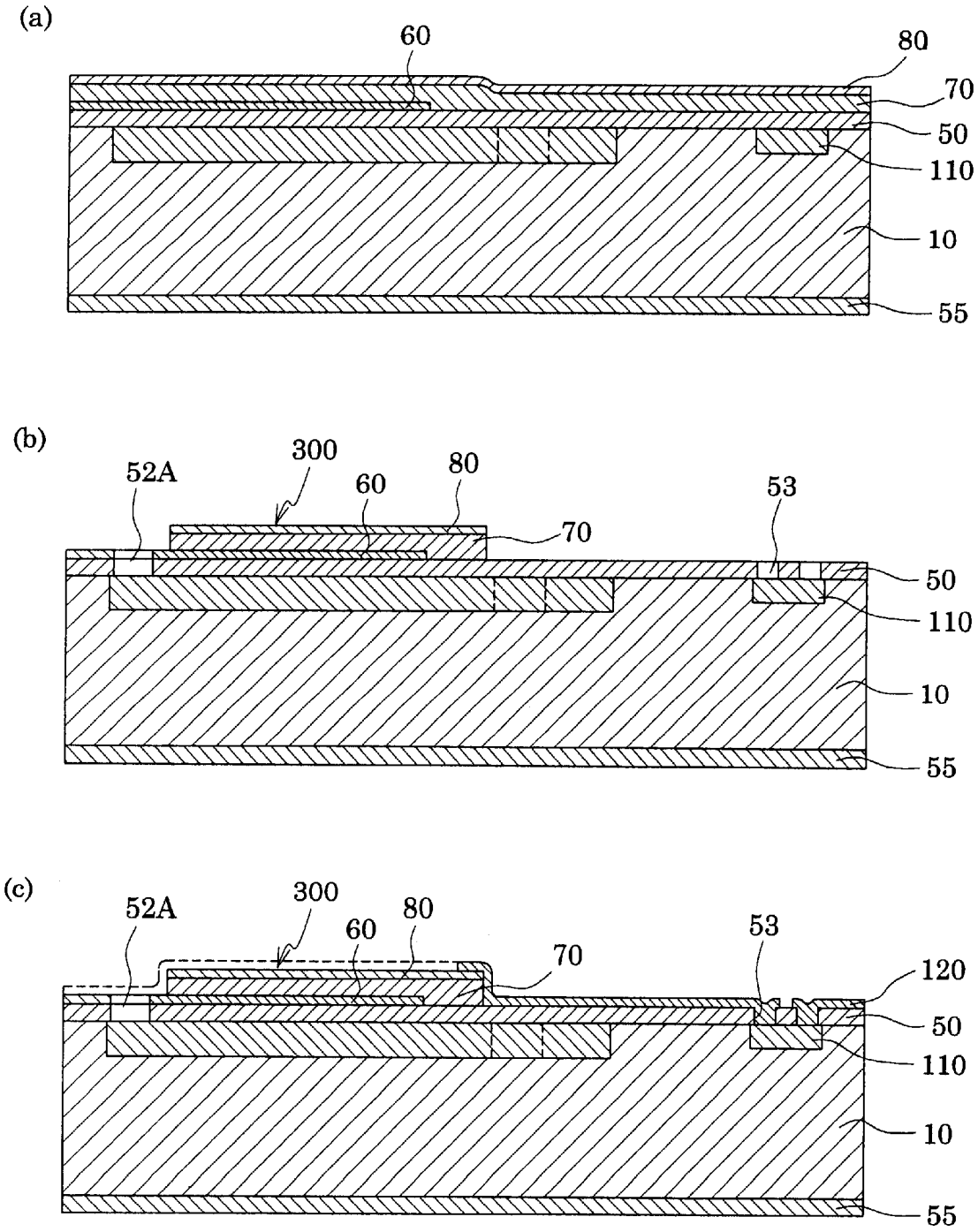
FIGS. 24(*a*) to 24(*c*) are sectional views showing the manufacturing process of the ink-jet recording head according to embodiment 5 of the present invention.

Next, the piezoelectric element 300 is formed on the elastic film 50 so as to correspond to each pressure generating chamber 15. Specifically, as shown in FIG. 24(*a*), the lower electrode film 60 is formed across the entire surface of the elastic film 50, and is patterned in a specified shape, and on the lower electrode film 60, the piezoelectric film 70 and the upper electrode film 80 are sequentially laminated. Subsequently, as shown in FIG. 24(*b*), only the piezoelectric film 70 and the upper electrode film 80 are etched to pattern the piezoelectric element 300. Note that, in the present embodiment, the elastic film 50 in the region facing the drive IC 110 is simultaneously removed, thus the connection hole 53 that will be a connecting portion with each piezoelectric element 300. And, the elastic film 50 and the lower electrode film 60 in the vicinity of the end portions opposite to the ink communicating portion 18 in the longitudinal direction of the pressure generating chamber 15 are patterned to form the second through hole 52A.

Next, as shown in FIG. 24(*c*), the lead electrode 120 is formed across the entire surface of the passage-forming substrate 10, and is patterned for each piezoelectric element 300. Thus, the upper electrode film 80 of each piezoelectric element 300 and the drive IC 110 are electrically connected with each other via the connection hole 53.

Figure 25:
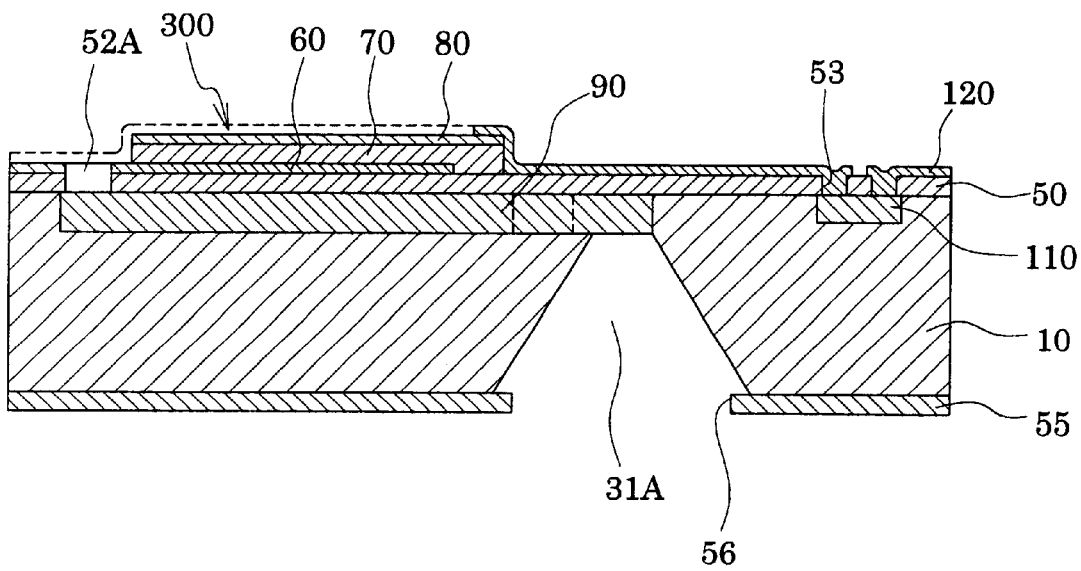
FIGS. 25(*a*) and 25(*b*) are sectional views showing the manufacturing process of the ink-jet recording head according to embodiment 5 of the present invention.
Figure 25:
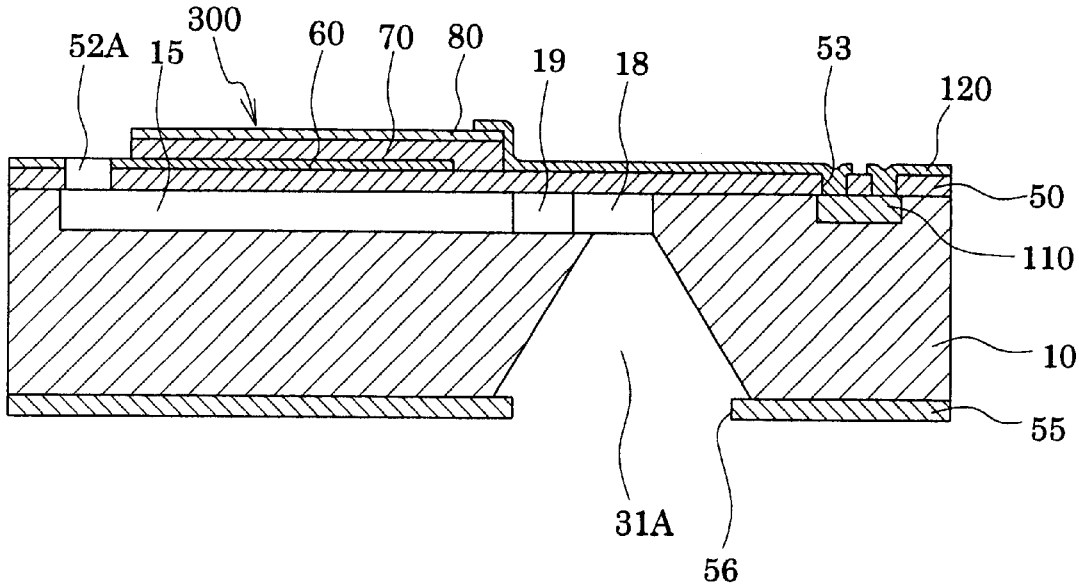

Next, as shown in FIG. 25(*a*), a region of the protective film 55 provided on the surface opposite to that having the pressure generating chamber 15 of the passage-forming substrate 10, the region being the reservoir 31A, is removed by patterning to form an opening portion 56. And, anisotropic etching (wet etching) is performed from this opening portion 56 to reach the ink communicating portion 18, thus forming the reservoir 31A. Note that, in the present embodiment, reservoir 31A is formed after forming the piezoelectric element 300, but not being limited to this, reservoir 31A may be formed in any step.

Thereafter, as shown in FIG. 25(*b*), the sacrificial layer 90 is removed by etching, which is wet etching or etching by steam, from the reservoir 31A, thus forming the pressure generating chamber 15.

As described above, with the constitution of the present embodiment, the pressure generating chamber 15 is formed on an outer layer portion of one surface of the passage-forming substrate 10, and the reservoir 31A communicating with each pressure generating chamber 15 is formed on the other surface thereof. Accordingly, the pressure generating chamber 15 can be formed to be relatively thin, the rigidity of the compartment wall 14 partitioning the pressure generating chambers 15 can be increased, and the plurality of pressure generating chambers 15 can be arrayed in a high density. Moreover, the compliance of the compartment wall 14 is reduced to improve the ink ejection features. In addition, when the pressure generating chamber 15 is formed, since the depth of the pressure generating chamber 15 can be freely set by manipulating the etching time, the compliance of the compartment wall can be controlled, and the time required for manufacturing the pressure generating chamber 15 can be reduced. Accordingly, a low-cost manufacturing can be realized.

Moreover, since the thickness of the passage-forming substrate 10 can be made relatively thick, even in the case of a wafer of a large size, handling thereof is facilitated. Accordingly, the number of chips taken from one wafer can be increased to reduce manufacturing cost. Moreover, since a chip size can be increased, a head of a greater length can be manufactured. Furthermore, occurrence of a warp of the passage-forming substrate is restrained to facilitate positioning in joining the same to other members. And also after the joining, the features change of the piezoelectric element is restrained to stabilize the ink ejection characteristic.

Furthermore, the volume of the reservoir 31A can be made sufficiently large relative to the volume of each pressure generating chamber 15, and ink itself in the reservoir 31A can be allowed to have compliance. Accordingly, it is not necessary to provide separately a plate or the like for absorbing pressure change in the reservoir 31A, and thus the structure can be simplified to reduce manufacturing cost.

Note that, on the elastic film 50 and the lower electrode film 60, which have the piezoelectric element 300 formed thereon as described above, as shown in FIGS. 21 to 22(*c*), the nozzle orifice 21 communicating with each pressure generating chamber 15 via the second through hole 52 is drilled, and a nozzle plate 20B provided with the piezoelectric element holding a portion 24 is provided.

Such a nozzle plate 20B is tightly fixed on the elastic film 50 and the lower electrode film 60 by adhesive or the like. In this case, an inner surface of the second through hole 52A formed in the elastic film 50 and the lower electrode film 60 is preferably covered with this adhesive. Thus, the inner surface of the through hole 52A is protected, and exfoliation or the like of the elastic film 50 and the lower electrode film 60 can be prevented.

Figure 26:
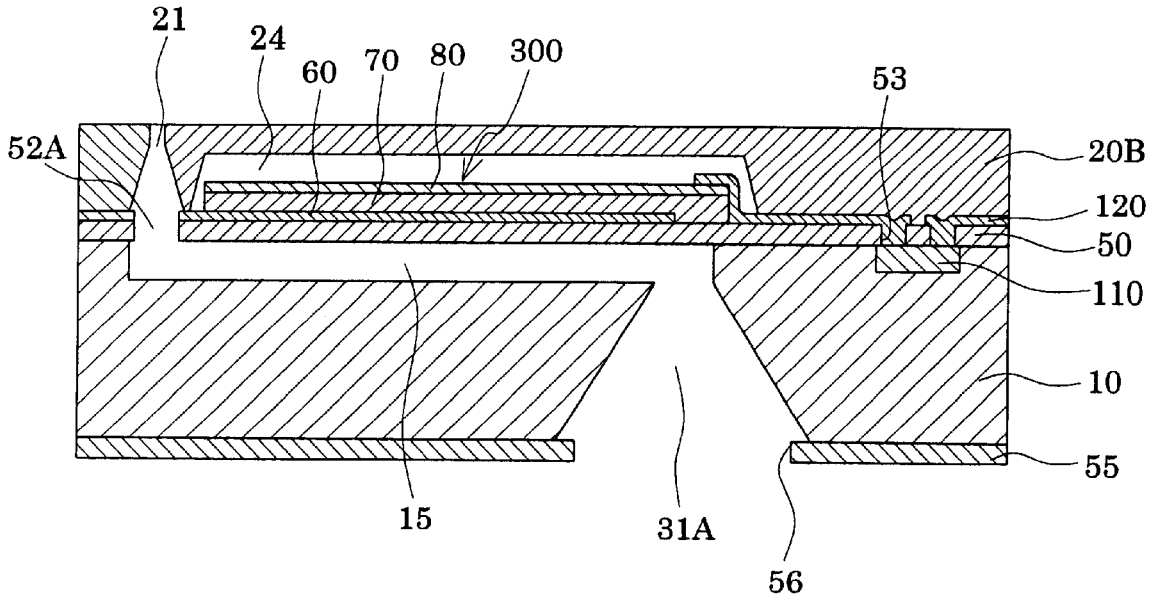
FIGS. 26(*a*) and 26(*b*) are sectional views showing another example of the ink-jet recording head according to embodiment 5 of the present invention.
Figure 26:
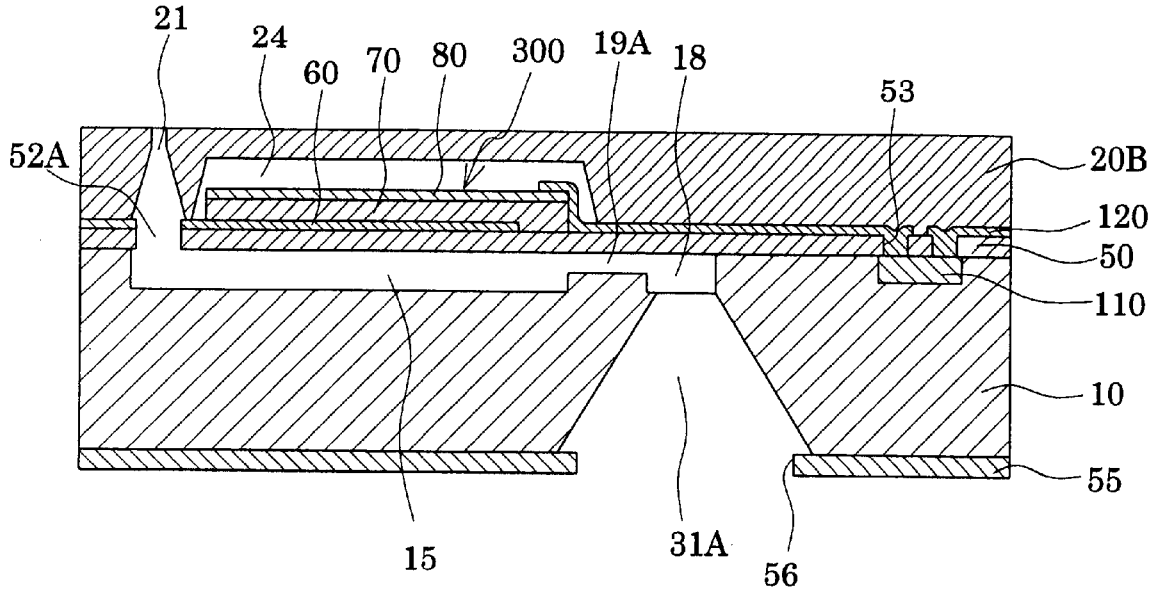

Note that, in the present embodiment, each pressure generating chamber 15 and the reservoir 31A are made to communicate with each other via the ink communicating portion 18 and the narrowed portion 19, but not being limited to this, for example, as shown in FIG. 26(*a*), each pressure generating chamber 15 and the reservoir 31A may be also made to directly communicate with each other.

Moreover, in the present embodiment, the narrowed portion 19 is formed to have a width narrower than the pressure generating chamber 15, and thus a flow of ink of the pressure generating chamber 15 is controlled, but not being limited to this, for example, as shown in FIG. 26(*b*), a narrowed portion 19A having a width equal to that of the pressure generating chamber 15 and an adjusted depth may be also formed.

Furthermore, in the present embodiment, the drive IC 110 driving the piezoelectric element 300 is formed integrally with the passage-forming substrate 10, but not being limited to this, a joining member joined to the surface, at the piezoelectric element 300 side, of the passage-forming substrate 10, for example, the nozzle plate or the like is formed of a single crystal silicon substrate, and the drive IC may be also formed integrally with this nozzle plate or the like.

Note that, a manufacturing method of the ink-jet recording head of the present embodiment is not limited to the above-described one. Hereinbelow, description will be made for an example of another manufacturing method.

Figure 27:
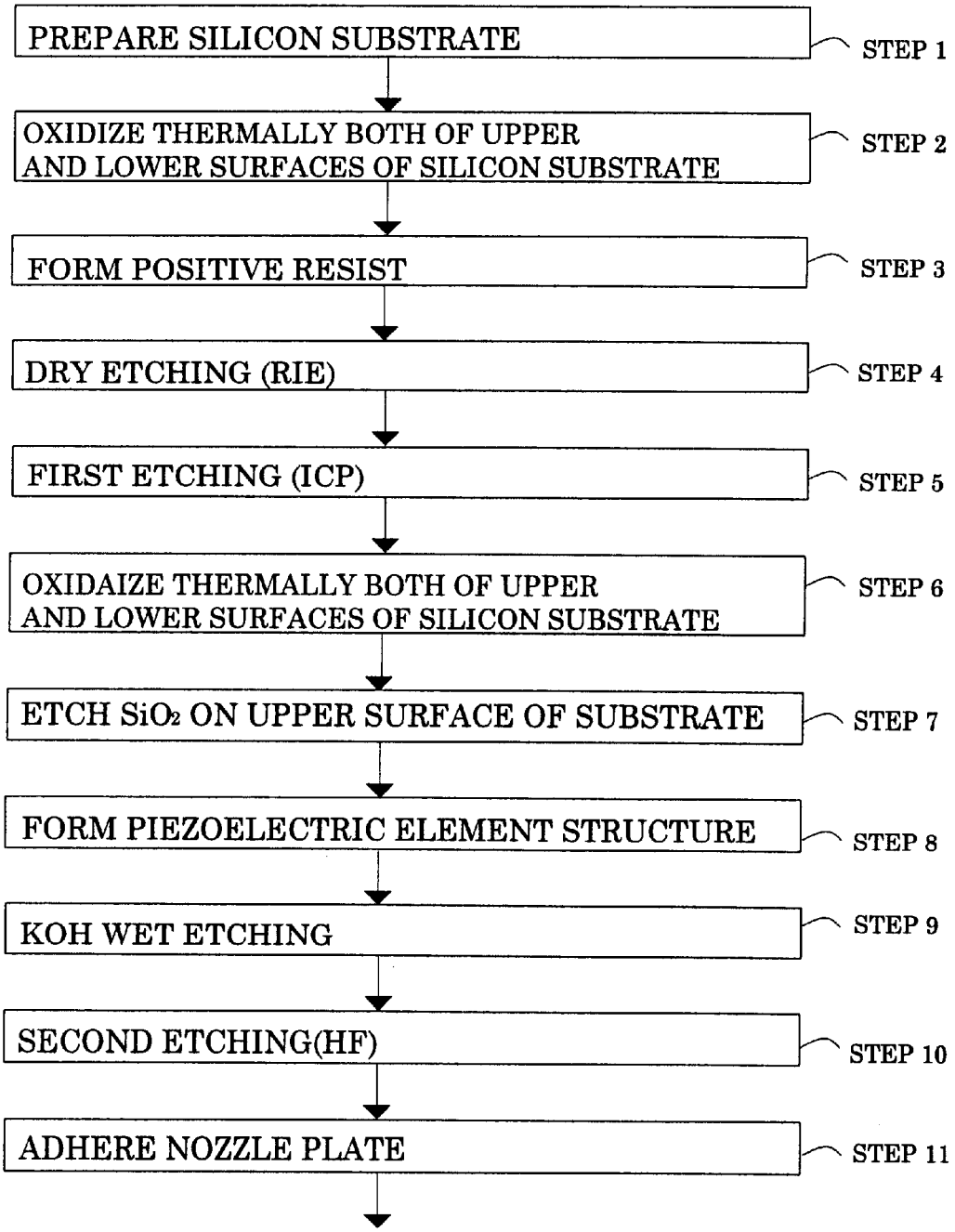
FIG. 27 is a flowchart explaining another manufacturing process of the ink-jet recording head according to embodiment 5 of the present invention.
Figure 28:
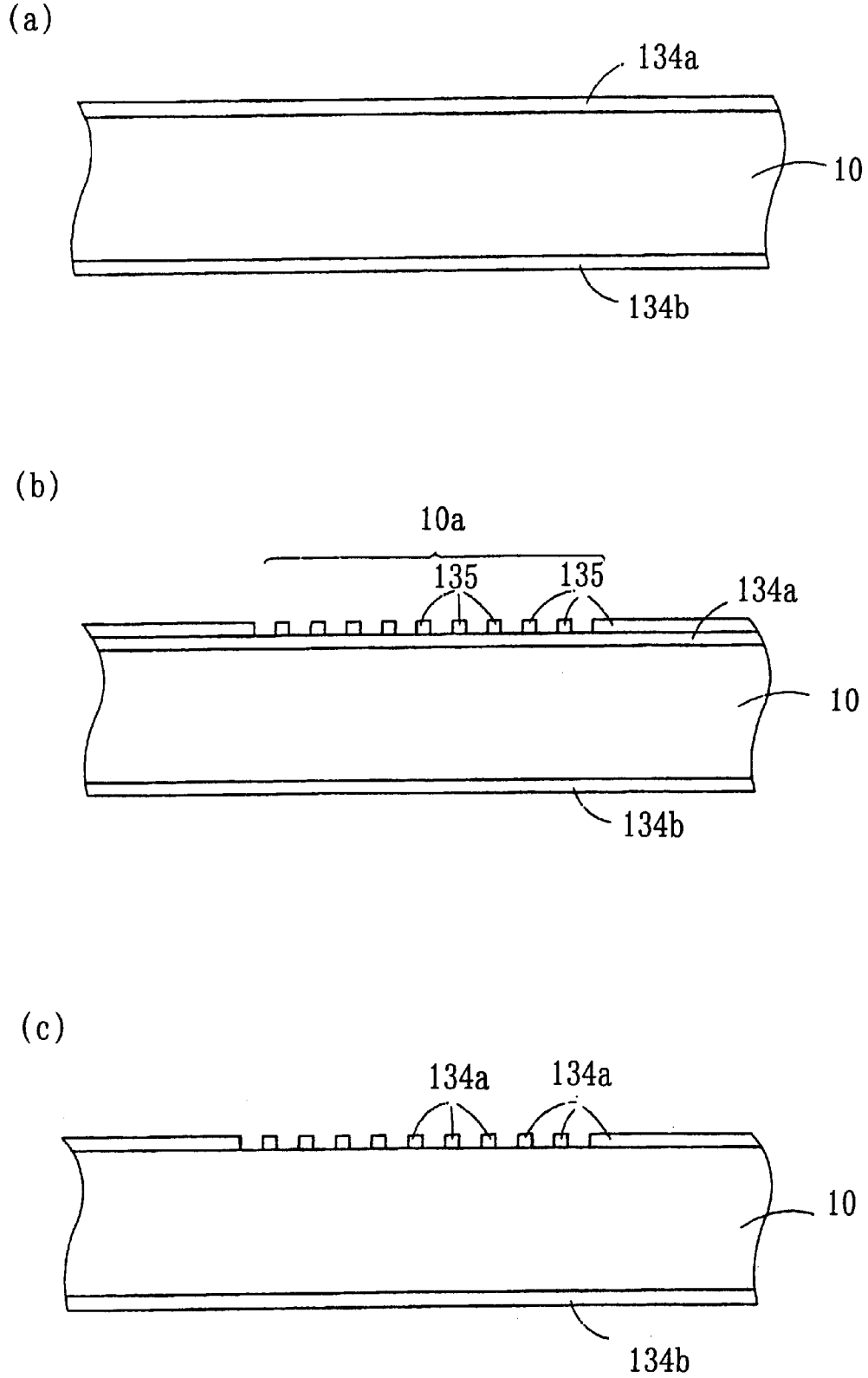
FIGS. 28(*a*) to 28(*c*) are sectional views showing another manufacturing process of the ink-jet recording head according to embodiment 5 of the present invention.

Note that, FIG. 27 is a flowchart of an embodiment of the manufacturing method of the recording head according to the present invention, and FIGS. 28(*a*) to 31(*b*) are schematic sectional views for describing each step shown in FIG. 27.

The present example is an example where the pressure generating chamber is formed without using a sacrificial layer. First, as shown in FIG. 27, a substrate that will be an object to be processed is prepared (STEP 1). Note that, in this example, as the passage-forming substrate 10, a single crystal silicon substrate having a crystal orientation of, for example, (100) is used.

Next, as shown in FIG. 28(*a*), both of upper and lower surfaces of the passage-forming substrate 10 are thermally oxidized to form $SiO_2$ films 134*a* and 134*b* (STEP 2). Subsequently, as shown in FIG. 28(*b*), further on an upper surface of the $SiO_2$ film 134*a* on the upper surface of the passage-forming substrate 10, positive resist 135 is formed (STEP 3). The positive resist 135 is formed by executing each step for, for example, resistant coating, masking, exposing, developing and post-baking. A thickness of the positive resist 135 is, for example, 1 to 2 $\mu$m.

Figure 33:
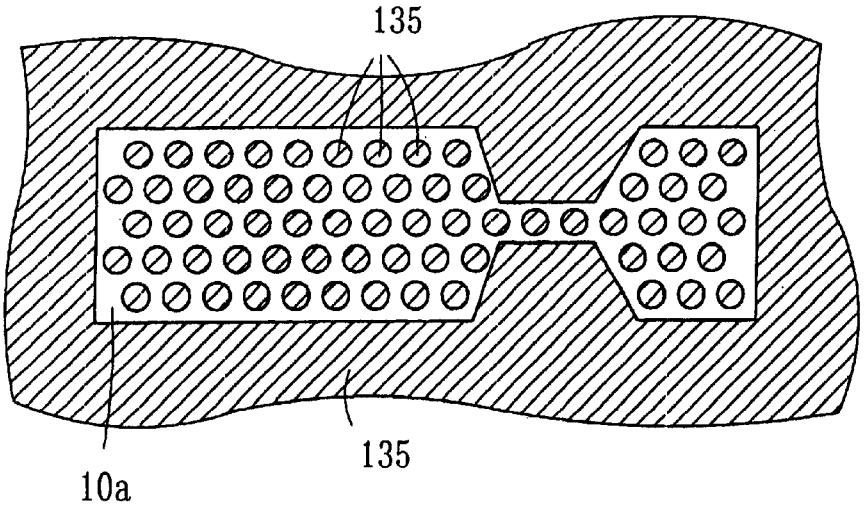
FIG. 33 is a plan view showing an arrangement example of positive resist.

One example of arrangement of the positive resist 135 is shown in FIG. 33. FIG. 33 is a plan view of FIG. 29(*b*), and slant line portions indicate the positive resist 135. As shown in FIG. 33, it is preferable that the positive resist 135 be arranged approximately uniformly on a specified region 10*a* (portion where the pressure generating chamber and the ink communicating portion are formed) of the passage-forming substrate 10.

Subsequently, as shown in FIG. 28(*c*), dry etching is executed from the upper surface of the passage-forming substrate 10, and the positive resist 135 and the $SiO_2$ film 134*a* on portions that are not covered with the positive resist 135 are etched to be removed (STEP 4).

Thus, on the upper surface of the passage-forming substrate 10, the $SiO_2$ film 134*a* is patterned. This dry etching is performed by, for example, a reactive ion etching (RIE) dry etching apparatus.

Figure 29:
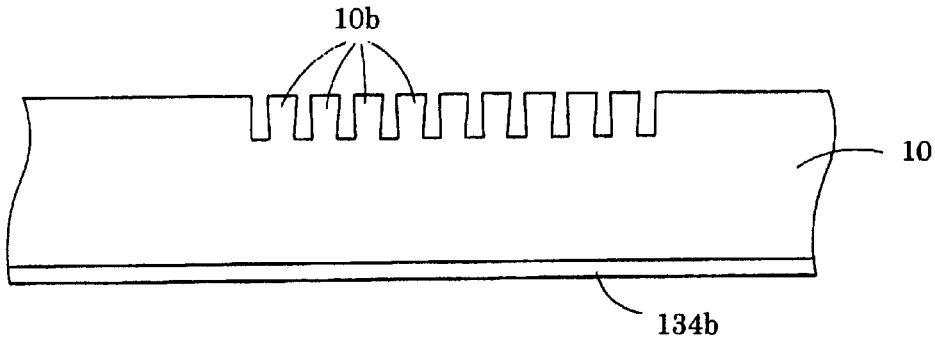
FIGS. 29(*a*) to 29(*c*) are sectional views showing another manufacturing process of the ink-jet recording head according to embodiment 5 of the present invention.
Figure 29:
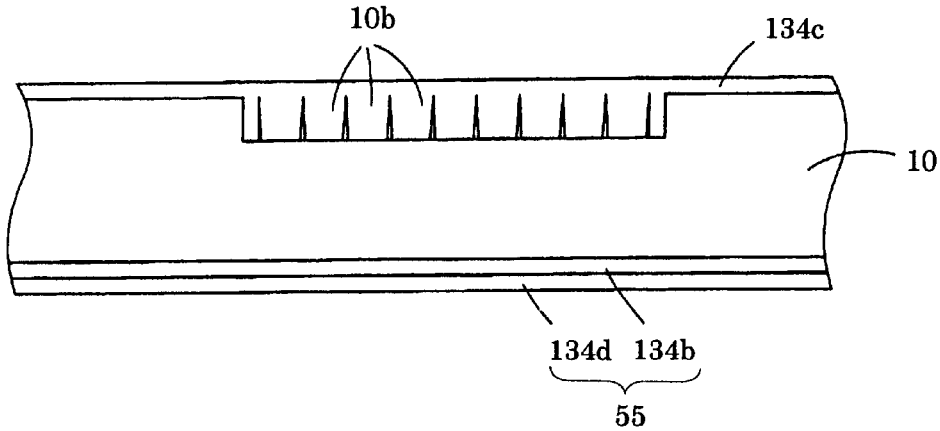
Figure 29:
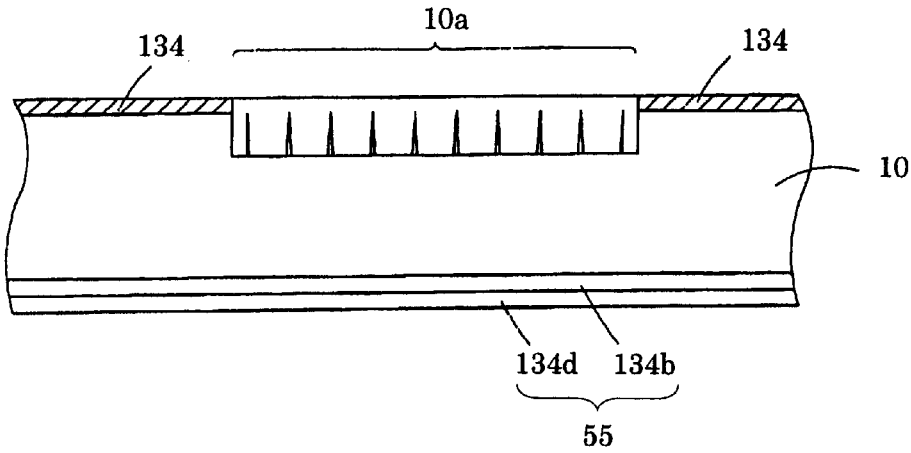

Next, as shown in FIG. 29(*a*), dry etching is executed from the upper surface of the passage-forming substrate 10. Thus, the patterned $SiO_2$ film 134*a* and the surface portion of the passage-forming substrate 10, which does not have the $SiO_2$ film 134*a* coated thereon by patterning, are etched to be removed (STEP 5: first etching step).

Thus, as shown in FIG. 29(*a*), the upper surface of the passage-forming substrate 10 is etched such that a plurality of columnar portions 10*b* remain. This dry etching is performed until a thickness (height) of the columnar portions 10*b* become about 30 to 100 $\mu$m, preferably 50 $\mu$m, by, for example, an inductively coupled plasma (ICP) dry etching apparatus or an RIE dry etching apparatus. Concretely, the dry etching is performed for, for example, about 30 minutes. Herein, it is not necessary to completely remove the patterned $SiO_2$ film 134*a*.

Figure 34:
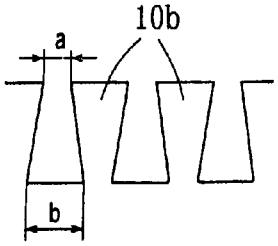
FIG. 34 is a schematic view showing an example of a sectional shape of a plurality of columns.

Note that, as shown in FIG. 34, in each of the plurality of columnar portions formed on the upper surface of the passage-forming substrate 10, it is preferable that the sectional area of a surface side be larger than a sectional area of the bottom portion side, specifically, that a gap dimension b of the bottom portion side be larger than a gap dimension a of the surface side.

Next, as shown in FIG. 29(*b*), both of the upper and lower surfaces of the passage-forming substrate 10 are thermally oxidized to form a $SiO_2$ film 134*c*, and also a film 134*d* that will be the protective film 55 (STEP 6). At this time, as shown in FIG. 29(*b*), the plurality of columnar portions 10*b* expand apparently due to formation of the oxidized film by thermal oxidization. As a result, the upper surface of the passage-forming substrate 10 becomes even. This thermally oxidizing step is completed in about 2 to 3 hours.

Subsequently, as shown in FIG. 29(*c*), until the $SiO_2$ film 134*c* portion can be completely removed, etching is performed across the entire surface of $SiO_2$ on the upper surface of the passage-forming substrate 10. Alternatively, the $SiO_2$ film 134 of portions excluding a region 10*a* is removed by patterning (STEP 7).

Figure 30:
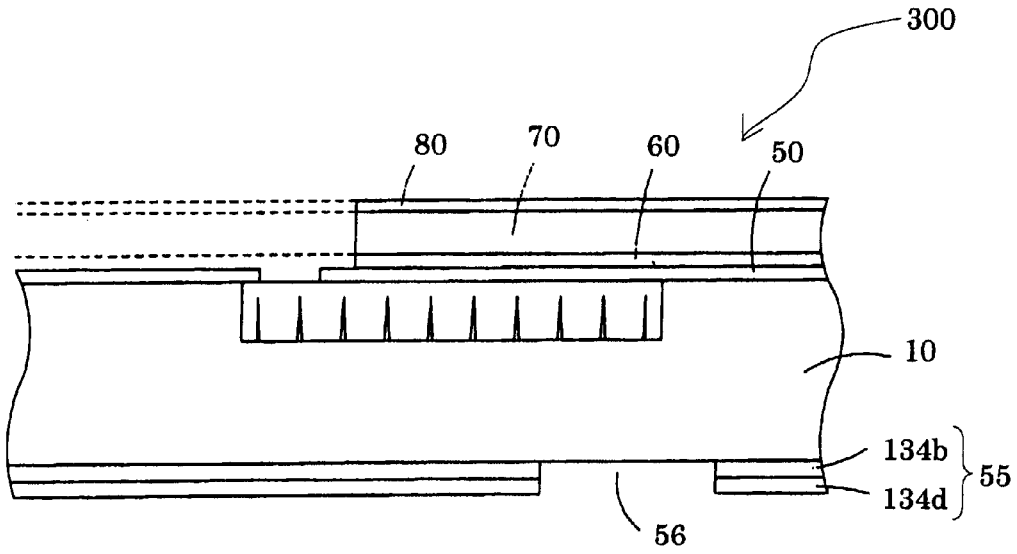
FIGS. 30(*a*) and 30(*b*) are sectional views showing another manufacturing process of the ink-jet recording head according to embodiment 5 of the present invention.
Figure 30:
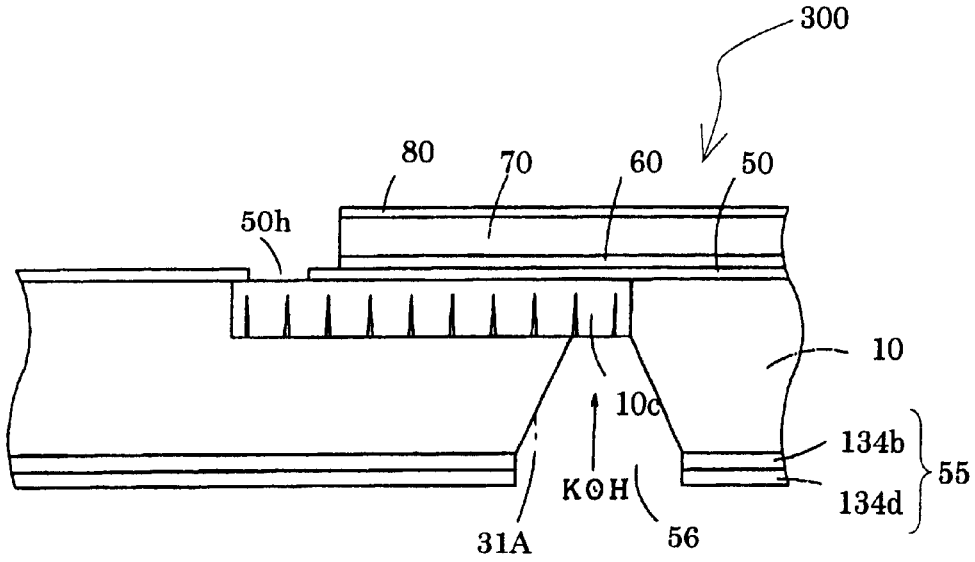

Next, on the upper surface of the passage-forming substrate 10, the piezoelectric element 300 is formed (STEP 8). Concretely, the elastic film 50, the lower electrode film 60, the piezoelectric element 70 and the upper electrode film 80 are sequentially deposited and laminated on the upper surface of the passage-forming substrate 10. And, as shown in FIG. 30(*a*), the upper electrode film 80, the piezoelectric film 70, the lower electrode film 60 and the elastic film 50 are patterned. On the other hand, also with regard to the lower surface of the passage-forming substrate 10, a slit-shaped opening portion 56 continuing in the width direction of the pressure generating chamber is formed.

Next, as shown in FIG. 30(*b*), wet etching is executed by KOH from the lower surface of the passage-forming substrate 10, and the etching advances from the slit-shaped opening portion 56 to the region where the plurality of thermally oxidized columnar portions 10*c* exist, thus forming the reservoir 31A (STEP 9).

Figure 31:
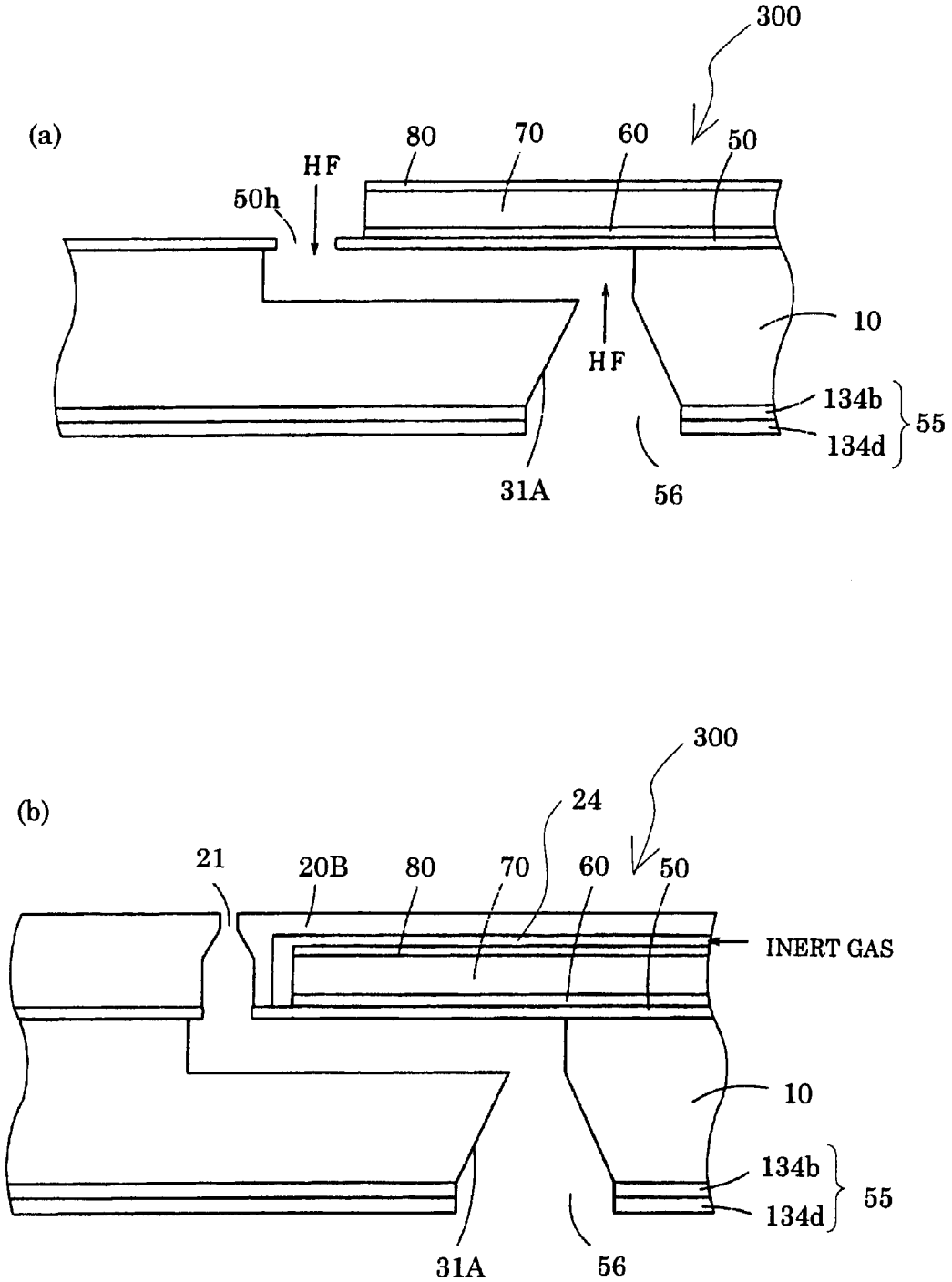
FIGS. 31(*a*) and 31(*b*) are sectional views showing another manufacturing process of the ink-jet recording head according to embodiment 5 of the present invention.

Subsequently, as shown in FIG. 31(*a*), wet etching is executed by HF from both of the upper and lower surfaces of the passage-forming substrate 10 (STEP 10: second etching). This etching advances from the reservoir 31A formed in the prior step and a specified portion 50*h* of the elastic film 50, and removes the columnar portions 10*c* in which a chemical property is transformed by thermal oxidization.

Figure 32:
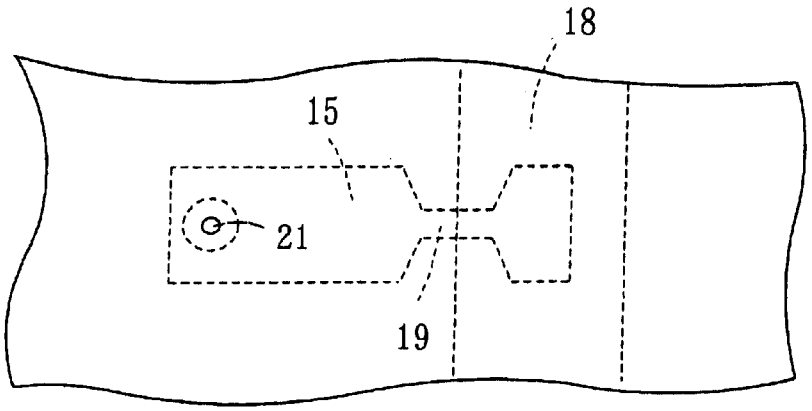
FIG. 32 is a schematic plan view of the ink-jet recording head of FIG. 31.

Thus, the pressure generating chamber 15, the ink communicating portion 18 and the narrowed portion 19 are formed (see FIG. 32). Note that, in the wet etching by HF, it is desirable that the piezoelectric element be protected by, for example, fluorine-series resin, paraxylylene resin or the like, and that the resin be removed after the etching.

Figure 35:
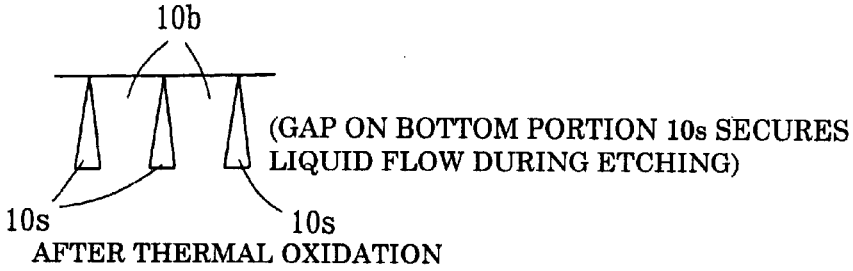
FIG. 35 is a schematic view showing the sectional shape of the plurality of columns after thermal oxidation.

In the case of the present embodiment, since gaps 10*s* as shown in FIG. 35 are made to remain among the plurality of thermally oxidized columnar portions 10*c*, an HF liquid etches the plurality of columnar portions 10*c* more effectively. Moreover, since the $SiO_2$ film (elastic film) 134 in the region corresponding to the upper surface of the passage-forming substrate is removed, exfoliation of the piezoelectric element structure due to side etching of the $SiO_2$ film can be prevented.

Subsequently, as shown in FIG. 31(*b*), on the upper surface of the passage-forming substrate 10, the nozzle plate 20B having the nozzle orifice 21 and the piezoelectric element holding portion 24 is adhered (STEP 11). Into this piezoelectric element holding portion 24, for example, an inert gas is introduced, and thus the piezoelectric element is protected from humidity or the like. Note that FIG. 32 is a plan view showing a state of FIG. 31(*b*).

As described above, according to the present embodiment, even in the case where the depth of the pressure generating chamber 15 is shallowly formed, the thickness of the passage-forming substrate 10 to be prepared can be selected freely. For this reason, handling of the passage-forming substrate 10 during manufacturing is facilitated, and a silicon substrate of a large-diameter wafer can be utilized.

Moreover, according to the present embodiment, since the chemical property of the plurality of columnar portions 10*c* is transformed after the etching is performed so that the concerned columnar portions 10*c* can be made to remain, it is not necessary to deposit the sacrificial layer, and thus a manufacturing time therefor can be significantly shortened. However, it is possible to execute the step of transforming the chemical property and the step of filling (depositing) the sacrificial layer in combination therewith.

In the case of the present embodiment, since thermal oxidization is adopted as a system for transforming the chemical property of the passage-forming substrate 10, the plurality of columnar portions 10*c* expand, and thus flattening of the passage-forming substrate 10 is also achieved simultaneously. However, some flattening step may be performed separately.

Figure 36:
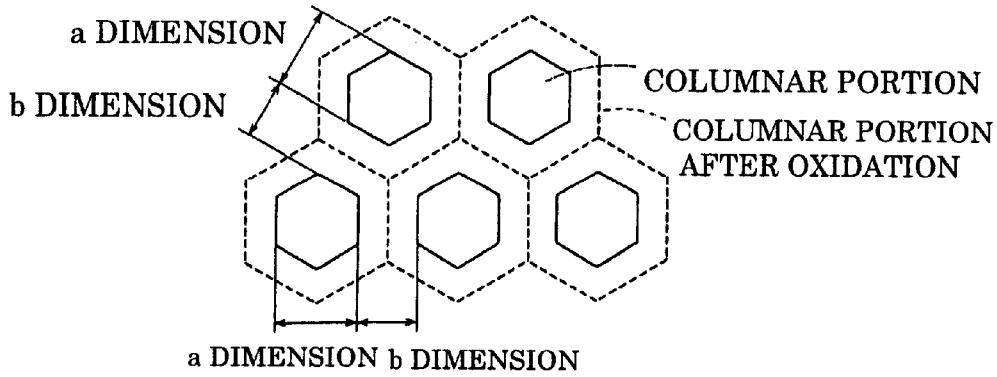
FIG. 36 is a plan view showing another arrangement example of the positive resist.
Figure 37:
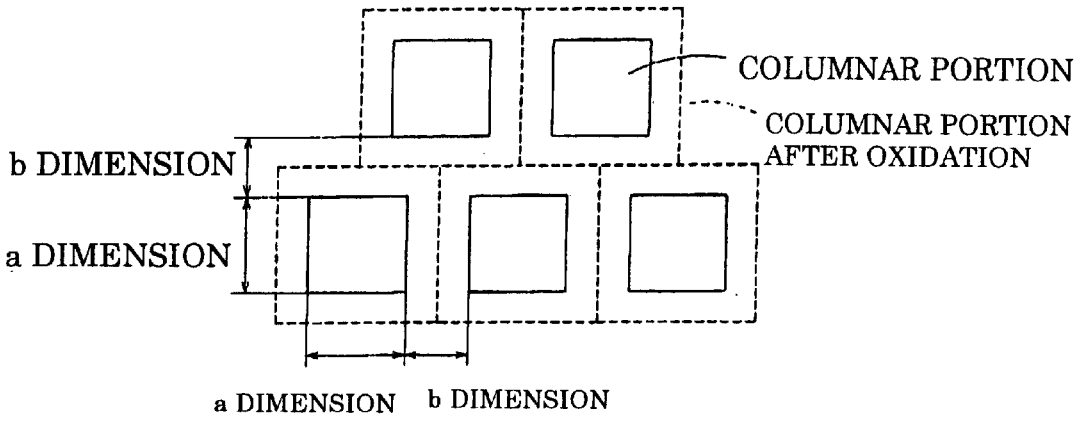
FIG. 37 is a plan view showing still another arrangement example of the positive resist.
Figure 38:
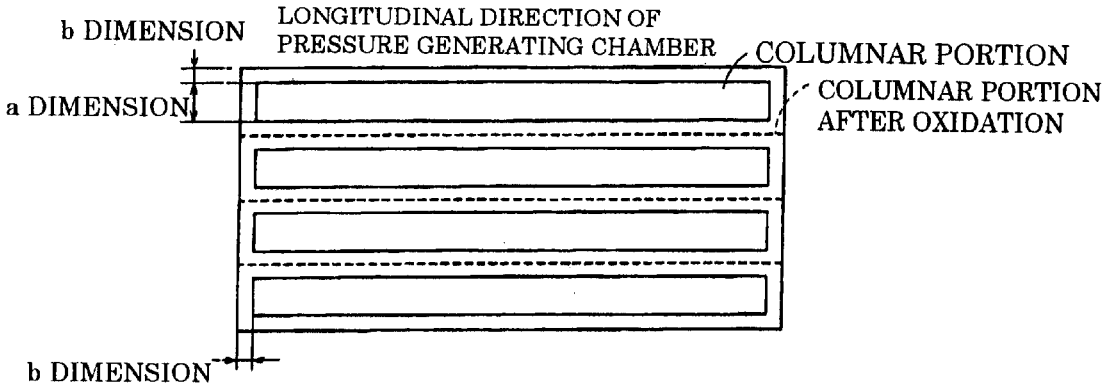
FIG. 38 is a plan view showing yet another arrangement example of the positive resist.

Since the plurality of columnar portions 10*c* to be thermally oxidized are removed by the second etching step (wet etching by HF), the plurality of columnar portions 10*c* are preferably constituted approximately uniformly as in the present embodiment. The arrangement of the columnar portions are decided by the arrangement of the positive resist 135 in the case of the present embodiment. Besides the circular pattern shown in FIG. 33, the pattern of the columnar portions may be also a hexangular pattern, a square pattern or a slit pattern as shown in FIGS. 36 to 38. As concrete examples of dimensions in each of these patterns, with regard to an a dimension and a b dimension, which are shown in each drawing, data as shown in the following table are enabled.

TABLE 1

| | | | | | | |
|---|---|---|---|---|---|---|
| a dimension (μm) | 2 | 3 | 4 | 6 | 8 | 10 |
| b dimension (μm) | 1 | 1.5 | 2 | 3 | 4 | 5 |

Moreover, in the present embodiment, since the gaps 10s are made to remain among the plurality of thermally oxidized columnar portions 10*c*, the plurality of columnar portions are etched more effectively.

According to the present embodiment, regardless of the thickness and the plane orientation of the passage-forming substrate 10, it is possible to form the pressure generating chamber having an optional depth and an optional shape extremely readily, and to do this in a short time. From a request such as high densifying of nozzle intervals of the recording head, it is particularly preferable that a pressure generating chamber of an approximate hexahedron be constituted.

Note that, the recording head itself manufactured according to the present invention is also in the range covered by the present application. For example, it is conceivable that surface unevenness is observed in the pressure generating chamber 15 of the recording head manufactured according to the present embodiment due to the formation of the columnar portions 10*c*.

(Embodiment 6)

Figure 39:
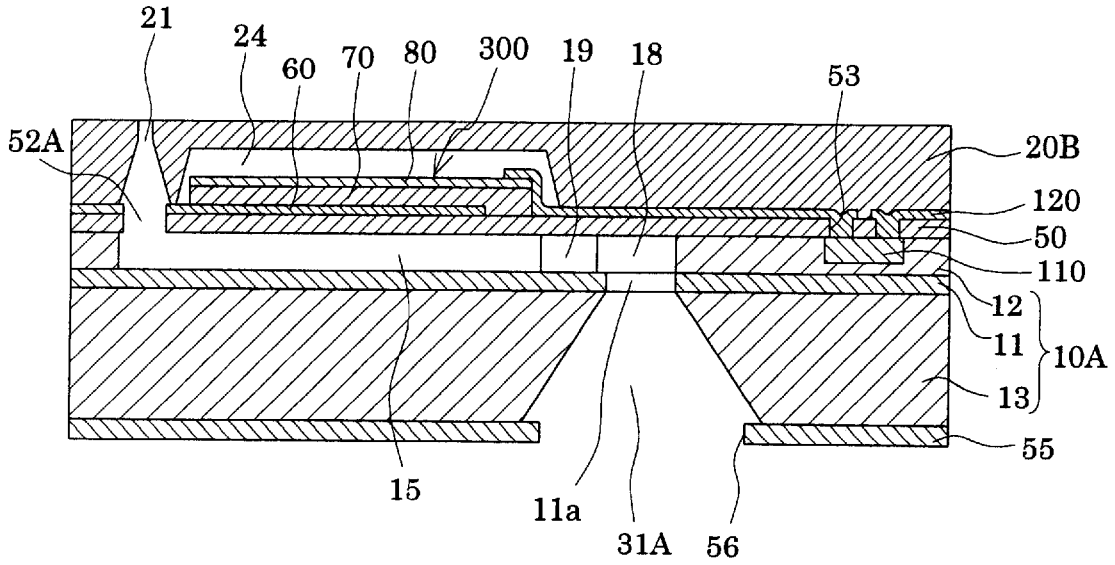
FIG. 39 is a sectional view showing an ink-jet recording head according to embodiment 6 of the present invention.

FIG. 39 is a sectional view of an ink-jet recording head according to embodiment 6.

As shown in FIG. 39, the present embodiment is an example where an SOI substrate consisting of an insulating layer 11 and first and second silicon layers 12 and 13 provided on both surfaces of this insulating layer 11 is used as a passage-forming substrate. The present embodiment is similar to embodiment 5 except that the first silicon layer 12 having a film thickness thinner than that of the second silicon layer 13 is etched to reach the insulating layer 11, thus forming a pressure generating chamber 15, an ink communicating portion 18 and a narrowed portion 19, and that the second silicon layer 13 is etched to reach the insulating layer 13, thus forming a reservoir 31A and a through portion 11*a* in a portion of the insulating layer 11, which corresponds to the bottom surface of the reservoir 31A.

Also with such a constitution of the present embodiment, as a matter of course, effects similar to those of the above-described embodiments can be obtained.

(Embodiment 7)

Figure 40:
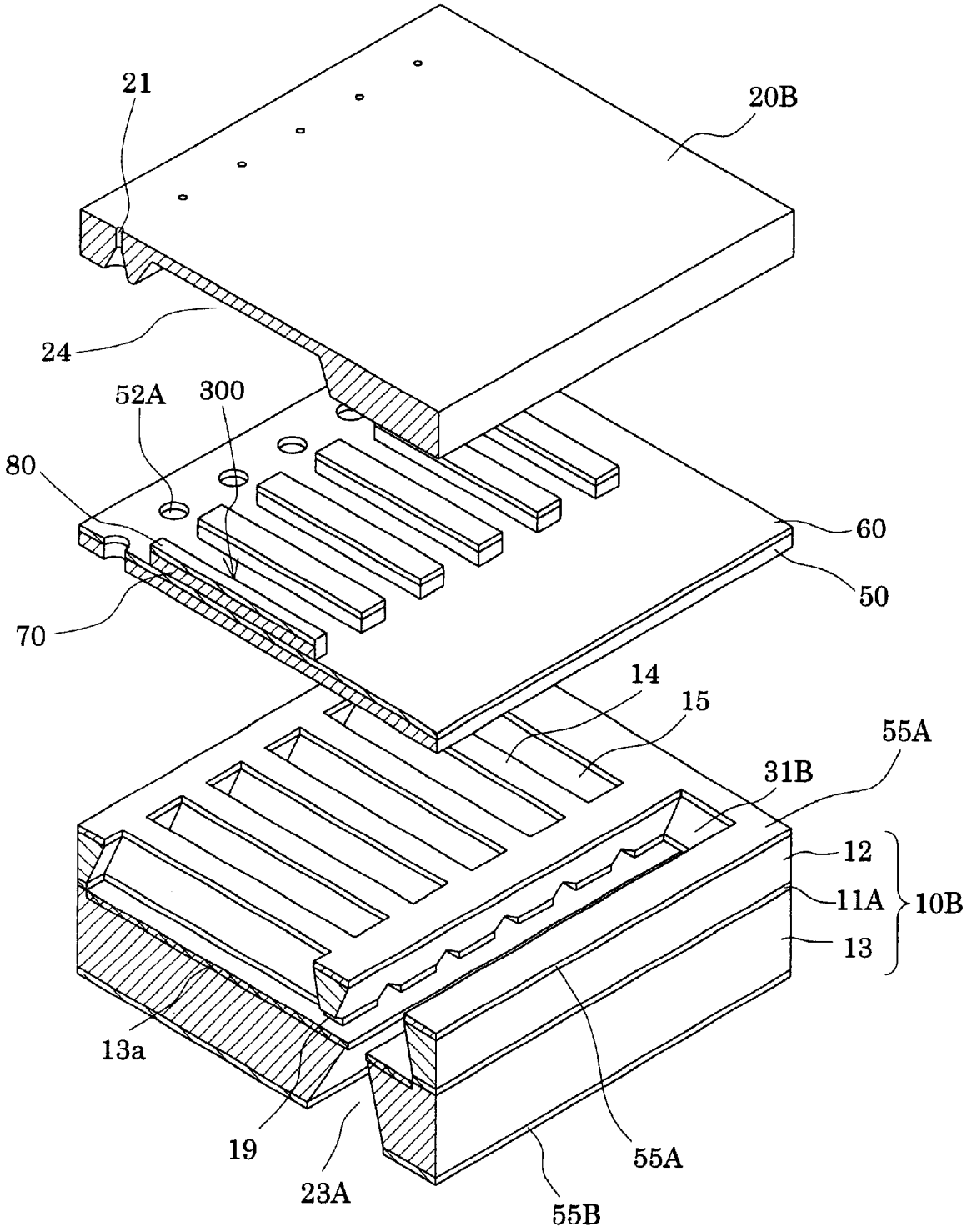
FIG. 40 is an exploded perspective view schematically showing an ink-jet recording head according to embodiment 7 of the present invention.
Figure 41:
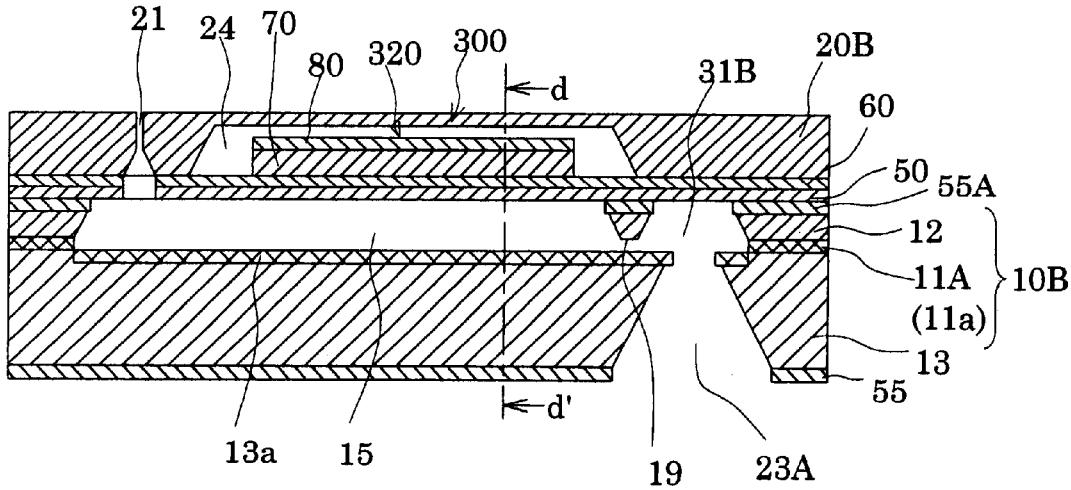
FIGS. 41(*a*) and 41(*b*) are sectional views showing the ink-jet recording head according to embodiment 7 of the present invention.
Figure 41:
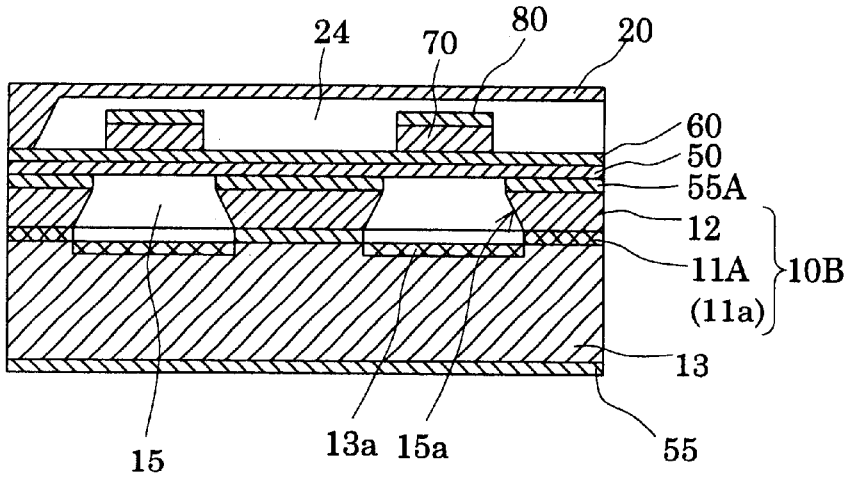

FIG. 40 is an exploded perspective view showing an ink-jet recording head according to embodiment 7, and FIGS. 41(*a*) and 41(*b*) are views showing sectional structures of one pressure generating chamber of ink-jet recording head in the longitudinal and width directions of the pressure generating chamber.

The present embodiment is another example of using the passage-forming substrate constituted of a plurality of layers. As shown in the drawings, a passage-forming substrate 10B consists of a polysilicon layer 11A and first and second silicon layers 12 and 13 provided on both surfaces of this polysilicon layer 11A.

On one silicon layer constituting this passage-forming substrate 10B, that is, on the first silicon layer 12 in the present embodiment, pressure generating chambers 15 partitioned by a plurality of compartment walls 14 by means of, for example, anisotropic etching, is parallelly provided in the width direction. In addition, at one end portion in the longitudinal direction of each pressure generating chamber 15, a reservoir 31B that will be a common ink chamber for each pressure generating chamber 15 is formed and made to communicate with one end portion in the longitudinal direction of each pressure generating chamber 15 via a narrowed portion 19 respectively.

Moreover, in the other silicon layer, that is, in the second silicon layer 13 in the present embodiment, an ink introducing port 23A, which penetrates this second silicon layer 13 in the thickness direction and serves for introducing ink to the reservoir 31B, is formed. In addition, on a region of a joining surface to the polysilicon layer 11A, which is opposite to the pressure generating chamber 15, the reservoir 31B and the narrowed portion 19, excluding a portion which has the ink introducing port 23A made to communicate therewith, a boron-doped silicon layer 13*a* having boron doped therein is formed.

Each of the first and second silicon layers 12 and 13 constituting such a passage-forming substrate 10B consists of a single crystal silicon substrate of the plane orientation (100). For this reason, a lateral surface 15*a* in the width direction of the pressure generating chamber 15 constitutes a slant plane slanting in such a manner that a width thereof is narrower at the piezoelectric element 300 side, and thus a passage resistance in the pressure generating chamber 15 is restrained.

Meanwhile, on the polysilicon layer 11A interposed between these first and second silicon layers 12 and 13, a boron-doped polysilicon layer 11*a* having boron doped in a specified region thereof is formed. This boron-doped polysilicon layer 11*a* imparts an etching selectivity to the pressure generating chamber 15 formed in the first silicon layer 12. Specifically, between the first and second silicon layers 12 and 13, only the boron-doped polysilicon layer 11*a* is substantially interposed. Note that, a silicon oxide layer may be also provided between this polysilicon layer 11A and the first silicon layer 12, thus a highly accurate etching selectivity for the polysilicon layer 11A can be obtained.

Moreover, on a surface of the first silicon layer 12 constituting the passage-forming substrate 10B, a protective film 55A formed by thermally oxidizing the first silicon layer 12 previously is formed. On this protective film 55A, similarly to the above-described embodiments, the piezoelectric element 300 consisting of a lower electrode film 60, a piezoelectric film 70 and the upper electrode film 80 is formed via an elastic film 50.

Furthermore, at the piezoelectric element 300 side of the passage-forming substrate 10, that is, onto the elastic film 50 and the lower electrode film 60 in the present embodiment, similarly to the above-described embodiments, a nozzle plate 20B is joined.

Herein, description will be made for a manufacturing process of the ink-jet recording head of the present embodiment, concretely, a process of forming the pressure generating chamber 15 and the like in the passage-forming substrate 10. Note that FIGS. 42(*a*) to 43(*d*) are sectional views ink-jet recording head in the longitudinal direction of the pressure generating chamber 15.

First, the passage-forming substrate 10B having first and second silicon layers on both surfaces of a polysilicon layer is formed.

Figure 42:
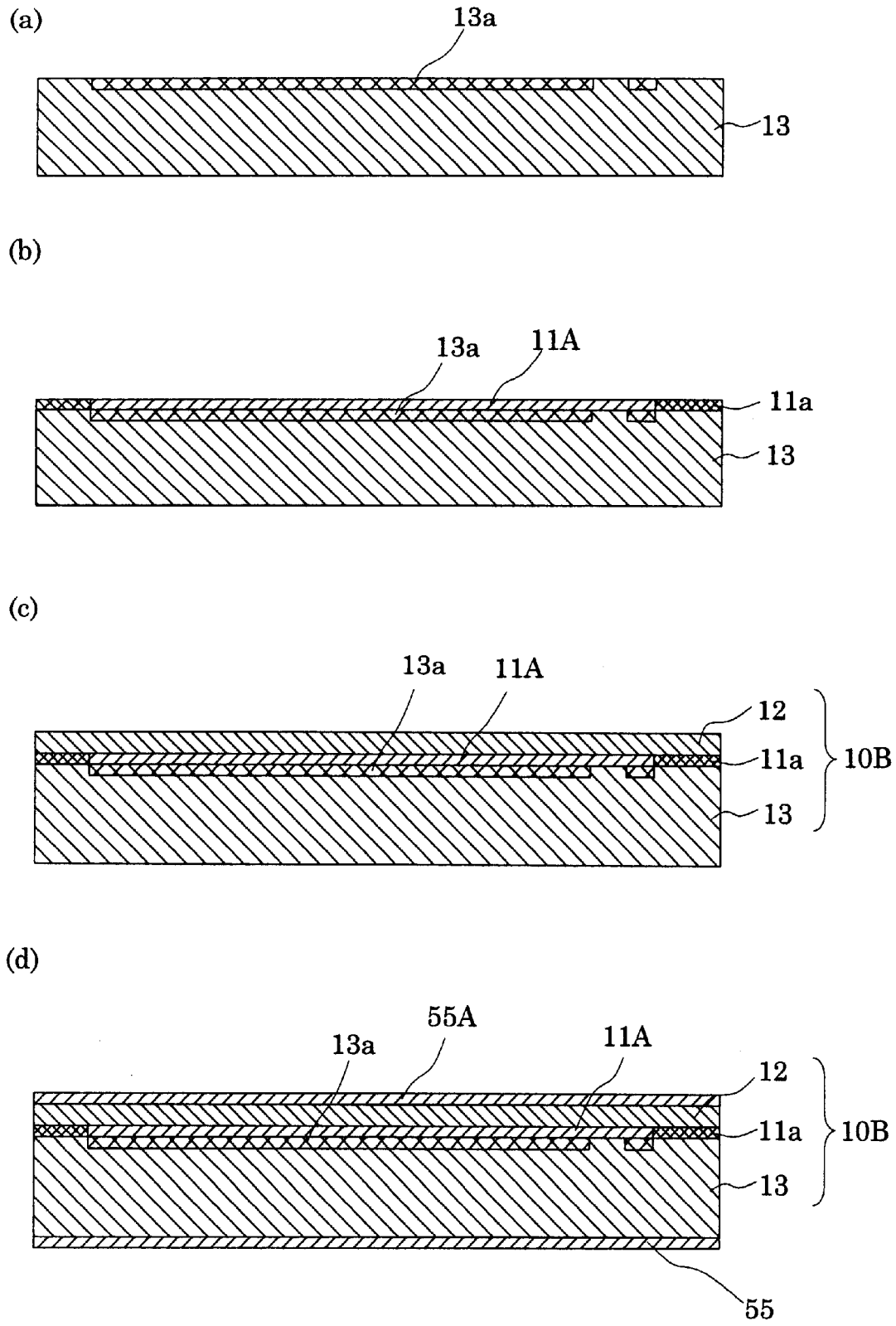
FIGS. 42(*a*) to 42(*d*) are sectional views showing a manufacturing process of the ink-jet recording head according to embodiment 7 of the present invention.

Specifically, as shown in FIG. 42(*a*), on a region of the surface layer of the second silicon layer 13, which faces the pressure generating chamber 15, reservoir 31B and the narrowed portion 19 and excludes a portion having the ink introducing port 23A made to communicate therewith, by use of a mask such as an oxidized film, boron is doped by depth of, for example, about 1 μm, thus forming the boron-doped silicon layer 13*a*. Note that, a boron-doped silicon layer may be also provided on the entire surface of the second silicon layer 13 excluding at least a portion with which the ink introducing port 23A communicates.

Subsequently, as shown in FIG. 42(*b*), on the second silicon layer 13, the polysilicon layer 11A is formed so as to have a thickness of about 0.1 to 3 μm. Thereafter, boron is doped in a portion other than the region of this polysilicon layer 11A, which will be the pressure generating chamber 15, the reservoir 31B and the narrowed 19 to form the boron-doped polysilicon layer 11*a*, and thus the etching selectivity is imparted to the polysilicon layer 11A.

Subsequently, as shown in FIG. 42(*c*), on this polysilicon layer 11A, the first silicon layer 12 having a thickness of, for example, about 50 μm is adhered, and thus the passage-forming substrate 10B is formed.

Note that a adhering method of the polysilicon layer 11A and the first silicon layer 12 is not particularly limited, but for example, the polysilicon layer 11A and the first silicon layer 12 can be adhered by adsorbing the first silicon layer 12 onto the polysilicon layer 11A and performing anneal processing therefor at a high temperature of about 1200° C. In addition, after adhering the first silicon layer 12 thereon, the first silicon layer 12 may be polished to have a specified thickness.

Next, as shown in FIG. 42(*d*), the surfaces of the passage-forming substrate 10B thus formed, that is, the surfaces of the first and second silicon layers 12 and 13 constituting the passage-forming substrate 10B are thermally oxidized in a diffusion furnace at about 1100° C., thus forming the protective films 55 and 55A consisting of silicon dioxide.

Figure 43:
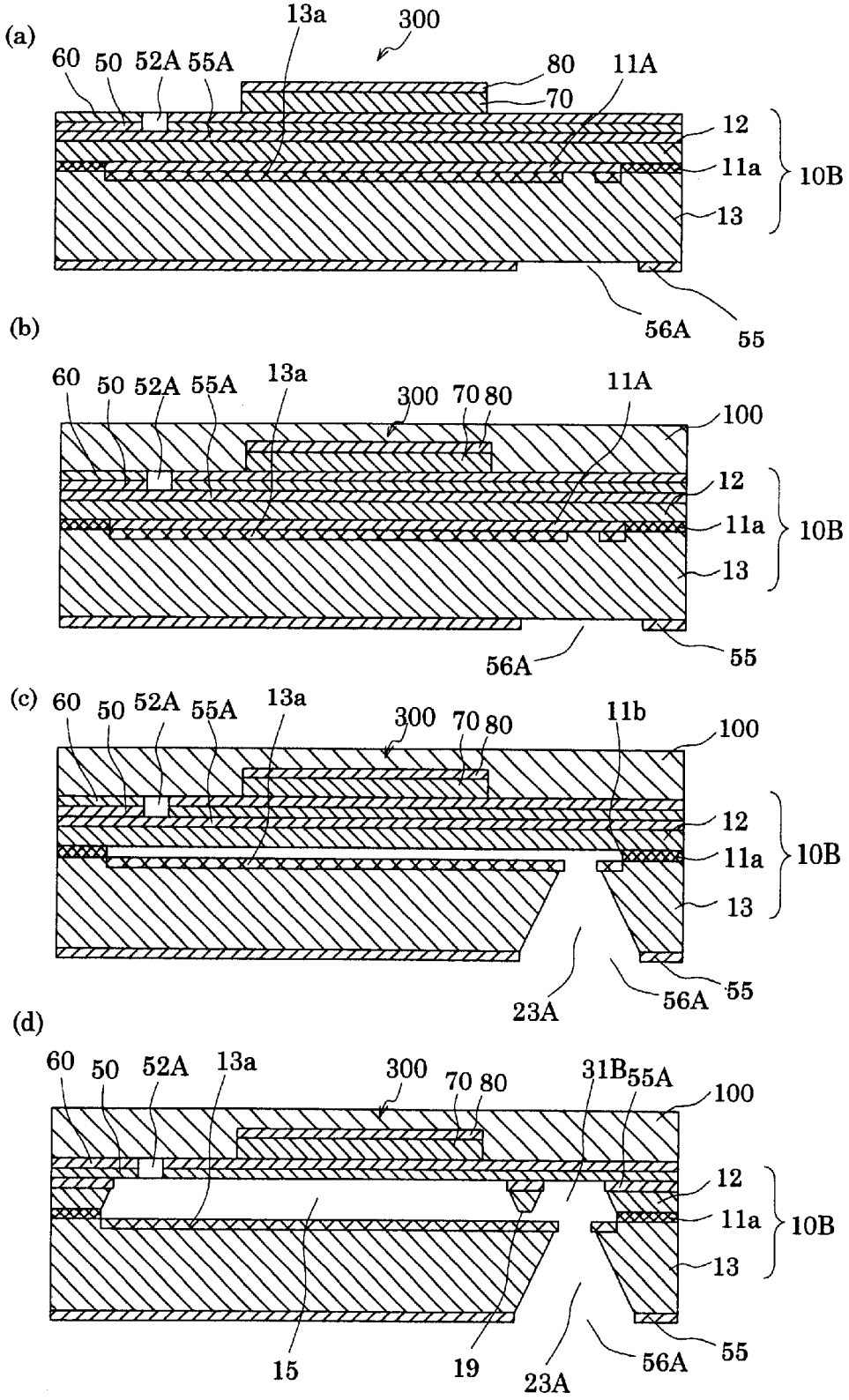
FIGS. 43(*a*) to 43(*d*) are sectional views showing the manufacturing process of the ink-jet recording head according to embodiment 7 of the present invention.

Next, as shown in FIG. 43(*a*), the elastic film 50 is formed on the protective film 55A. For example, in the present embodiment, after forming a zirconium layer on the protective film 55A, the zirconium layer is thermally oxidized in a diffusion furnace at 500 to 1200° C. to form the elastic film 50 consisting of zirconium oxide. On this elastic film 50, similarly to the above-described embodiments, the lower electrode film 60, the piezoelectric film 70 and the upper electrode film 80 are sequentially laminated and patterned, thus forming the piezoelectric element 300. In addition, the lower electrode film 60 and the elastic film 50 are simultaneously patterned to form the second through hole 52A, and the protective film 55 is patterned to form the opening potion 56A in a region corresponding to the ink introducing port 23A.

Next, as shown in FIG. 43(*b*), on the surfaces of the piezoelectric element 300 and the lower electrode film 60, the protective film 100 consisting of, for example, fluorine resin or the like is formed. Subsequently, as shown in FIG. 43(*c*), with the protective film 55 is a mask, the second silicon layer 13 is subjected to anisotropic etching, for example, wet etching by an alkaline solution such as KOH or the like, and thus the ink introducing port 23A is formed. Thereafter, the polysilicon layer 11A is patterned via this ink introducing port 23A.

Herein, the polysilicon layer 11A becomes the boron-doped polysilicon layer 11*a* having boron doped in a specified portion as described above. Only the polysilicon layer 11A is selectively removed by etching, and only the boron-doped polysilicon layer 11*a* is not removed but remains. Specifically, only a region that will be the pressure generating chamber 15, the reservoir 31B and the narrowed portion 19 is removed to form the through portion 11*b*, thus exposing the first silicon layer 12. In addition, as described above, since the polysilicon layer 11A is completely removed in etching and only the boron-doped polysilicon layer 11*a* remains, the passage-forming substrate 10B is substantially constituted of the boron-doped polysilicon layer 11*a* and the first and second silicon layers 12 and 13.

Subsequently, as shown in FIG. 43(*d*), with the boron-doped polysilicon layer 11*a* constituting the passage-forming substrate 10 as a mask, the first silicon layer 12 is subjected to anisotropic etching via the ink introducing port 23A, thus forming the pressure generating chamber 15, the reservoir 31B and the narrowed portion 19. Also simultaneously, in the present embodiment, the protective film 55A in a region which faces to the pressure generating chamber 15 and the reservoir 31B is removed by etching.

Note that, in forming the pressure generating chamber 15 and the like by etching the first silicon layer 12, the surface of the second silicon layer 13 at the first silicon layer 12 side also touches etchant. However, as described above, since the region of the second silicon layer 13, which faces the pressure generating chamber 15 and the like, becomes the boron-doped silicon layer 13*a*, it is never etched. Specifically, in the present embodiment, the surface of this boron-doped silicon layer 13*a* becomes an etching stop surface in the anisotropic etching.

Figure 44:
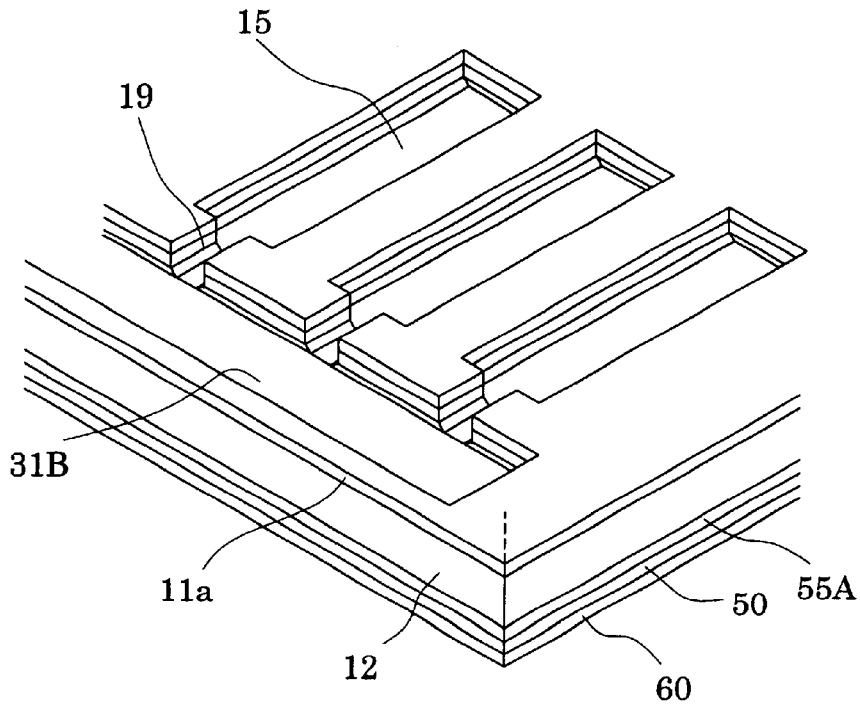
FIGS. 44(*a*) and 44(*b*) are schematic perspective views showing the manufacturing process of the ink-jet recording head according to embodiment 7 of the present invention.
Figure 44:
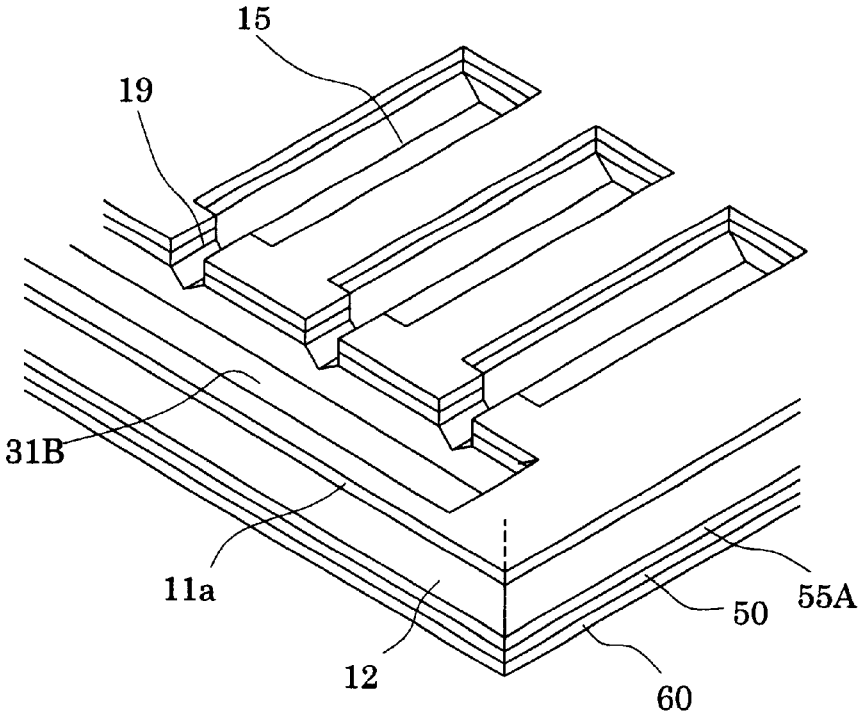

Herein, since the first silicon layer 12 of the present embodiment consists of a single crystal silicon substrate of the plane orientation (100) as described above, as shown in FIG. 44(*a*), in the case of etching the same with the boron-doped polysilicon layer 11*a* as a mask, interior surfaces defining the pressure generating chamber 15, the reservoir 31B and the narrowed portion 19 are formed of a (111) plane. Specifically, these interior surfaces are formed of slant planes having a width narrower at the elastic film 50 side. For this reason, as shown in FIG. 44(*b*), the pressure generating chamber 15 and the reservoir 31B with relatively wide widths are etched to reach the protective film 55A, and etching stops by the protective film 55A, while in the narrowed portion 19 with a width narrower than the pressure generating chamber 15, etching stops at a position where the interior surfaces thereof cross each other, and the narrowed portion 19 is formed to be shallower than the pressure generating chamber 15.

In the process as described above, the pressure generating chamber 15, the piezoelectric element 300 and the like are formed. Thereafter, the etching protective film 100 provided on the surfaces of the piezoelectric element 300 and the like is removed, and the nozzle plate 20 is joined onto the piezoelectric element 300 side of the passage-forming substrate 10B, thus constituting the ink-jet recording head (see FIGS. 41(*a*) and 41(*b*)).

In such an ink-jet recording head of the present embodiment, the ink introducing port 23A and the pressure generating chamber 15 and the like can be formed in a lump by etching, and thus a manufacturing efficiency is improved. Moreover, since the pressure generating chamber 15 and the like are formed via the ink introducing port 23A provided on the side of the passage-forming substrate 10B, which is opposite that having the piezoelectric element 300, the piezoelectric film 70 and the like can be prevented from being affected during etching.

Furthermore, in the present embodiment, since the first and second silicon layers 12 and 13 consist of single crystal silicon substrates of the plane orientation (100), (111) planes where an etching rate is relatively slow appear on the inner surface of the pressure generating chamber 15, the reservoir 31B and the narrowed portion 19. Therefore, the narrowed portion can be formed with good accuracy. Accordingly, the passage resistance of ink supplied to the pressure generating chamber 15 can be controlled with high accuracy.

Note that, in the present embodiment, each of the first and second silicon layers 12 and 13 constituting the passage-forming substrate 10B consists of a single crystal silicon substrate of the plane orientation (100), but not being limited to this, these silicon layers may be also single crystal silicon substrates of the plane orientation (100) and the plane orientation (110), or each of these silicon layers may be a single crystal silicon substrate of the plane orientation (110). As a matter of course, also with such a constitution, effects similar to the above-described constitution are obtained.

Figure 45:
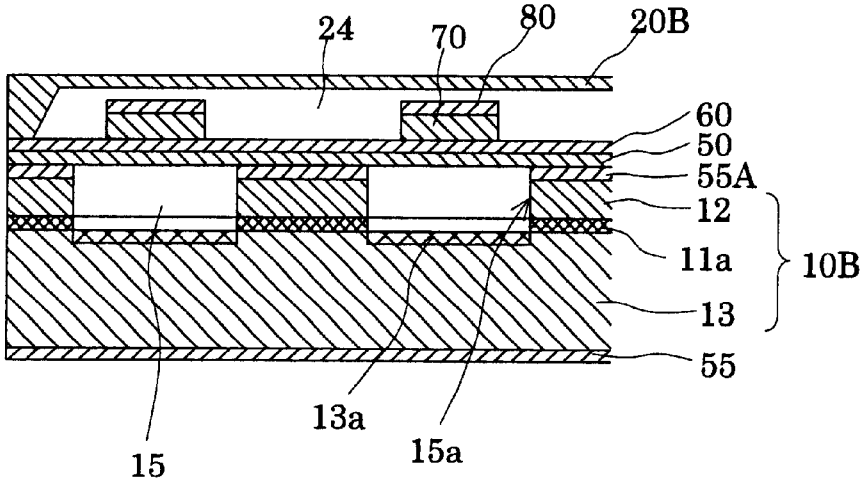
FIG. 45 is a sectional view showing another example of the ink-jet recording head according to embodiment 7 of the present invention.

Moreover, in the case where each of the first and second silicon layers 12 and 13 consists of a single crystal silicon substrate of the plane orientation (110), as shown in FIG. 45, the interior surface (15*a*) of the pressure generating chamber 15, the reservoir 31B and the narrowed portion 19 is formed of a plane approximately perpendicular to the surface of the passage-forming substrate 10B. In addition, in the case of this constitution, the passage resistance of the narrowed portion 19 can be controlled by, for example, adjusting the width of the narrowed portion 19.

(Embodiment 8)

Figure 46:
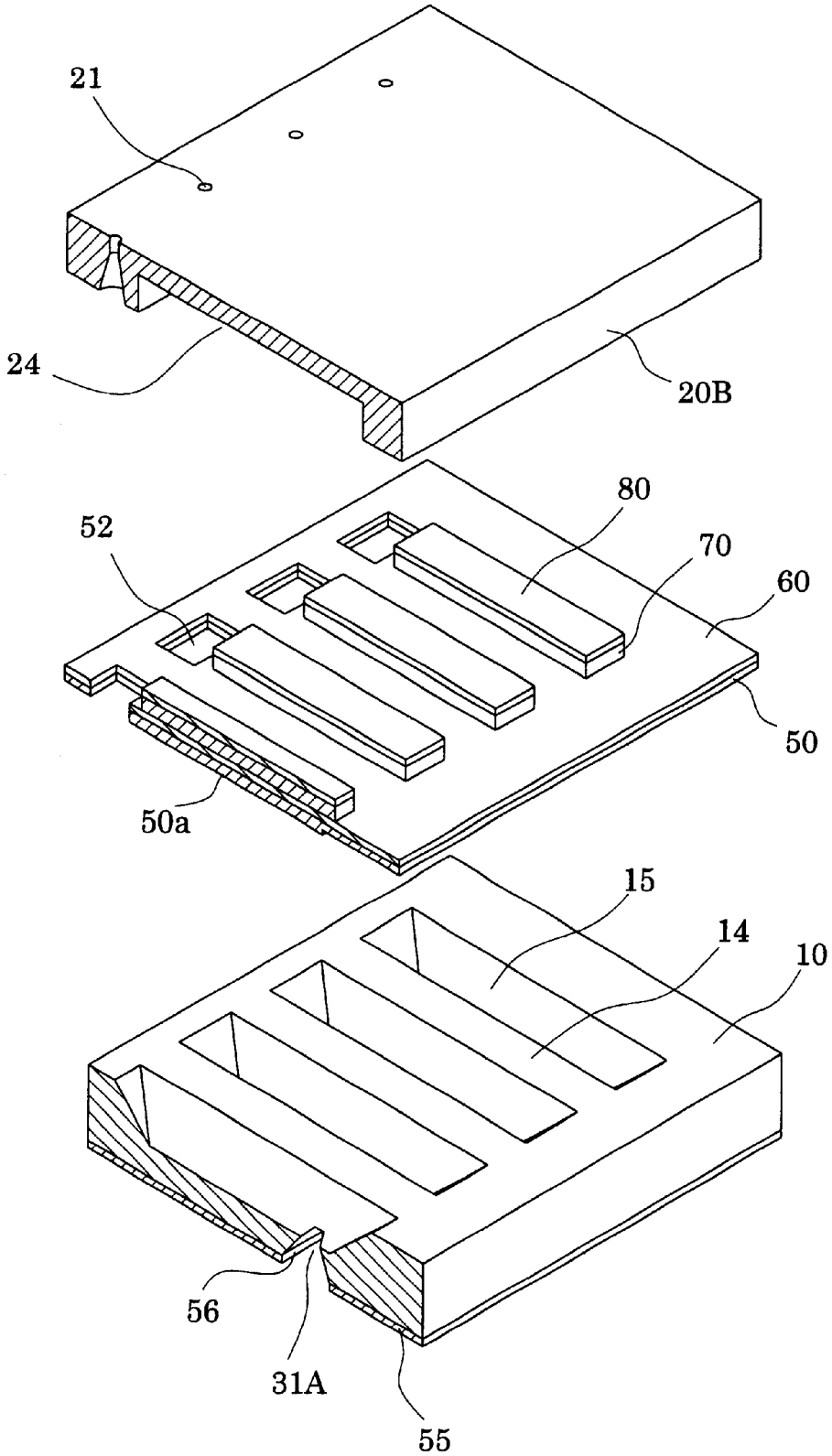
FIG. 46 is a perspective view schematically showing an ink-jet recording head according to embodiment 8 of the present invention.
Figure 47:
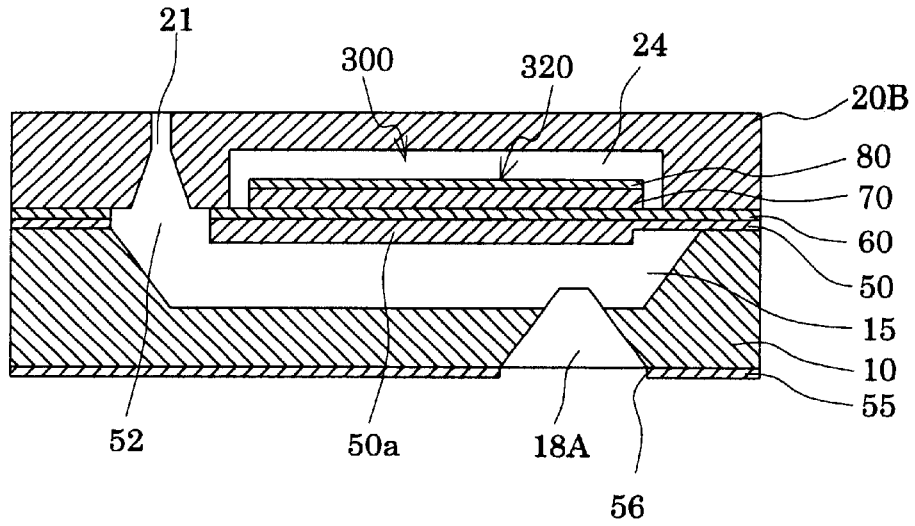
FIGS. 47(*a*) and 47(*b*) are sectional views showing the ink-jet recording head according to embodiment 8 of the present invention.
Figure 47:
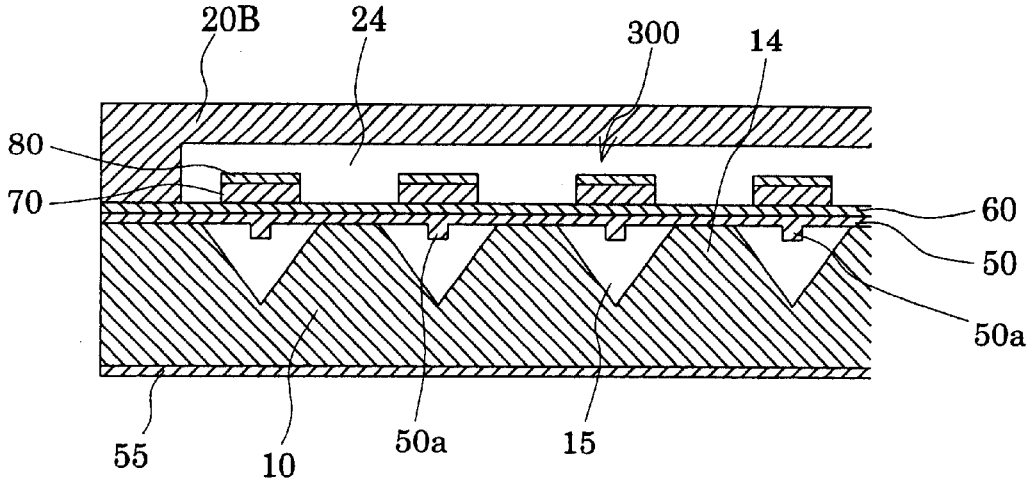

FIG. 46 is an exploded perspective view showing an ink-jet recording head according to embodiment 8, and FIGS. 47(*a*) and 47(*b*) are sectional views of FIG. 46. Note that members having functions similar to those described in the above embodiments are added with the same reference numerals and repeated description will be omitted.

The present embodiment is an example where it has a constitution similar to that of embodiment 5 except that a single crystal silicon substrate of the crystal plane orientation (100) is used as the passage-forming substrate 10, but a pressure generating chamber is formed without using a sacrificial layer. On one surface of this passage-forming substrate 10, pressure generating chambers 15 partitioned by a plurality of compartment walls 14 are parallelly provided in the width direction. In the vicinity of one end portion in the longitudinal direction of the pressure generating chamber 15, an ink communicating portion 18A communicating with a reservoir (not shown) that will be a common ink chamber of each pressure generating chamber 15 is formed by anisotropic etching from the other surface of the passage-forming substrate 10.

Note that, on the passage-forming substrate 10, a piezoelectric element 300 consisting of a lower electrode film 60, a piezoelectric film 70 and an upper electrode film 80 is formed via an elastic film 50. Moreover, in the present embodiment, the elastic film 50 is formed in such a manner that a protruding portion 50*a* protruding to the passage-forming substrate 10 side is formed in a region facing to each pressure generating chamber 15 along the longitudinal direction of the pressure generating chamber 15.

Herein, description will be made for a manufacturing process of the ink-jet recording head of the present embodiment, particularly, a process of forming the pressure generating chamber 15 on the passage-forming substrate 10, with reference to FIGS. 48(*a*) to 49(*f*).

Figure 48:
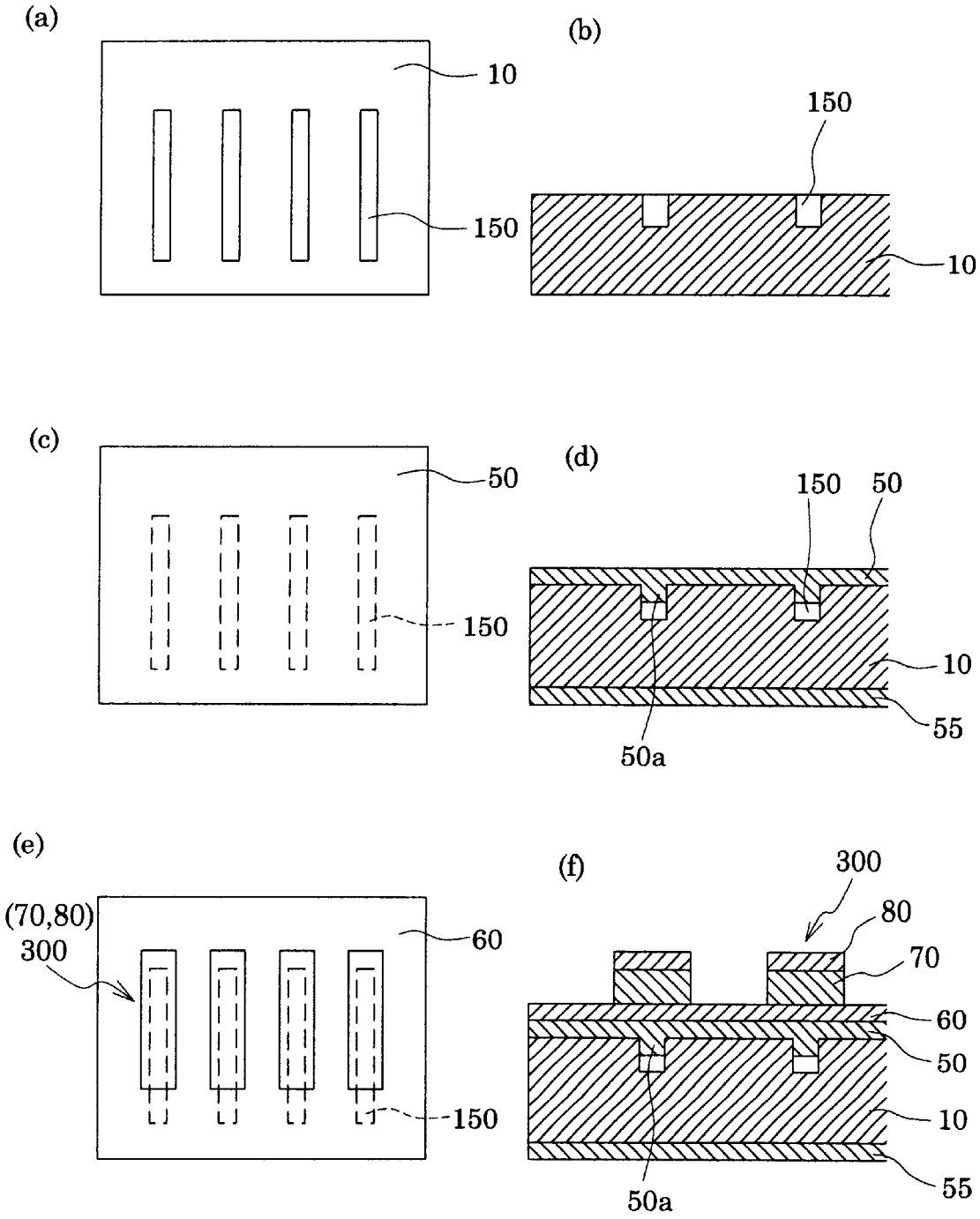
FIGS. 48(*a*) to 48(*f*) are plan views and sectional views showing a manufacturing process of the ink-jet recording head according to embodiment 8 of the present invention.

First, as shown in FIGS. 48(*a*) and 48(*b*), in a region of the passage-forming substrate 10 consisting of a single crystal silicon substrate, where each pressure generating chamber 15 is formed, an approximately rectangular groove portion 150 having a width narrower than the pressure generating chamber 15 and a depth of, for example, about 50 to 100 $\mu$m is formed. The width of this groove portion 150 is preferably about 0.1 to 3 $\mu$m, and in the present embodiment, the groove portion 150 is formed so as to have a width of about 1 $\mu$m. Note that, the formation method of this groove portion 150 is not particularly limited, and for example, the groove portion 150 may be formed by dry etching or the like.

Next, as shown in FIGS. 48(*c*) and 48(*d*), on the both surfaces of the passage-forming substrate 10, the elastic film 50 and the protective film 55 are formed, respectively.

Herein, since the elastic film 50 formed on the groove portion 150 side of the passage-forming substrate 10 is formed in such a manner that a part thereof enters the groove portion 150, the protruding portion 50*a* having approximately the same shape as that of the groove portion 150 and protruding to the passage-forming substrate 10 side is formed in a region of the elastic film 50, which is opposite to each of the pressure generating chambers 15.

Next, as shown in FIGS. 48(*e*) and 48(*f*), the lower electrode film 60, the piezoelectric film 70 and the upper electrode film 80 are sequentially laminated and patterned, thus forming the piezoelectric element 300.

Thereafter, the single crystal silicon substrate as the passage-forming substrate 10 is subjected to anisotropic etching by an alkaline solution or the like, thus forming the pressure generating chamber 15 and the like.

Figure 49:
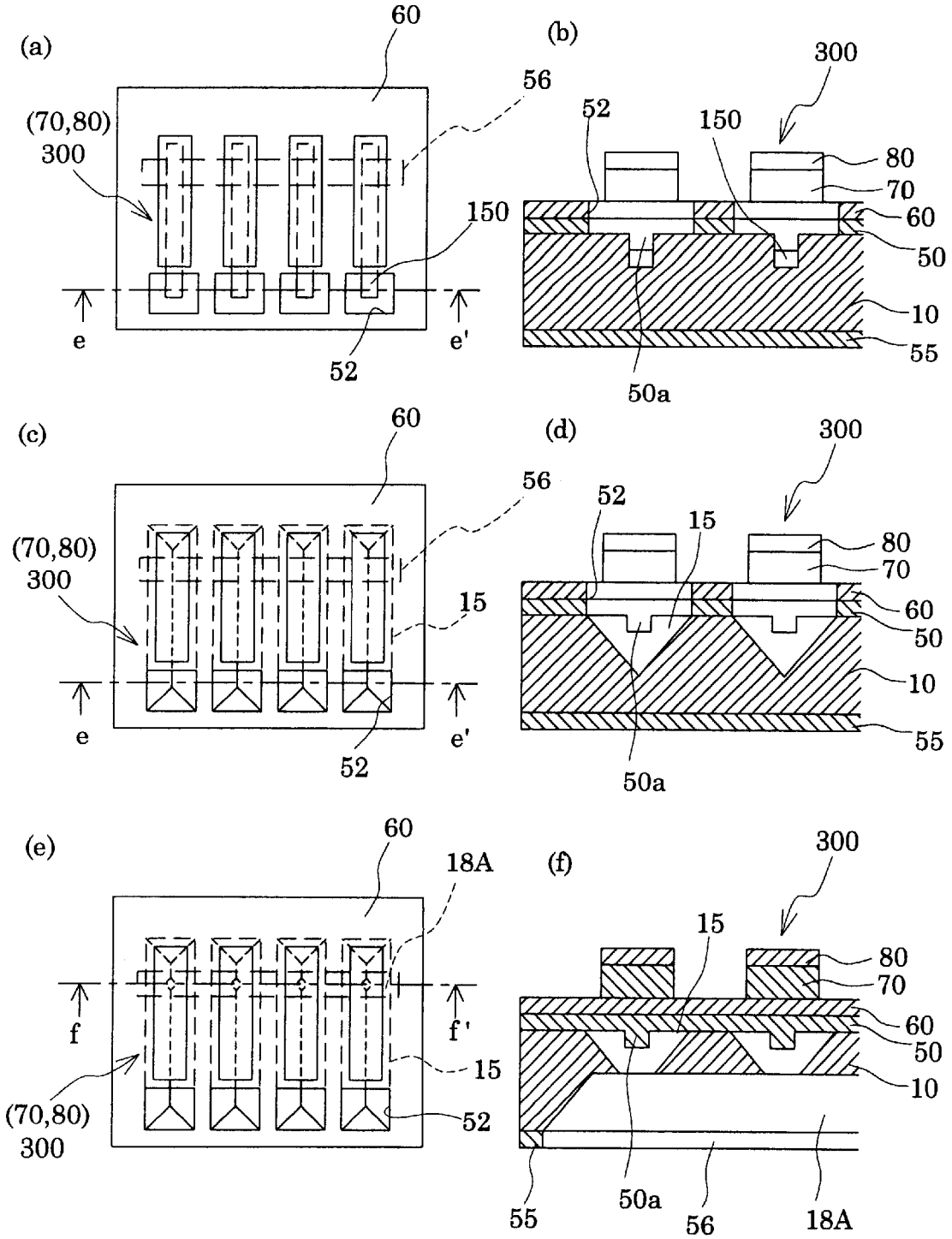
FIGS. 49(*a*) to 48(*f*) are plan views and sectional views showing the manufacturing process of the ink-jet recording head according to embodiment 8 of the present invention.

Specifically, first, as shown in FIGS. 49(*a*) and 48(*b*), which is a sectional view taken along the e–e' line of FIG. 49(*a*), the lower electrode film 60 and the elastic film 50 in a region that will be one end portion in the longitudinal direction of each pressure generating chamber 15 are removed, thus forming the second through hole 52 communicating with the nozzle orifice. Thus, the surface of the passage-forming substrate 10 and one end portion in the longitudinal direction of the groove portion 150 are exposed. In addition, simultaneously, the protective film 55 in a region where the ink communicating portion 18A is formed is removed, thus forming the opening portion 56.

Thereafter, as shown in FIGS. 49(*c*) and 49(*d*), which is a sectional view taken along the e–e' line of FIG. 49(*c*), the passage-forming substrate 10 is subjected to anisotropic etching by, for example, an alkaline solution such as KOH or the like via the second through hole 52, thus forming the pressure generating chamber 15. Herein, in anisotropic etching, the alkaline solution flows into the groove portion 150 via the second through hole 52, and the passage-forming substrate 10 is gradually eroded from this groove portion 150, thus forming the pressure generating chamber 15. Moreover, since the passage-forming substrate 10 is a single crystal silicon substrate of the crystal orientation (100), the inner surfaces of the pressure generating chamber 15 are formed of (111) planes slanting at about 54° relative to the surface of the passage-forming substrate 10. Specifically, each of these (111) planes is substantially the bottom surface of the pressure generating chamber 15 and the etching stop surface in anisotropic etching, and the pressure generating chamber 15 is formed in such a manner that a cross section thereof is approximately triangular.

As described above, the pressure generating chamber 15 is formed in such a manner that a cross section thereof is approximately triangular, and thus the strength of the compartment wall 14 between the pressure generating chambers 15 is significantly increased. Accordingly, even if the pressure generating chambers 15 are arranged in a high density, cross talk does not occur, and the ink ejection features can be favorably maintained.

Moreover, since the pressure generating chamber 15 can be formed without penetrating the passage-forming substrate 10 by etching, a thickness of the passage-forming substrate 10 is set at about 220 $\mu$m in the present embodiment, but the thickness may be thicker than 220 $\mu$m. Accordingly, even if a wafer forming the passage-forming substrate 10 is set to have a relatively large diameter, handling thereof can be facilitated, and cost reduction can be achieved.

Note that, since the groove portion 150 of the passage-forming substrate 10 is for forming the pressure generating chamber by anisotropic etching as described above, a depth thereof is preferably set slightly shallower than the depth of the pressure generating chamber 15.

Figure 50:
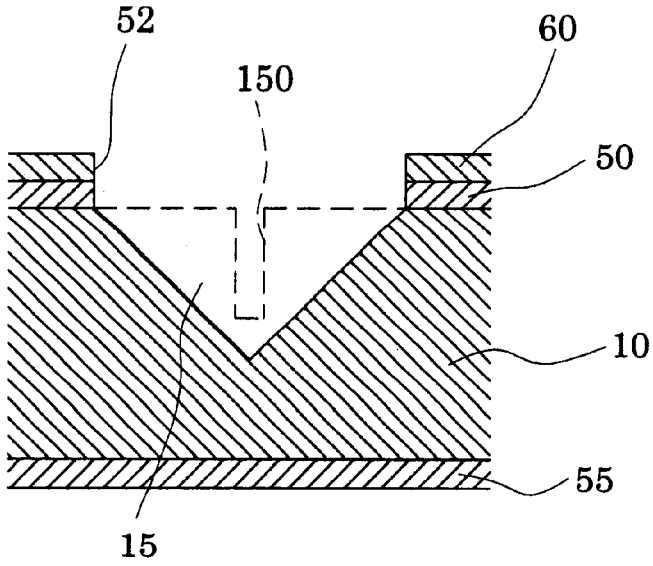
FIGS. 50(*a*) and 50(*b*) are schematic sectional views explaining the manufacturing process of the ink-jet recording head according to embodiment 8 of the present invention.
Figure 50:
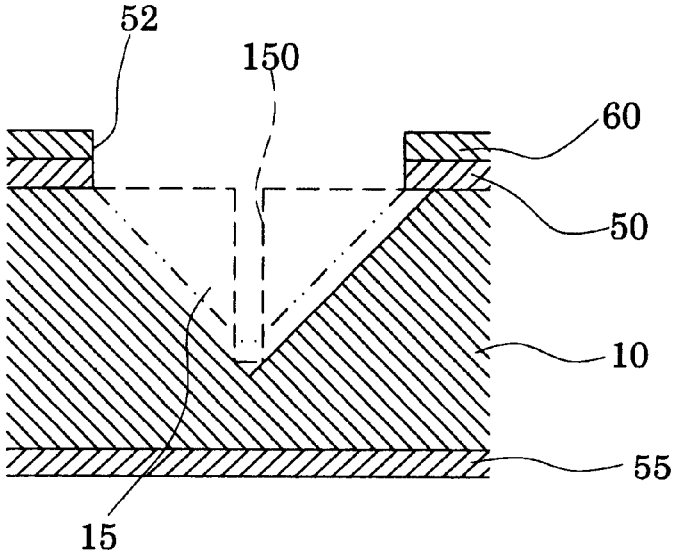

Specifically, in the present embodiment, the size of the pressure generating chamber 15 is controlled by the size of the second through hole 52. For this reason, if the depth of the groove portion 150 is set slightly shallower than the depth of the pressure generating chamber 15, the etching for the passage-forming substrate 10 stops securely with the width of the second through hole 52 is shown in FIG. 50(*a*), and thus the size of the pressure generating chamber 15 can be readily controlled. On the other hand, if the depth of the groove portion 150 is set deeper than the depth of the pressure generating chamber 15, as shown in FIG. 50(*b*), the etching for the passage-forming substrate 10 advances to the bottom portion of the groove portion 150. Accordingly, the width of the opening portion of the pressure generating chamber 15 becomes larger than the width of the second through hole 52 without stopping thereto, and thus it will be difficult to control the size of the pressure generating chamber 15.

Moreover, after forming the pressure generating chamber 15 as described above, as shown in FIGS. 49(*e*) and 49(*f*), which is a sectional view taken along the f–f' line of FIG. 49(*e*), etching is performed with the protective film 55 is a mask from the surface opposite to that having the piezoelectric element 300 of the passage-forming substrate 10. Specifically, the passage-forming substrate 10 is subjected to anisotropic etching via the opening portion 56, thus forming the ink communicating portion 18A communicating with the pressure generating chamber 15.

Note that, on the elastic film 50 side of the passage-forming substrate 10, where the pressure generating chamber 15 and the like are formed in the process as described above, further, as shown in FIGS. 46 and 47(*b*), the nozzle plate 20B having the nozzle orifices 21 drilled therein is fixedly adhered similarly to the above-described embodiments.

Figure 51:
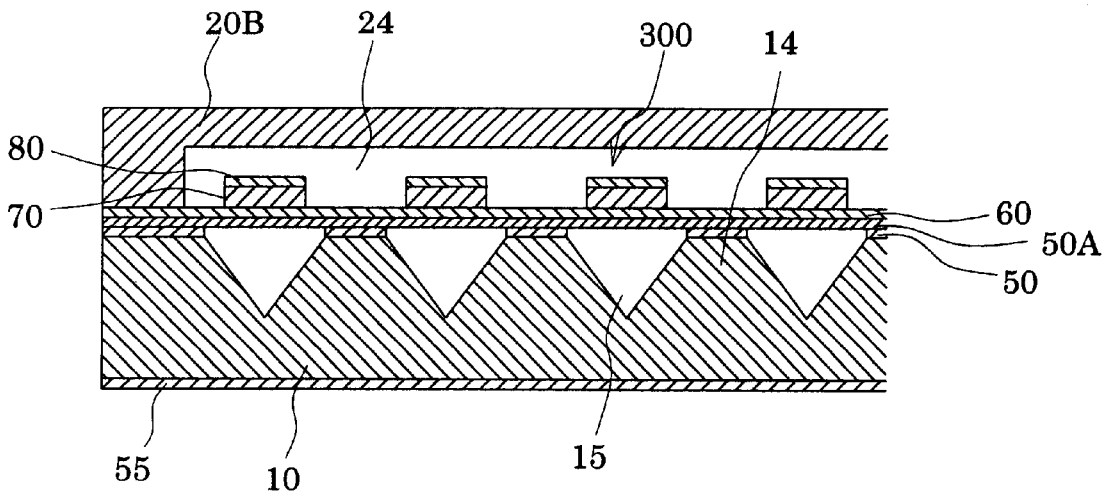
FIG. 51 is a sectional view showing another example of the ink-jet recording head according to embodiment 8 of the present invention.

Moreover, in the present embodiment, the protruding portion 50*a* is formed in a portion of the elastic film 50, which corresponds to each pressure generating chamber 15. This protruding portion 50*a* may be removed at the same time that the pressure generating chamber 15 is etched. Furthermore, for example, as shown in FIG. 51, a constitution may be also adopted, in which a second elastic film 50A consisting of zirconium oxide or the like is previously provided on the elastic film 50, and in forming the pressure generating chamber 15 by anisotropic etching, the elastic film 50 in the region facing to the pressure generating chamber 15 is completely removed.

(Embodiment 9)

Figure 52:
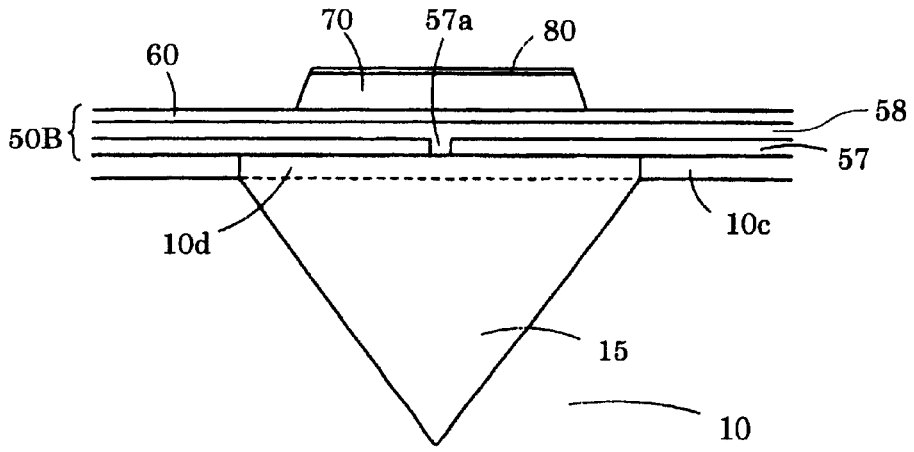
FIGS. 52(*a*) and 52(*b*) are sectional views showing an ink-jet recording head according to embodiment 9 of the present invention.
Figure 52:
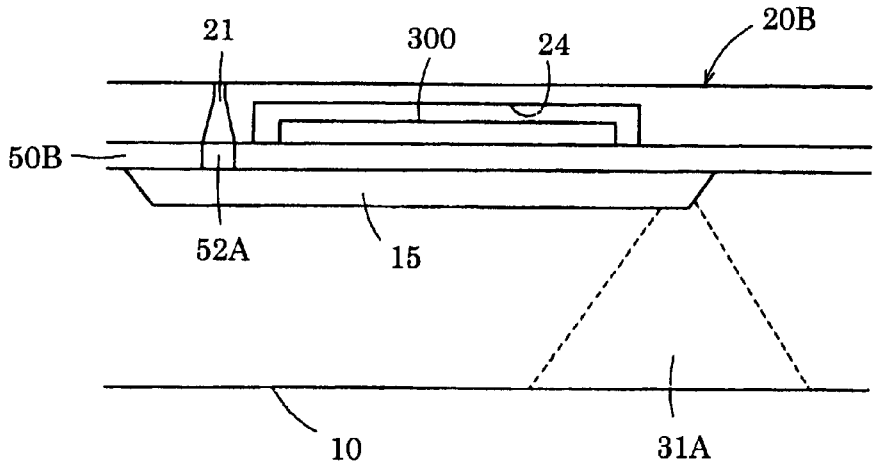

FIGS. 52(*a*) and 52(*b*) are enlargements of longitudinal and cross sectional views showing one pressure generating chamber of an ink-jet recording head according to the present embodiment and the periphery thereof.

The present embodiment is another example where a single crystal silicon substrate of the crystal plane orientation (100) is used as a passage-forming substrate 10 to form the pressure generating chamber without using a sacrificial layer. As shown in FIGS. 52(*a*) and 52(*b*), on a surface of the passage-forming substrate 10 excluding a forming region of a pressure generating chamber 15, a polycrystal silicon film 10*c* having boron doped therein is formed. Note that, an upper space 10*d* of the pressure generating chamber 15 is a hole portion formed by removing a polycrystal silicon film not having boron doped therein by isotropic etching. On an upper surface of the polycrystal silicon film 10*c* and on the pressure generating chamber 15, an approximately tabular-shaped elastic film 50B is formed so as to cover the pressure generating chamber 15. Inner wall surfaces of the pressure generating chamber 15 are formed of a (111) plane of a single crystal silicon substrate exposed by anisotropic wet etching and an inner surface of a vibration plate.

Note that, in the present embodiment, the elastic film 50B consists of a silicon nitride film (first film) 57 and a zirconium oxide film (second film) 58 laminated on this silicon nitride film 57. In addition, in the silicon nitride film 57, an etching hole 57*a* is formed for supplying an etching liquid onto the surface of the passage-forming substrate in forming the pressure generating chamber 15. This etching hole 57*a* is closed by the zirconium oxide film 58.

Note that the first film consisting of the silicon nitride film 57 *c* an also consist of a silicon oxide film or a zirconium oxide film instead of the silicon nitride film. In addition, the second film consisting of the zirconium oxide film 58 can also consist of a silicon oxide film or a silicon nitride film instead of the zirconium oxide film. Alternatively, the second film can consist of a film obtained by laminating any of a silicon oxide film, a silicon nitride film and a zirconium oxide film.

Herein, description will be made for a manufacturing method of the ink-jet recording head according to the present embodiment with reference to the drawings.

Figure 53:
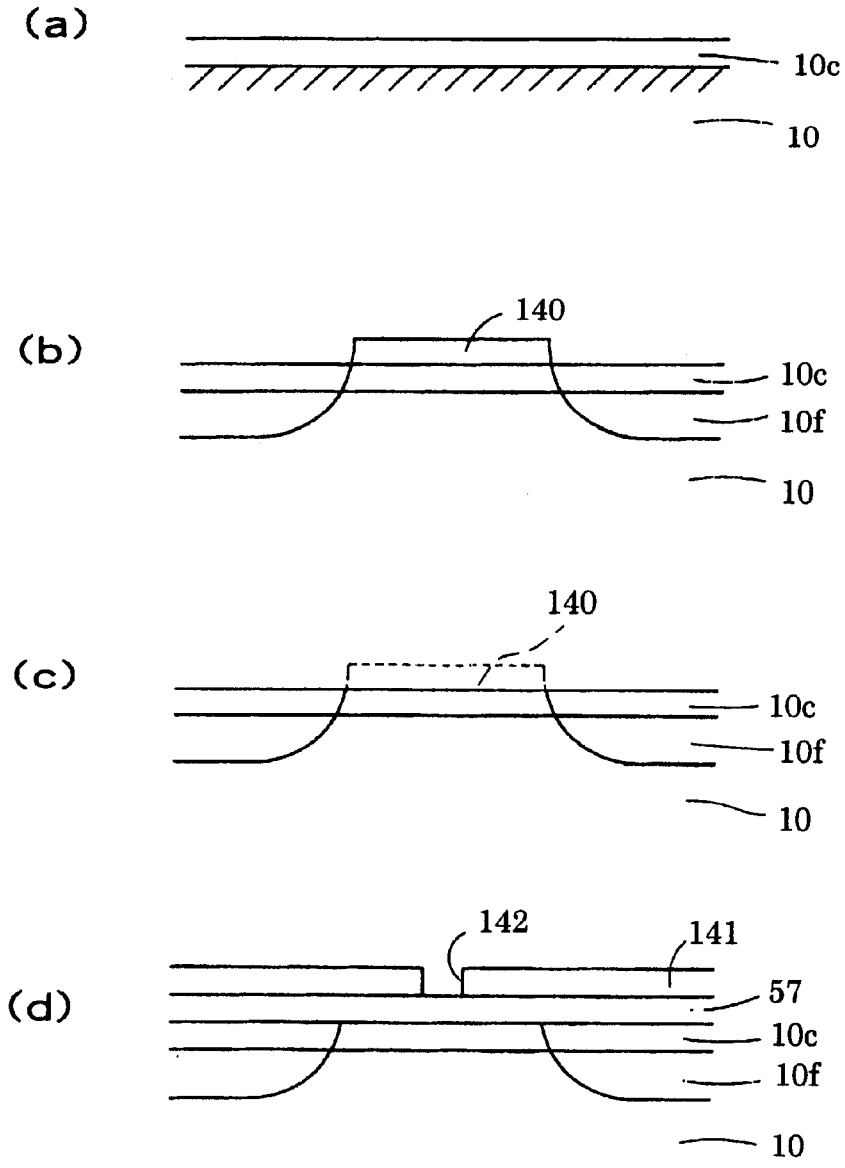
FIGS. 53(*a*) to 53(*d*) are sectional views showing a manufacturing process of the ink-jet recording head according to embodiment 9 of the present invention.

First, as shown in FIG. 53(*a*), on the surface of the passage-forming substrate 10 of the (100) plane orientation, the polycrystal silicon film 10*c* is formed. Next, as shown in FIG. 53(*b*), a silicon oxide ($SiO_2$) film 140 is formed on a region that will be the pressure generating chamber 15. With this silicon oxide film 140 as a mask, highly concentrated boron is diffused in the vicinity of the inner surfaces of the polycrystal silicon film 10*c* and the passage-forming substrate 10 excluding the region that will be the pressure generating chamber 15, thus forming a boron-diffused region 10*f*. After the step of diffusing boron, as shown in FIG. 53(*c*), the silicon oxide film 140 is removed.

Figure 54:
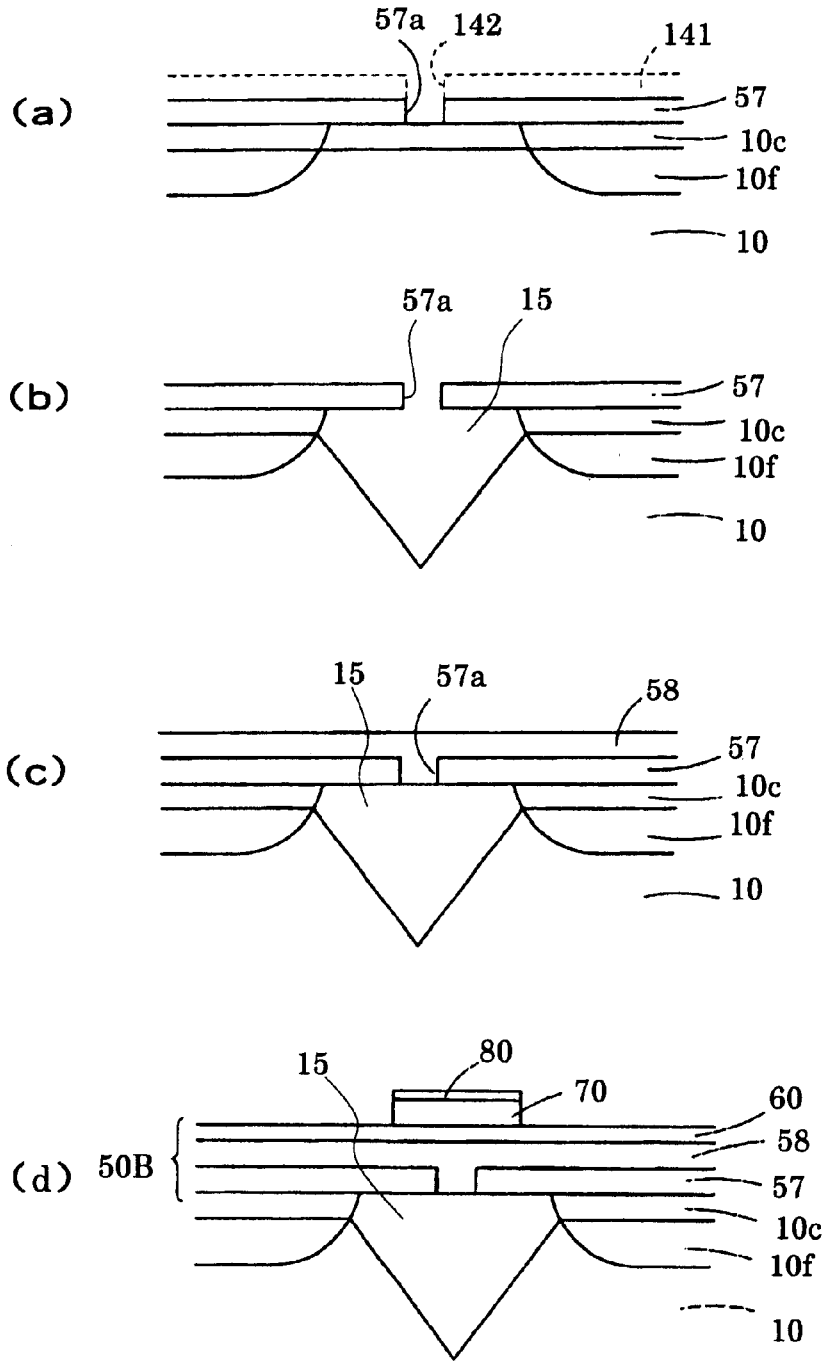
FIGS. 54(*a*) to 54(*d*) are sectional views showing the manufacturing process of the ink-jet recording head according to embodiment 9 of the present invention.

Next, as shown in FIG. 53(*d*), on the polycrystal silicon film 10*c*, the silicon nitride film (first film) 57 excellent in etching resistance is formed, and further, on the silicon nitride film 57, a resist film 141 is formed. In the resist film 141, a hole 142 is formed at a position corresponding to the etching hole 57*a*. As shown in FIG. 54(*a*), the etching hole 57*a* is formed in the silicon nitride film 57 by etching using the hole 142 of this resist film 141.

Next, via the etching hole 57*a*, an etching liquid (for example, KOH) is supplied to a portion where the pressure generating chamber 15 is formed. Then, as shown in FIG. 54(*b*), an undoped portion of the entire polycrystal silicon film 10*c*, which does not have boron doped therein, is etched by isotropic wet etching in order to be removed. Subsequently, with a pattern of the polycrystal silicon film 10*c* in the removed undoped portion, the surface of the passage-forming substrate 10 is etched by anisotropic wet etching, thus forming the pressure generating chamber 15.

Next, as shown in FIG. 54(*c*), the zirconium oxide film (second film) 58 is formed on the silicon nitride film 57, thus closing the etching hole 57*a*. Note that, as a forming method of the second film, thermal oxidation, chemical vapor deposition (CVD), sputtering and the like can be used. Next, as shown in FIG. 54(*d*), on the zirconium oxide film 58, a lower electrode film 60, a piezoelectric film 70 and an upper electrode film 80 are deposited and patterned, thus forming a piezoelectric element 300 similarly to the above-described embodiments.

Figure 55:
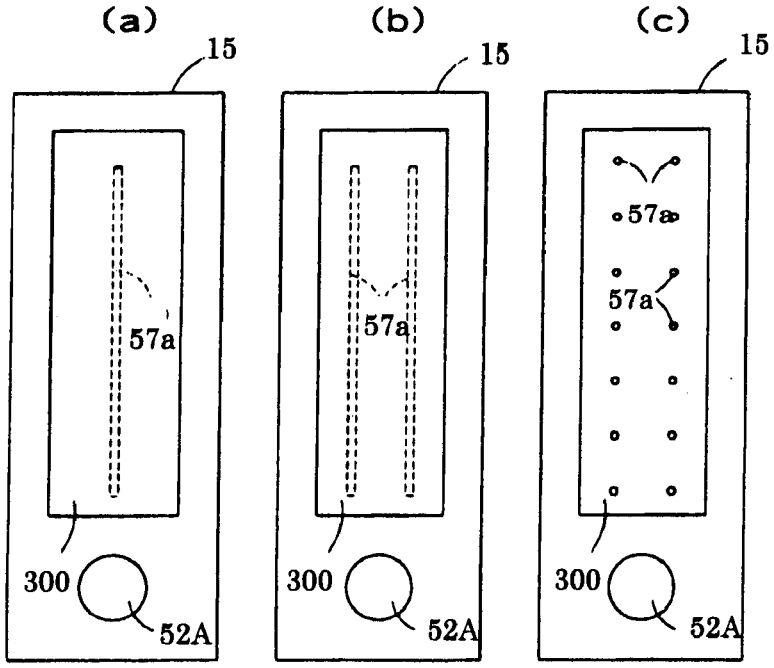
FIGS. 55(*a*) to 55(*c*) are top plan views showing other examples of the ink-jet recording head according to embodiment 9 of the present invention.

Note that, as shown in FIG. 55(*a*), the etching hole 57*a* can be also made as a slit formed along the longitudinal direction of the pressure generating chamber 15 at the center of the width direction thereof. Alternatively, as shown in FIG. 55(*b*), a plurality of parallel slits can be formed along the longitudinal direction of the pressure generating chamber 15. A forming position of the slit may be either the inside or outside of a region where the piezoelectric film 70 is projected. In addition, as shown in FIG. 55(*c*), the etching holes 57*a* can be also formed as a plurality of pores formed in the forming region of the pressure generating chamber 15. Sizes and shapes of the slits and the pores constituting the etching holes 57*a* are set so as to be buried by the second film consisting of the zirconium oxide film 58.

As described above, according to the present embodiment, the pressure generating chamber 15 is formed by anisotropic etching for the surface of the passage-forming substrate 10 consisting of a single crystal silicon substrate of the (100) plane orientation. Accordingly, it is possible to secure the thickness of the compartment walls among the pressure generating chambers 15 sufficiently, and even in the case where the thickness of the passage-forming substrate 10 is increased, the rigidity of the compartment walls can be maintained sufficiently high, thus enabling nozzles to be arrayed in high density. Moreover, the pressure generating chamber can be formed by a simple process with high accuracy.

Furthermore, since the piezoelectric film 70 is not yet formed in forming the pressure generating chamber 15 by wet etching, it is not necessary to protect the piezoelectric film 70 from an etching liquid.

(Embodiment 10)

The ink-jet recording head of embodiment 10 is one obtained by partially modifying the constitution of embodiment 9. Hereinbelow, description will be made for portions different from those of embodiment 9. Note that, FIG. 56 is an enlarged longitudinal sectional view showing one pressure generating chamber of the ink-jet recording head according to embodiment 10 and a periphery thereof.

Figure 56:
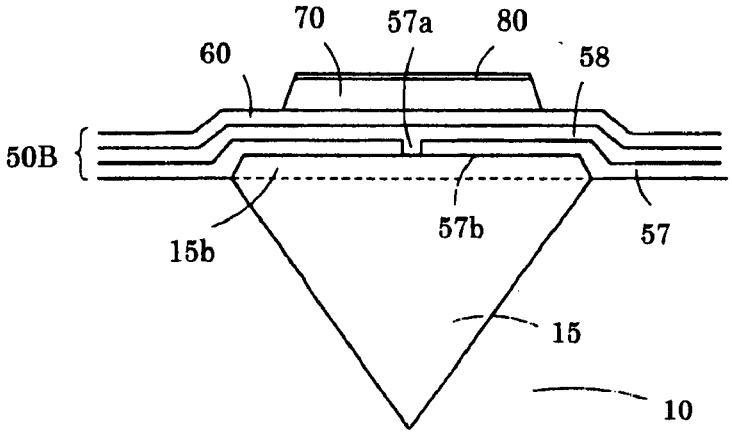
FIG. 56 is a sectional view showing an ink-jet recording head according to embodiment 10 of the present invention.

As shown in FIG. 56, in the ink-jet recording head of the present embodiment, an interior surface of a vibration plate forming a portion of an inner wall surface of the pressure generating chamber 15 constitutes a convex shape toward the direction of the piezoelectric film 70. The vibration plate constitutes a convex shape toward the direction of the piezoelectric film 70, corresponding to the convex shape of the inner surface of the vibration plate. A space portion 15*b* formed of this convex-shaped inner surface 57*b* is formed by injecting an etching liquid from the etching hole 57*a* to perform wet etching for a polycrystal silicon film.

Moreover, the ink-jet recording head according to the present embodiment does not comprise a portion corresponding to the polycrystal silicon film 10*a* having boron doped therein in embodiment 9. This is because the foregoing space portion 15*b* determines an etching shape of the pressure generating chamber 15.

Next, description will be made for a manufacturing method of the ink-jet recording head according to the present embodiment with reference to the drawings.

Figure 57:
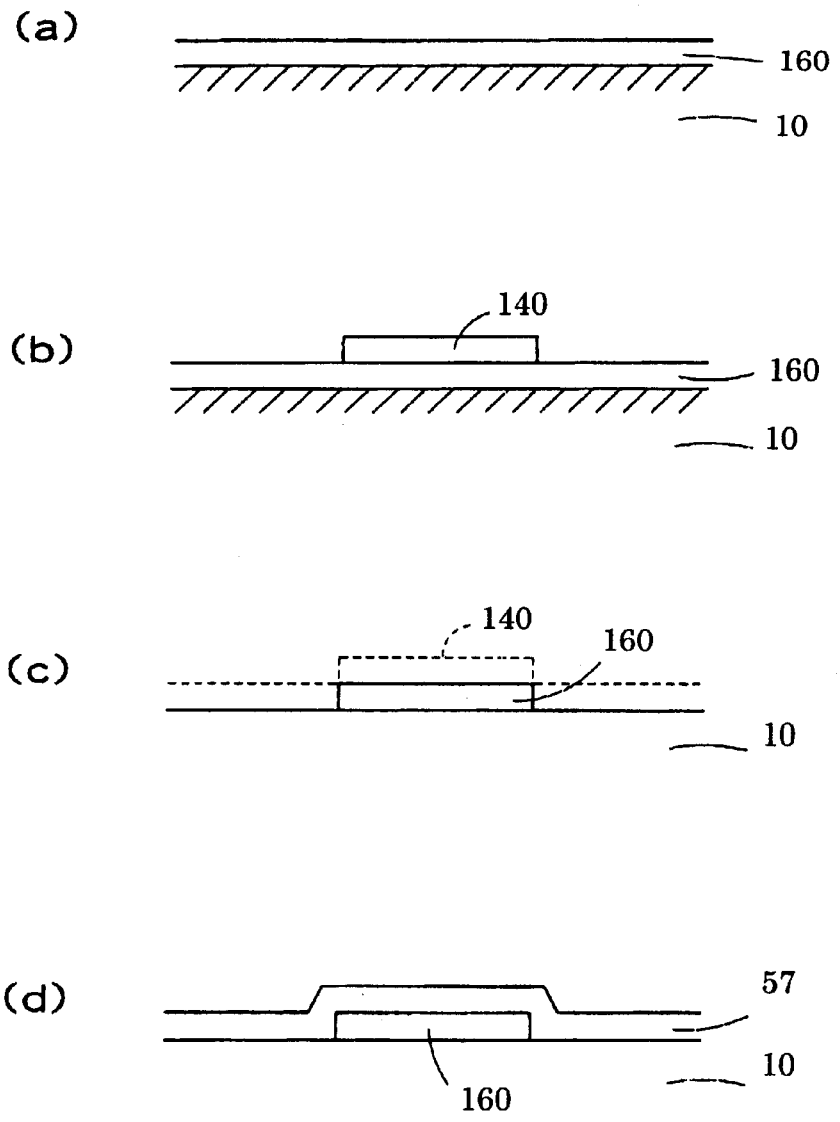
FIGS. 57(*a*) to 57(*d*) are sectional views showing a manufacturing process of the ink-jet recording head according to embodiment 10 of the present invention.

First, as shown in FIG. 57(*a*), a polycrystal silicon film 160 is formed on the surface of the passage-forming substrate 10 of (100) plane orientation. Next, as shown in FIG. 57(*b*), a silicon oxide ($SiO_2$) film 140 is formed on a region that will be the pressure generating chamber 15, and the polycrystal silicon film 160 is removed by etching with this silicon oxide film 140 as a mask, thus forming the polycrystal silicon film 160 of a specified pattern as shown in FIG. 57(*c*).

Figure 58:
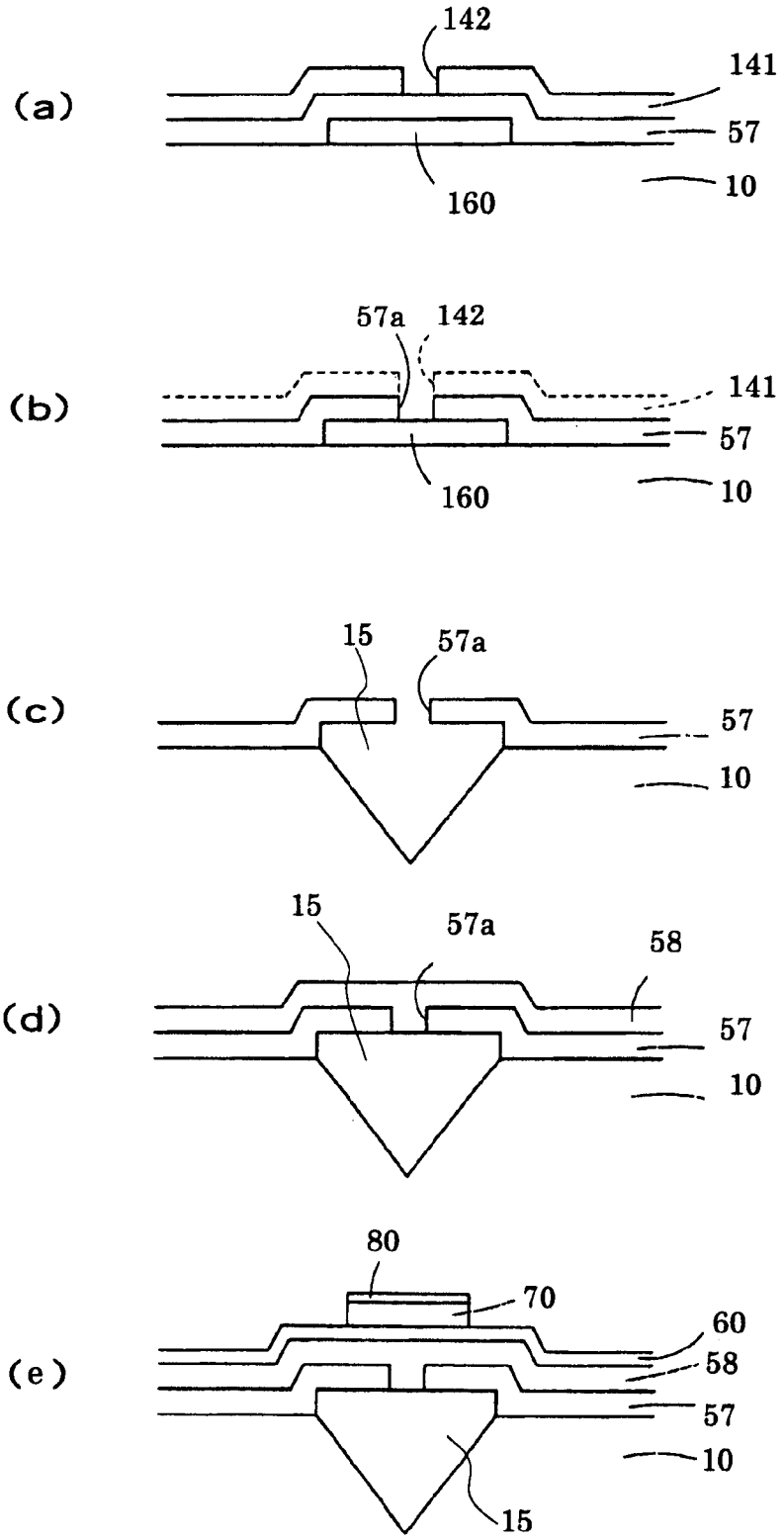
FIGS. 58(*a*) to 58(*e*) are sectional views showing the manufacturing process of the ink-jet recording head according to embodiment 10 of the present invention.

Next, on the polycrystal silicon film 160 of the specified pattern and on the surface of the passage-forming substrate 10, a silicon nitride film (first film) 57 excellent in etching resistance is formed, and further, on the silicon nitride film 57 *a* resist film 141 is formed. In the resist film 141, a hole 142 is formed at a position corresponding to the etching hole 57*a*. As shown in FIG. 58(*b*), the etching hole 57*a* is formed in the silicon nitride film 57 by etching using this hole 142 of the resist film 141.

Next, via the etching hole 57*a*, an etching liquid (for example, KOH) is supplied to a portion where the pressure generating chamber 15 is formed. Then, as shown in FIG. 58(*c*), first, the polycrystal silicon film is removed by isotropic wet etching. Subsequently, with the pattern of the removed polycrystal silicon film 160, the surface of the passage-forming substrate 10 is etched by anisotropic wet etching, thus forming the pressure generating chamber 15.

Next, as shown in FIG. 58(*d*), a zirconium oxide film (second film) 58 is formed on the silicon nitride film 57, thus closing the etching hole 57*a*. Note that, as a forming method of the second film, thermal oxidation, chemical vapor deposition (CVD), sputtering and the like can be used. Next, as shown in FIG. 58(*d*), a lower electrode film 60, a piezoelectric film 70 and an upper electrode film 80 are sequentially deposited and patterned on a zirconium oxide film 58, thus forming a piezoelectric element 300 similarly to the above-described embodiments.

As described above, according to the present embodiment, the pressure generating chamber 15 is formed by anisotropic etching for the surface of the passage-forming substrate 10 of (100) plane orientation. Accordingly, it is possible to secure the thickness of the compartment walls among the pressure generating chambers 15 sufficiently, and even in the case where the thickness of the passage-forming substrate 10 is increased, the rigidity of the compartment walls can be maintained to be sufficiently high, thus enabling nozzles to be arrayed with a high density. Moreover, the pressure generating chamber can be formed by a simple process with high accuracy.

Furthermore, since the piezoelectric film 70 is not yet formed in forming the pressure generating chamber 15 by wet etching, it is not necessary to protect the piezoelectric film 70 from an etching liquid.

Still further, in the present embodiment, the pressure generating chamber 15 is formed by wet etching using a space of a specified pattern, which is formed by removing the polycrystal silicon film formed in a specified pattern. Accordingly, the doping step of boron, which has been required in the manufacturing process of the pressure generating chamber 15 (FIG. 53(*b*)) in the above-described embodiment 9, can be omitted.

(Embodiment 11)

An ink-jet recording head of embodiment 11 is the one obtained by modifying partially the constitution of embodiment 9. Hereinbelow, description will be made for portions different from those of embodiment 9. Note that FIG. 59 is a longitudinal sectional view showing enlargedly one pressure generating chamber of the ink-jet recording head according to embodiment 11 and a periphery thereof.

Figure 59:
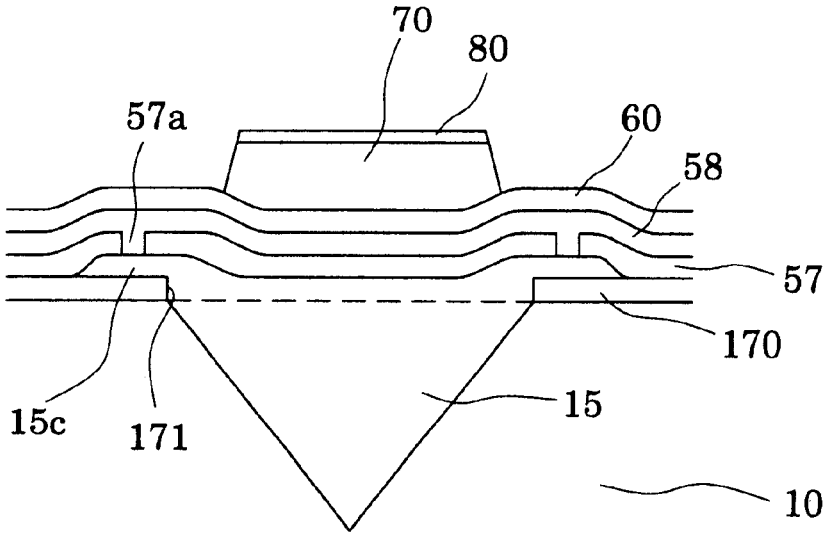
FIG. 59 is a sectional view showing an ink-jet recording head according to embodiment 11 of the present invention.

As shown in FIG. 59, in the ink-jet recording head of the present embodiment, a protective layer 170, which consists of, for example, silicon nitride, and has an opening portion 171 in a region facing the pressure generating chamber 15, is provided on a surface of the passage-forming substrate 10.

Moreover, an etching hole 57*a* is provided in a region of a first film 57, which faces a peripheral portion of the pressure generating chamber 15, and in a peripheral portion of the opening portion side of the pressure generating chamber 15, a space portion 15*c* communicating with the etching hole 57*a* is defined between the protective layer 170 and the first film 57. Except the above, the present embodiment is similar to embodiment 9.

Note that this space portion 15*c*, which will be described later in detail, is formed by injecting an etching liquid from the etching hole 57*a* to remove a sacrificial layer by means of wet etching.

Hereinbelow, description will be made for a manufacturing method of an ink-jet recording head according to the present embodiment with reference to the drawings.

Figure 60:
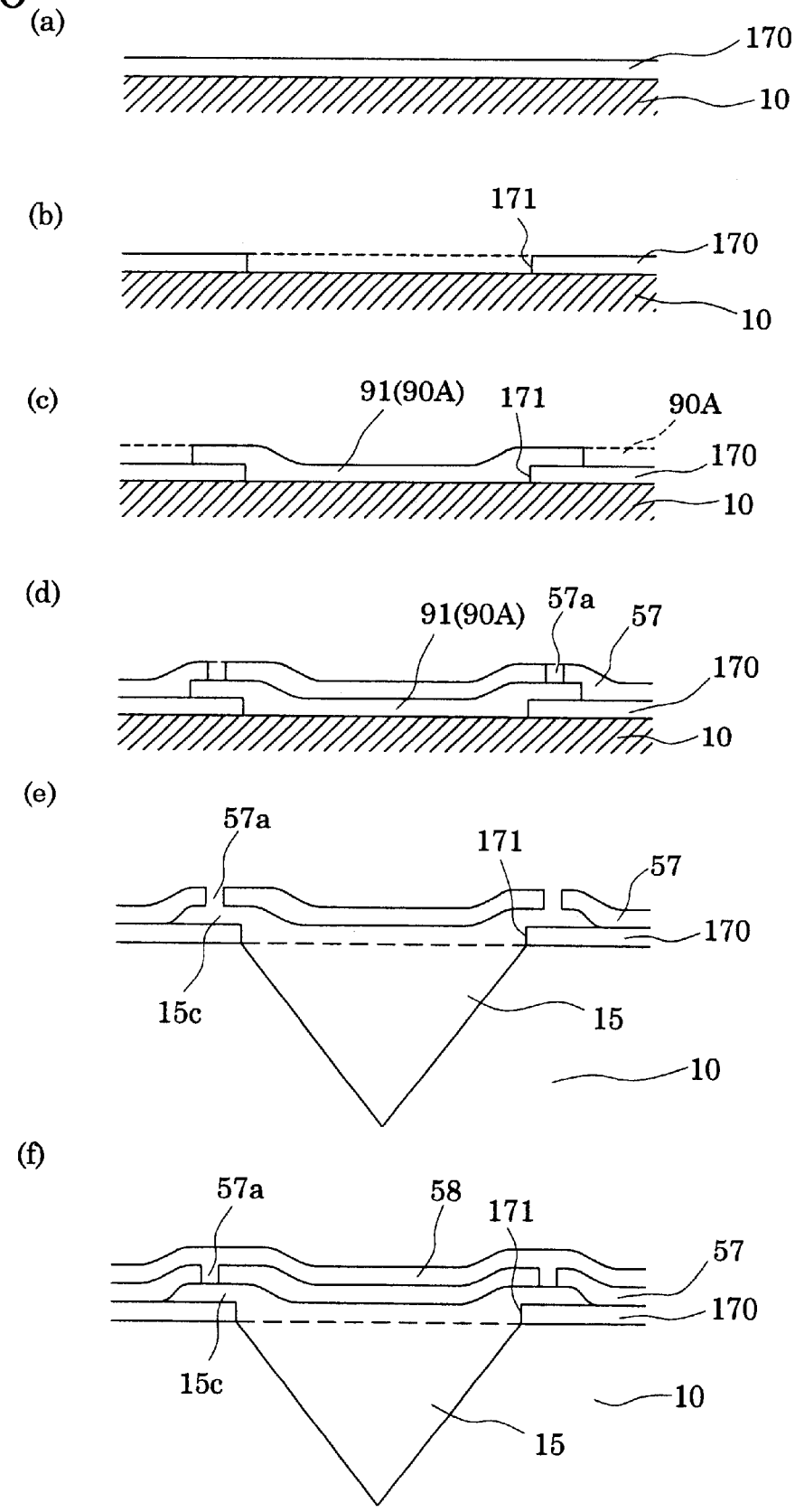
FIGS. 60(*a*) to 60(*f*) are sectional views showing a manufacturing process of the ink-jet recording head according to embodiment 11 of the present invention.

First, as shown in FIG. 60(*a*), the protective layer 170 is formed on a surface of the passage-forming substrate 10 of (100) plane orientation. Next, as shown in FIG. 60(*b*), a region of the protective layer 170, which will be the pressure generating chamber 15, is etched, for example, by use of a specified mask pattern to be removed, thus forming the opening portion 171.

Next, as shown in FIG. 60(*c*), on the protective layer 170, for example, a sacrificial layer 90A consisting of polysilicon is formed and etched, for example, by use of a specified mask pattern or the like, thus leaving the region of the protective layer 170, which covers the opening portion 171, as a remaining portion 91. Note that, in the present embodiment, the region other than the remaining portion 91 is completely removed.

Next, as shown in FIG. 60(*d*), on the remaining portion 91 of this sacrificial layer 90A and on the surface of the passage-forming substrate 10, the silicon nitride film (first film) 57 excellent in etching resistance is formed. On this silicon nitride film 57, similarly to the above-described embodiments, the etching hole 57*a* is formed by use of a resist film or the like. Concretely, the etching hole 57*a* is formed in a region of the silicon nitride film 57, which corresponds to an outside portion of the region that will be the pressure generating chamber 15.

Next, via the etching hole 57*a*, an etching liquid (for example, KOH) is supplied to a portion where the pressure generating chamber 15 is formed. Then, as shown in FIG. 60(*e*) , first, the remaining portion 91 of the sacrificial layer 90A is removed by isotropic etching to form the space portion 15*c*, thus exposing the opening portion 171 of the protective layer 170. Subsequently, via this opening portion 171, the surface of the passage-forming substrate 10 is etched by anisotropic wet etching, thus forming the pressure generating chamber 15.

Next, as shown in FIG. 60(*f*), a zirconium oxide film (second film) 58 is formed on the silicon nitride film 57, thus closing the etching hole 57*a*. Note that, as a forming method for the second film, thermal oxidation, chemical vapor deposition (CVD), sputtering or the like can be used.

Note that, thereafter, similarly to the above-described embodiments, a lower electrode film 60, a piezoelectric film 70 and an upper electrode film 80 are sequentially deposited and patterned on a zirconium oxide film 58, thus forming a piezoelectric element 300.

Also with the present embodiment thus constituted, similarly to the above-described embodiments, it is possible to secure the thickness of the compartment walls among the pressure generating chambers 15 sufficiently, and even in the case where the thickness of the passage-forming substrate 10 is increased, the rigidity of the compartment wall can be maintained sufficiently high, thus enabling nozzles to be arrayed in a high density. Moreover, the pressure generating chamber can be formed with good accuracy by a simple process.

Figure 61:
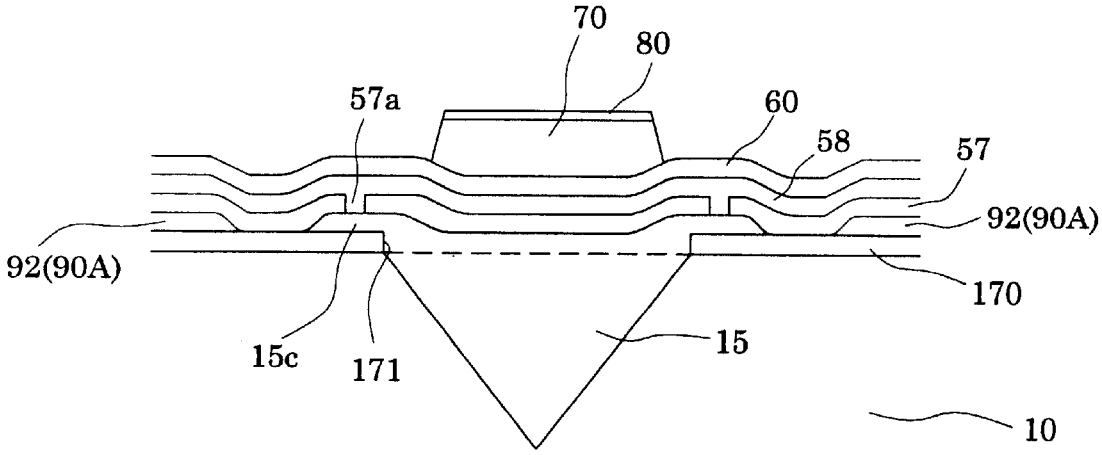
FIG. 61 is a sectional view showing a modification example of the ink-jet recording head according to embodiment 11 of the present invention.

Note that, in the present embodiment, the sacrificial layer 90A is finally completely removed, but not being limited to this, for example, as shown in FIG. 61, a remaining portion 92A, which is not to be removed in etching the remaining portion 91 may be left in the outside region of the space portion 15*c*. In the case of such a constitution, in patterning the sacrificial layer 90A, it is satisfactory that a groove portion may be formed across the peripheral portion of the opening portion 171 to completely separate the remaining portion 91 and the remaining portion 92.

(Other Embodiment)

As above, description has been made for each embodiment of the present invention, but the basic constitution of the ink-jet recording head is not limited to the above-described.

Figure 62:
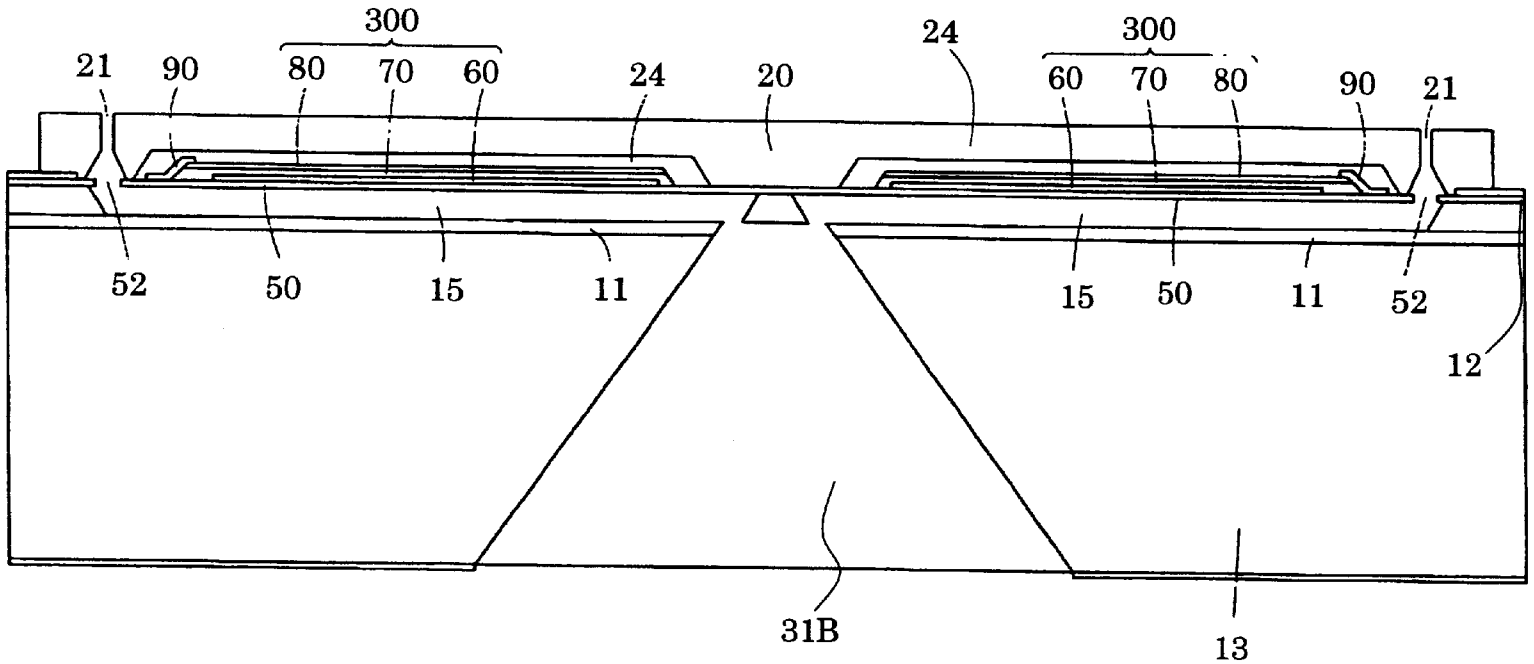
FIG. 62 is a sectional view of an ink-jet recording head according to another embodiment of the present invention.

For example, in the above-described embodiments, description has been made for the examples where a plurality of pressure generating chambers are parallelly provided on the passage-forming substrate in a row, but not being limited to this, for example, a plurality of rows of pressure generating chambers may be provided on the passage-forming substrate. In addition, in this case, as shown in FIG. 62, a reservoir 31B may be provided in a region corresponding to that between the rows of the pressure generating chambers 15 on the passage-forming substrate 10 so as to be common to two rows of the plurality of pressure generating chambers 15. Note that, in FIG. 62, an example of using an SOI substrate as the passage-forming substrate is shown, but as a matter of course, the passage-forming substrate may be a single crystal silicon substrate or the like.

As described above, the present invention can be applied to ink-jet recording heads of various structures as long as such application does not depart from the spirit of the present invention.

Figure 63:
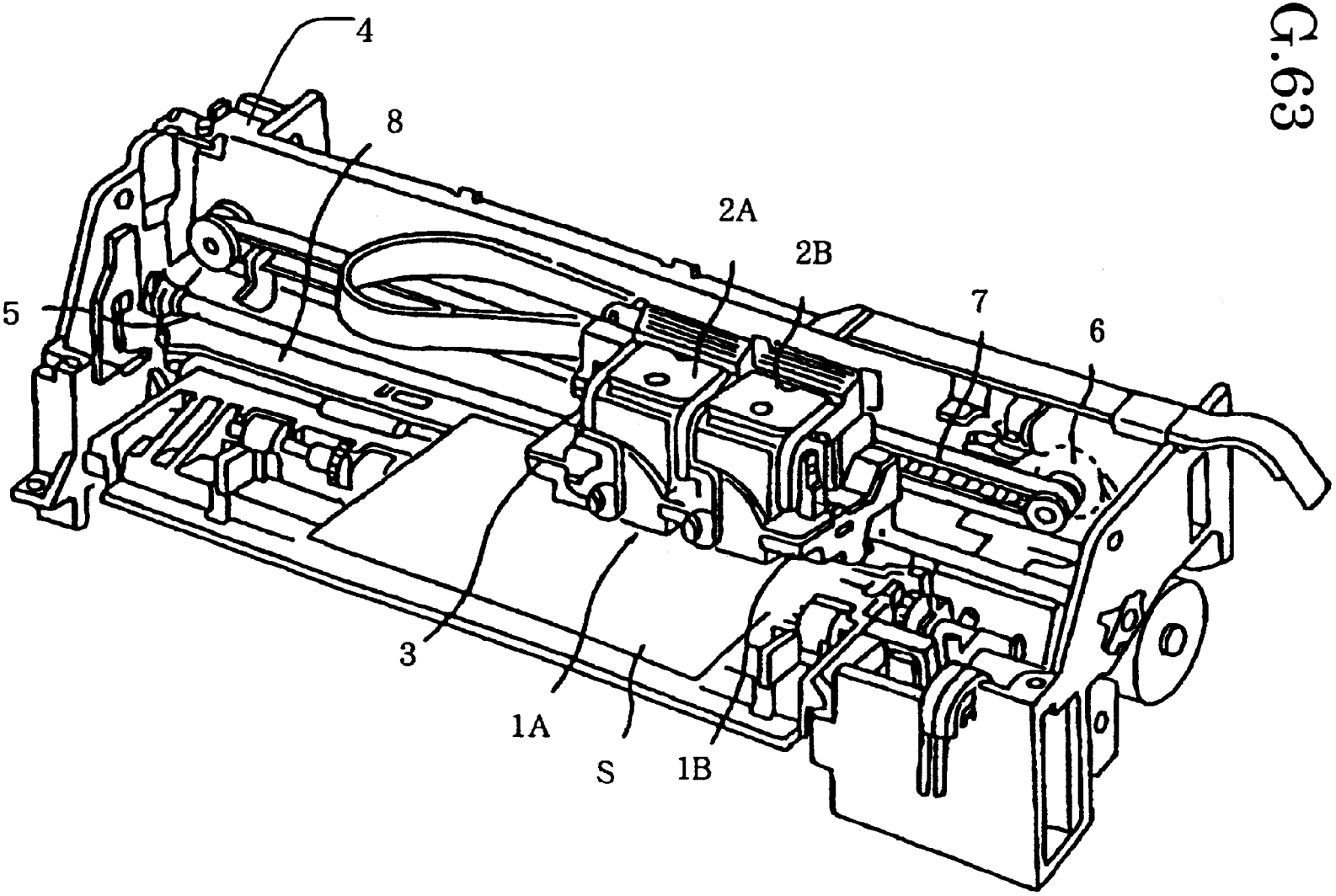
FIG. 63 is a schematic view of an ink-jet recording apparatus according to one embodiment of the present invention.

Moreover, these ink-jet recording heads of the respective ink-jet recording heads constitute a part of a recording head unit comprising an ink passage communicating with an ink cartridge and the like, and are mounted on an ink-jet recording apparatus. FIG. 63 is a schematic view showing one example of the ink-jet recording apparatus.

As shown in FIG. 63, in recording head units 1A and 1B, which have the ink-jet recording heads, cartridges 2A and 2B, which constitute ink supplying means, are detachably provided. A carriage 3 having these recording head units 1A and 1B mounted thereon is provided on a carriage shaft 5 attached onto an apparatus body 4 so as to be freely movable in the shaft direction. Each of these recording head units 1A and 1B, for example, is set to eject a black ink composition and a color ink composition.

And, a drive force of a drive motor 6 is transmitted to the carriage 3 via a plurality of gears (not shown) and a timing belt 7, thus moving the carriage 3 mounting the recording head units 1A and 1B along the carriage shaft 5. On the other hand, a platen 8 is provided onto the apparatus body 4 along the carriage shaft 5, and a recording sheet S that is a recording medium such as paper fed by a paper feeding roller (not shown) or the like is rolled and caught by the platen 8to be conveyed.

As described above, in the present invention, since the pressure generating chamber is shallowly formed, the rigidity of the compartment wall can be sufficiently secured. Accordingly, even if the plurality of pressure generating chambers are arranged in a high density, crosstalk can be securely prevented. Moreover, the compliance of the compartment wall can be freely set by changing the depth of the pressure generating chamber. Furthermore, the pressure generating chambers and the piezoelectric elements are formed respectively on two surfaces of a single crystal silicon substrate, thus enabling the head to be miniaturized.

In addition, in the case where the reservoir is formed in the passage-forming substrate, since the reservoir can be formed so as to have a relatively large volume, a pressure change in the reservoir is absorbed by ink itself in the reservoir, and thus it is not necessary to provide a compliance portion separately. Accordingly, the structure of the head can be simplified, and a manufacturing cost thereof can be reduced.

What is claimed is:

1. An ink-jet recording head comprising:

a passage-forming substrate having a silicon layer consisting of single crystal silicon, in which a pressure generating chamber communicating with a nozzle orifice is defined; and a piezoelectric element for generating a pressure change in the pressure generating chamber, the piezoelectric element being provided on a region facing said pressure generating chamber via a vibration plate constituting a part of said pressure generating chamber, wherein said pressure generating chamber is formed so as to open to one surface of said passage-forming substrate and not to penetrate therethrough, an etching stop surface, at which anisotropic etching has stopped, defines at least a bottom surface of said pressure generating chamber, the bottom surface facing to said one surface, without establishing communication between said pressure generating chamber and another flow passage via the bottom surface, and said piezoelectric element is provided at said one surface side of said passage-forming substrate by a film formed by film deposition technology and a lithography method.

2. The ink-jet recording head according to claim 1, wherein a piezoelectric layer constituting a part of the piezoelectric element has crystal subjected to priority orientation.

3. The ink-jet recording head according to claim 2, wherein said piezoelectric layer has crystal formed in a columnar shape.

4. The ink-jet recording head according to any one of claims 1 to 3, wherein said passage-forming substrate consists only of said silicon layer.

5. The ink-jet recording head according to claim 4, wherein said passage-forming substrate consists of single crystal silicon of plane orientation (110), and a plane (110) formed by half etching becomes said etching stop surface.

6. The ink-jet recording head according to claim 4, wherein said passage-forming substrate consists of single crystal silicon of plane orientation (100), and a (111) plane becomes said etching stop surface.

7. The ink-jet recording head according to claim 6, wherein a cross section of said pressure generating chamber has an approximately triangular shape.

8. The ink-jet recording head according to claim 6, wherein, in a region of said vibration plate, which faces each of the pressure generating chambers, a protruding portion protruding toward the pressure generating chamber side is formed across a longitudinal direction.

9. The ink-jet recording head according to claim 6, wherein a first film including an inner surface of said vibration plate constituting a part of said pressure generating chamber and a second film formed on said first film are provided, an etching hole for supplying an etching liquid to a surface of said one surface side of said passage-forming substrate in forming said pressure generating chamber is formed in said first film, and said etching hole is closed by said second film.

10. The ink-jet recording head according to claim 9, wherein said etching hole is formed in the region facing to said pressure generating chamber.

11. The ink-jet recording head according to any one of claims 8 to 10, wherein a protective layer having an opening portion in the region facing to said pressure generating chamber is provided on said passage-forming substrate, and said pressure generating chamber is formed by etching said passage-forming substrate via the opening portion of said protective layer.

12. The ink-jet recording head according to claim 11, wherein said protective layer is a polycrystal silicon layer having boron diffused therein.

13. The ink-jet recording head according to claim 11, wherein said etching hole is provided outside of the region facing said pressure generating chamber, and a space portion communicating with this etching hole is defined between said first film and said protective film.

14. The ink-jet recording head according to claim 9, wherein said pressure generating chamber is formed in an elongated shape, and said etching hole consists of a slit formed along the longitudinal direction of said pressure generating chamber.

15. The ink-jet recording head according to claim 9, wherein said etching hole consists of a plurality of pores provided at a specified interval.

16. The ink-jet recording head according to claim 9, wherein a lower electrode film constituting said piezoelectric element is formed on said second film, and the piezoelectric layer constituting said piezoelectric element is formed on said lower electrode film.

17. The ink-jet recording head according to claim 9, wherein said second film constitutes the lower electrode film constituting said piezoelectric element, and the piezoelectric layer constituting said piezoelectric element is directly formed on said second film.

18. The ink-jet recording head according to claim 9, wherein said first film is any one of a silicon oxide film, a silicon nitride film and a zirconium oxide film.

19. The ink-jet recording head according to claim 9, wherein said second film is any one of a silicon oxide film, a silicon nitride film and a zirconium oxide film, alternatively a laminated film obtained by laminating any of the films.

20. The ink-jet recording head according to claim 9, wherein the inner surface of said vibration plate forming a part of inner wall surfaces of said pressure generating chamber forms a convex shape toward a direction of said piezoelectric element, and said vibration plate forms a convex shape toward the direction of said piezoelectric element so as to correspond to the convex shape of the inner surface of said vibration plate.

21. The ink-jet recording head according to claim 1, wherein said passage-forming substrate has an insulation layer and passage layers, any one of which is a silicon layer, on both surfaces of said insulation layer, and a surface of said insulating layer becomes the etching stop surface.

22. An ink-jet recording head comprising:

a passage-forming substrate having a silicon layer consisting of single crystal silicon, in which a pressure generating chamber communicating with a nozzle orifice is defined; and a piezoelectric element for generating a pressure change in the pressure generating chamber, the piezoelectric element being provided on a region facing said pressure generating chamber via a vibration plate constituting a part of said pressure generating chamber, wherein said pressure generating chamber is formed so as to open to one surface of said passage-forming substrate and not to penetrate therethrough, an etching stop surface, at which anisotropic etching has stopped, defines at least a bottom surface of said pressure generating chamber, the bottom surface facing to said one surface, and a reservoir supplying ink to said pressure generating chamber is formed within said passage-forming substrate to be located on a side opposite said one surface with respect to the etching stop surface.

23. The ink-jet recording head according to claim 22, wherein said reservoir directly communicates with said pressure generating chamber.

24. The ink-jet recording head according to claim 22, wherein an ink communicating passage communicating with one end portion in the longitudinal direction of said pressure generating chamber is formed on one surface side of said passage-forming substrate, and said reservoir is made to communicate with said ink communicating passage.

25. The ink-jet recording head according to claim 24, wherein said ink communicating passage is provided for each of said pressure generating chambers.

26. The ink-jet recording head according to claim 24, wherein said ink communicating passage is continuously provided across a direction where said pressure generating chambers are parallelly provided.

27. The ink-jet recording head according to any one of claims 22 to 26, wherein said pressure generating chambers are parallelly provided along the longitudinal direction thereof, and said reservoir is provided between said pressure generating chambers parallelly provided along the longitudinal direction, and communicates with said pressure generating chambers at both sides.

28. The ink-jet recording head according to claim 1, wherein said pressure generating chambers are formed on both surfaces of said passage-forming substrate.

29. The ink-jet recording head according to claim 1, wherein said film constituting said piezoelectric element is provided on said pressure generating chamber and is a film formed on a sacrificial layer finally removed.

30. The ink-jet recording head according to claim 1, wherein a depth of said pressure generating chamber ranges between 20 $\mu$m and 100 $\mu$m.

31. The ink-jet recording head according to claim 1, wherein a nozzle communicating passage for allowing said pressure generating chamber and said nozzle orifice to communicate with each other is provided.

32. The ink-jet recording head according to claim 31, wherein said nozzle communicating passage is provided in one end portion side in the longitudinal direction of said pressure generating chamber, which is opposite that having said reservoir.

33. The ink-jet recording head according to claim 31 or 32, wherein said nozzle communicating passage is formed by removing said vibration plate.

34. The ink-jet recording head according to claim 33, wherein an inner surface of said nozzle communicating passage is covered with adhesive.

35. The ink-jet recording head according to claim 21 or 31, wherein said passage-forming substrate consists of an SOI substrate having silicon layers on both surfaces of an insulating layer of said SOI substrate, said pressure generating chamber is formed on one of said silicon layers constituting said SOI substrate, and the surface of said insulting layer becomes said etching stop surface.

36. The ink-jet recording head according to claim 35, wherein each of said silicon layers constituting said SOI substrate has a thickness different from that of the other, and said one silicon layer having said pressure generating chambers formed thereon is thinner than the other silicon layer.

37. The ink-jet recording head according to claim 35, wherein the nozzle communicating passage allowing said pressure generating chamber and said nozzle orifice to communicate with each other is formed in one of the silicon layers constituting said SOI substrate.

38. The ink-jet recording head according to claim 35, wherein the nozzle communicating passage allowing said pressure generating chamber and said nozzle orifice to communicate with each other penetrates said insulating layer constituting said SOI substrate and is formed on the other silicon layer, and said nozzle orifice is provided on a surface side of said other silicon layer.

39. The ink-jet recording head according to claim 37, wherein a sealing plate having a space for sealing said piezoelectric element inside thereof is joined onto said vibration plate, and said nozzle orifice is formed on the sealing plate.

40. The ink-jet recording head according to claim 37, wherein said nozzle communicating passage is extended from the end portion in the longitudinal direction of said pressure generating chamber, and said nozzle orifice is provided at the end surface side of said passage-forming substrate.

41. The ink-jet recording head according to claim 40, wherein said nozzle communicating passage is extended to the end surface of said passage-forming substrate, a nozzle plate having said nozzle orifice is joined to the end surface of the passage-forming substrate.

42. The ink-jet recording head according to claim 40, wherein said nozzle orifice is formed on an end portion of said nozzle communicating passage by removing a portion in the height direction of said silicon layer.

43. The ink-jet recording head according to any one of claims 39 to 42, wherein an IC is integrally formed in said sealing plate.

44. The ink-jet recording head according to claim 21 or 31, wherein a plane orientation of said silicon layer is a (001) plane.

45. The ink-jet recording head according to claim 44, wherein the longitudinal direction of said pressure generating chamber is a <110> direction.

46. The ink-jet recording head according to claim 21 or 31, wherein a main plane of the silicon layer where said pressure generating chamber is formed has a (110) orientation, and the longitudinal direction of said pressure generating chamber is of a <1-12> direction.

47. An ink-jet recording apparatus comprising the ink-jet recording head according to claim 1.

48. A method of manufacturing an ink-jet recording head, in which a piezoelectric element allowing a pressure generating chamber to generate a pressure change via a vibration plate is formed in a region facing said pressure generating chamber formed in a passage-forming substrate, said method of manufacturing an ink-jet recording head comprising the steps for:

forming the pressure generating chamber on the passage-forming substrate having at least a silicon layer consisting of single crystal silicon without penetrating to the height direction of said passage-forming substrate;

filling said pressure generating chamber with a sacrificial layer;

forming said vibration plate on said sacrificial layer side of said passage-forming substrate and forming said piezoelectric element in the region facing said pressure generating chamber; and removing said sacrificial layer from said pressure generating chamber via a flow passage at least a part of which is formed by said vibration plate.

49. The method of manufacturing an ink-jet recording head according to claim 48, wherein said passage-forming substrate consists of an SOI substrate having silicon layers consisting of single crystal silicon on both surfaces of an insulating layer, and in the step where a pressure generating chamber is formed, one of the silicon layers of said SOI substrate is patterned to form said pressure generating chamber.

50. The method of manufacturing an ink-jet recording head according to claim 48 or 49, wherein, during the step where a pressure generating chamber is formed, a nozzle communicating passage communicating with a nozzle orifice from an end portion in a longitudinal direction of the pressure generating chamber is also formed.

51. The method of manufacturing the ink-jet recording head according to claim 50, wherein an ink communicating passage allowing one side surface of said silicon layer and said pressure generating chamber to communicate with each other is formed, and in the step of removing a sacrificial layer, said sacrificial layer is removed by wet etching via the ink communicating passage.

52. The method of manufacturing the ink-jet recording head according to claim 48, wherein the step of removing a sacrificial layer is performed by etching via an opening portion penetrating said vibration plate to expose said sacrificial layer.

53. The method of manufacturing an ink-jet recording head according to claim 48, wherein the step of filling with a sacrificial layer includes: a step of forming said sacrificial layer so as to have at least a thickness approximately equal to the depth of said pressure generating chamber in a region corresponding to said pressure generating chamber of said passage-forming substrate; and a step of removing said sacrificial layer other than that of said pressure generating chamber by polishing.

54. The method of manufacturing an ink-jet recording head according to claim 53, wherein said sacrificial layer is formed by a jet molding method.

55. The method of manufacturing the ink-jet recording head according to claim 48, wherein said sacrificial layer is selected from a group consisting of phosphorous-doped silicate glass (PSG), boron phosphorous-doped silicate glass (BPSG), silicon oxide (SiOx) and silicon nitride (SiNx).

56. The method of manufacturing the ink-jet recording head according to claim 48, wherein the insulating layer is formed as said vibration plate, and a lower electrode layer, a piezoelectric layer and an upper electrode layer are sequentially formed in a laminated state and patterned to form said piezoelectric element.

57. The method of manufacturing the ink-jet recording head according to claim 56, wherein said vibration plate doubles as said lower electrode layer.

58. The method of manufacturing the ink-jet recording head according to claim 48, wherein said pressure generating chamber and an ink passage are formed by anisotropic etching.

59. A method of manufacturing an ink-jet recording head, which comprises: a passage-forming substrate consisting of a single crystal silicon substrate, in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, said method of manufacturing an ink-jet recording head comprising the steps of:

forming a region that will be a space portion between said vibration plate and said passage-forming substrate on a side of said passage-forming substrate where the vibration plate is formed;

forming said vibration plate on a surface of said passage-forming substrate;

laminating sequentially said lower electrode film, said piezoelectric layer and said upper electrode film on said vibration plate and patterning the same to form said piezoelectric element; and forming said pressure generating chamber by performing anisotropic etching for said passage-forming substrate from said piezoelectric element side via said space portion.

60. The method of manufacturing the ink-jet recording head according to claim 59, wherein the step of forming a space portion includes: a first depositing step of forming a polycrystal silicon film on the one surface of said passage-forming substrate; and a boron diffusing step of diffusing highly concentrated boron in a region of said polycrystal silicon film, which excludes a region corresponding to a pressure generating chamber forming portion in said passage-forming substrate, and the step for forming a pressure generating chamber includes: a hole forming step for removing the other part of the region of said vibration plate, the region corresponding to said pressure generating chamber forming portion in said passage-forming substrate, to form an etching hole; and a step of removing a portion of the polycrystal silicon film where boron is not diffused and one side surface portion of the passage-forming substrate under the portion by anisotropic wet etching from said etching hole.

61. The method of manufacturing the ink-jet recording head according to claim 60, wherein said boron diffusing step diffuses boron so that a Boron containing density thereof can be $1\times10^{20}$ number/$cm^3$ or more.

62. The method of manufacturing the ink-jet recording head according to claim 60 or 61, wherein said boron diffusing step includes: a mask forming step of forming a mask film on an upper surface of a region of said polycrystal silicon film, the region corresponding to said pressure generating chamber forming portion in said passage-forming substrate; a boron imparting step of imparting boron to approximately the entire surface of the upper surface of said polycrystal silicon film; and a mask removing step of removing said mask film.

63. The method of manufacturing an ink-jet recording head according to claim 59, further comprising a reservoir forming step of forming a reservoir reaching said pressure generating chamber from the other side surface of said passage-forming substrate.

64. The method of manufacturing an ink-jet recording head according to claim 63, wherein said passage-forming substrate is entirely constituted of single crystal silicon, and said reservoir forming step includes: a third depositing step of forming a protective film on the other side surface of said passage-forming substrate; a hole forming step of removing a region of said protective film, which corresponds to a reservoir forming portion in said passage-forming substrate, to form the etching hole; and a reservoir etching step of removing the reservoir forming portion reaching said pressure generating chamber from the other side surface of said passage-forming substrate by anisotropic wet etching from said etching hole.

65. The method of manufacturing the ink-jet recording head according to claim 63, wherein said passage-forming substrate is an SOI substrate in which the other side surface is constituted of single crystal silicon and the center portion is constituted of an insulating layer, said pressure generating chamber forming step forms said pressure generating chamber so that a bottom portion of said pressure generating chamber can be regulated by the insulating layer, and said reservoir forming step includes: a third depositing step of forming a protective film on the other side surface of said passage-forming substrate; a hole forming step of removing a region of said protective film, which corresponds to a reservoir forming portion in said passage-forming substrate, to form the etching hole; a reservoir etching step of removing a first reservoir forming portion reaching the insulating layer from the other side surface of said passage-forming substrate by anisotropic wet etching from said etching hole; and an insulating layer removing step of removing a part of the insulating layer to form a second reservoir forming portion allowing said pressure generating chamber and the first reservoir forming portion to communicate with each other.

66. The method of manufacturing the ink-jet recording head according to claim 64 or 65, wherein said protective film is selected from a group consisting of silicon nitride, silicon dioxide and zirconium oxide.

67. The method of manufacturing the ink-jet recording head according to claim 63, wherein said pressure generating chamber forming step and said reservoir etching step are simultaneously executed.

68. The method of manufacturing the ink-jet recording head according to claim 59, further comprising a protective film forming step of forming the protective film protecting said piezoelectric element after the step of forming the piezoelectric element.

69. The method of manufacturing the ink-jet recording head according to claim 68, wherein said hole forming step is constituted for removing the other part of a region of an elastic film and the protective film, which corresponds to said pressure generating chamber forming portion in said passage-forming substrate.

70. The method of manufacturing the ink-jet recording head according to claim 59, wherein said passage-forming substrate consists of a single crystal silicon substrate of crystal plane orientation (100), the step of forming a space portion includes a step of forming a groove portion having a width narrower than the pressure generating chamber in the region of said passage-forming substrate where said pressure generating chamber is formed, and the step of forming a pressure generating chamber includes: a step of patterning said vibration plate to form a communicating hole communicating with the groove portion in a region respectively facing to said groove portion; and the step of forming said pressure generating chamber in an approximately triangular shape in a cross section by performing anisotropic etching for said passage-forming substrate via the communicating hole.

71. The method of manufacturing the ink-jet recording head according to claim 70, wherein said groove portion is formed to have a depth shallower than that of said pressure generating chamber.

72. The method of manufacturing the ink-jet recording head according to claim 59, wherein the step of forming a space portion includes: a first etching step of etching a part of the surface of said passage-forming substrate so as to leave a plurality of columnar portions; and a transforming and flattening step of transforming a chemical property of said plurality of columnar portions and flattening a part of said surface, and the step of forming a pressure generating chamber includes: a hole forming step of removing the other part of the region of said vibration plate, which corresponds to said pressure generating chamber forming portion in said passage-forming substrate to form an etching hole; and a second etching step of etching said plurality of columnar portions having the chemical property transformed by anisotropic wet etching from said etching hole to form the pressure generating chamber.

73. The method of manufacturing the ink-jet recording head according to claim 72, wherein said transforming and flattening step includes a thermally oxidizing step of thermally oxidizing said plurality of columnar portions.

74. The method of manufacturing the ink-jet recording head according to claim 73, wherein said transforming and flattening step includes a sacrificial layer filling step of filling spaces of said plurality of columnar portions with a sacrificial layer.

75. The method of manufacturing the ink-jet recording head according to any one of claims 72 to 74, wherein said plurality of columnar portions are formed to be arranged approximately uniformly on a part of said surface.

76. The method of manufacturing the ink-jet recording head according to claim 72, wherein each of said plurality of columnar portions has a sectional area of a surface side thereof, which is larger than that of the bottom portion side thereof.

77. The method of manufacturing the ink-jet recording head according to claim 72, wherein the shape of said pressure generating chamber is approximately hexagonal.

78. A method of manufacturing the ink-jet recording head, which comprises: a passage-forming substrate consisting of a single crystal silicon substrate of crystal plane orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, said method of manufacturing an ink-jet recording head comprising the steps of:

forming a polycrystal silicon film on a surface of said passage-forming substrate of (100) plane orientation, which includes said surface and a back surface;

diffusing boron in the vicinity of inner surfaces of said polycrystal silicon film and said single crystal silicon substrate excluding the region that will be said pressure generating chamber;

forming a first film on said polycrystal silicon film;

forming an etching hole for supplying an etching liquid to the portion where said pressure generating chamber is formed in said first film;

supplying the etching liquid to the portion where said pressure generating chamber is formed via said etching hole, and etching said surface of said single crystal silicon substrate by anisotropic wet etching by means of a pattern of an undoped portion of said polycrystal silicon film etched by isotropic wet etching by use of the etching liquid to form said pressure generating chamber; and forming a second film on said first film to close said etching hole.

79. A method of manufacturing the ink-jet recording head, which comprises: a passage-forming substrate consisting of a single crystal silicon substrate of crystal plane orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, said method of manufacturing an ink-jet recording head comprising the steps of:

forming a polycrystal silicon film on a surface of said passage-forming substrate of (100) plane orientation, which includes said surface and a back surface;

removing said polycrystal silicon film excluding the region that will be said pressure generating chamber to form the polycrystal silicon film of a specified pattern;

forming a first film on said polycrystal silicon film of a specified pattern and on said surface of said single crystal silicon substrate;

forming an etching hole for supplying an etching liquid to a portion where said pressure generating chamber is formed in said first film;

supplying the etching liquid to the portion where said pressure generating chamber is formed via said etching hole, and etching said surface of said single crystal silicon substrate by anisotropic wet etching by means of said specified pattern of said polycrystal silicon film etched by isotropic wet etching by use of the etching liquid to form said pressure generating chamber; and forming a second film on said first film to close said etching hole.

80. The method of manufacturing the ink-jet recording head according to any one of claims 76 to 79, wherein said etching hole consists of a plurality of pores formed at a specified interval.

81. A method of manufacturing the ink-jet recording head, which comprises: a passage-forming substrate consisting of a single crystal silicon substrate of crystal plane orientation (100), in which a pressure generating chamber communicating with a nozzle orifice ejecting ink is defined; and a piezoelectric element consisting of a lower electrode film, a piezoelectric layer and an upper electrode film, the piezoelectric element being provided on one surface of the passage-forming substrate via a vibration plate, said method of manufacturing an ink-jet recording head comprising the steps of:

forming a protective layer on a surface of said passage-forming substrate of (100) plane orientation, which includes said surface and a back surface, and forming an opening portion in a region of the protective layer, which will be the pressure generating chamber;

forming a sacrificial layer on this protective layer and patterning the sacrificial layer to leave at least the region covering said opening portion as a remaining portion;

forming a first film on this sacrificial layer;

forming an etching hole communicating with a peripheral portion of said sacrificial layer formed on said protective layer;

supplying an etching liquid via said etching hole to remove said sacrificial layer, and performing anisotropic etching for said passage-forming substrate from said surface side by said specified pattern of said protective layer to form said pressure generating chamber; and forming a second film on said first film to close said etching hole.

82. The method of manufacturing the ink-jet recording head according to claim 81, wherein, in the step of patterning said sacrificial layer, a groove portion is formed across a periphery of the opening portion of said protective layer.

83. The method of manufacturing the ink-jet recording head according to any one of claims 78 to 82 herein said pressure generating chamber is formed in an elongate shape, and said etching hole consists of a slit formed along a longitudinal direction of said pressure generating chamber.

84. A method of manufacturing the ink-jet recording head, in which a pressure generating chamber is formed on a passage-forming substrate, and a piezoelectric element consisting of a lower electrode, a piezoelectric layer and an upper electrode is formed on one surface of said passage-forming substrate via a vibration plate, said method of manufacturing an ink-jet recording head comprising the steps of:

forming said passage-forming substrate having a silicon layer consisting of a single crystal silicon substrate on each of both surfaces of a polysilicon layer to which etching selectivity is imparted by doping boron in a region other than that having said pressure generating chamber formed therein;

laminating sequentially said lower electrode, said piezoelectric layer and said upper electrode in one silicon layer of said passage-forming substrate via a vibration plate and patterning the same to form said piezoelectric element;

etching the other silicon layer of said passage-forming substrate to reach said polysilicon layer, thus forming an ink introducing port, patterning said polysilicon layer in the region that will be said pressure generating chamber via the ink introducing port, and etching said one silicon layer with the polysilicon layer as a mask, to form said pressure generating chamber.

85. The method of manufacturing the ink-jet recording head according to claim 84, wherein the step of forming said passage-forming substrate includes a step of doping boron on the surface of said other silicon layer joining to said polysilicon layer, which is at least a surface layer of the region facing said pressure generating chamber.

* * * * *